US006502251B1

(12) United States Patent
Teshima et al.

(10) Patent No.: US 6,502,251 B1
(45) Date of Patent: Jan. 7, 2003

(54) WATER CLOSET AND FLUSHING WATER FEED DEVICE

(75) Inventors: Kunihiko Teshima, Kitakyushu (JP); Tatsuhiro Kosugi, Kitakyushu (JP); Taiji Sugita, Kitakyushu (JP); Takayuki Ohtani, Kitakyushu (JP); Kenichi Nagato, Kitakyushu (JP); Yoshitaka Suehiro, Kitakyushu (JP)

(73) Assignee: TOTO Ltd., Fukuoka (JP)

( * ) Notice: Subject to any disclaimer, the term of this patent is extended or adjusted under 35 U.S.C. 154(b) by 37 days.

(21) Appl. No.: 09/830,867

(22) PCT Filed: Aug. 16, 2000

(86) PCT No.: PCT/JP00/05494

§ 371 (c)(1),
(2), (4) Date: Apr. 30, 2001

(87) PCT Pub. No.: WO01/23678

PCT Pub. Date: Apr. 5, 2001

(30) Foreign Application Priority Data

Sep. 27, 1999 (JP) ..... 11-271471
Aug. 4, 2000 (JP) ..... 2000-236938

(51) Int. Cl.[7] ..... E03D 1/00
(52) U.S. Cl. ..... 4/300; 4/374; 4/377; 4/425
(58) Field of Search ..... 4/300, 328, 329, 4/331, 332, 336, 374, 377, 415, 421, 425

(56) References Cited

U.S. PATENT DOCUMENTS

| | | | | | |
|---|---|---|---|---|---|
| 1,020,962 | A | * | 3/1912 | Cable | 4/108 |
| 1,402,137 | A | * | 1/1922 | Polhemus et al. | 4/374 |
| 2,658,203 | A | * | 11/1953 | Aue | 4/332 |
| 4,183,108 | A | | 1/1980 | Hamilton | |
| 5,502,845 | A | * | 4/1996 | Hayashi et al. | 4/300 |
| 5,579,542 | A | | 12/1996 | Hayman | |
| 5,887,294 | A | * | 3/1999 | Yeung | 4/415 |

FOREIGN PATENT DOCUMENTS

| | | |
|---|---|---|
| JP | 10-102568 | 4/1998 |
| WO | WO 91/16508 | 10/1991 |

* cited by examiner

*Primary Examiner*—Gregory Huson
*Assistant Examiner*—Huyen Le
(74) *Attorney, Agent, or Firm*—Beyer Weaver & Thomas

(57) ABSTRACT

A flush toilet 1 has a toilet flushing tank device 7 for discharging flushing water to a toilet bowl 2. This tank device is built into a tank storage region 5 to the rear of the toilet bowl 2, and comprises a flushing water tank 8 and a jet pump 13 disposed submerged in this flushing water tank 8. Flushing water (operating water) is supplied to this jet pump 13 via a flush valve 11 and a pipe 12 downstream from this valve. The jet pump 13 comprises a spray nozzle 131 and a throat 132 opposite thereto. Because the jet pump 13 is connected directly to a pipe 14, all of the flushing water jetted from the jet pump 13 passes directly to the pipe 14, and is guided by this pipe 14 to a rim water channel 4*b*.

47 Claims, 39 Drawing Sheets

*Fig. 39*

| NO. | Through hole | Inside diameter D2 of inlet (mm) | Total quantity Q (liters) |
|---|---|---|---|
| 1 | 420g2 | 1.2 | 5 |
| 2 | 420h2 | 1.1 | 5.5 |
| 3 | 420i2 | 1.0 | 6 |
| 4 | 420j2 | 0.9 | 6.5 |
| 5 | 420k2 | 0.8 | 7 |
| 6 | 420l2 | 0.7 | 7.5 |
| 7 | 420m2 | 0.6 | 8 |
| 8 | 420n2 | 0.5 | 8.5 |

WATER CLOSET AND FLUSHING WATER FEED DEVICE

TECHNICAL FIELD

This invention relates to a flush toilet and to a water supply device for supplying flushing water to various destinations, including this flush toilet.

BACKGROUND ART

With a typical flush toilet, flushing water is held in a flushing water tank arranged above the toilet, and the head of the water is utilized to discharge the flushing water into the toilet. In recent years, however, many different flushing methods have been proposed that do not merely utilize the flushing water head in this manner.

For instance, Japanese Patent Publication Gazette H6-99952 proposes a flush toilet in which pressurized flushing water is discharged from the flushing water tank into the toilet to remove the waste from the toilet. With a pressurized flushing system such as this, the head of the water is not utilized, and instead a large flow of flushing water is discharged into the toilet, so the flushing water tank and any ancillary equipment can be installed inside the toilet. An advantage of this layout was that the bathroom was more spacious and pleasant.

Japanese Patent Laying-Open Gazette H10-102568 proposes a flushing system that increases the flow in the discharge of flushing water by utilizing the flushing water head as mentioned above. With this flushing system, a spray nozzle facing the opening of the flush valve seat is disposed within the flushing water tank, and when the toilet is flushed, flushing water is jetted from the flush valve seat and the spray nozzle, producing a stream of flushing water aimed at t he flush valve opening. This flushing water stream induces an ejector action similar to that of a jet pump as it flows into the opening of the flush valve seat. This allows the flushing water inside the toilet flushing tank device to be forcibly sucked into the opening of the flush valve seat, and increases the discharge flow of flushing water as compared to a flushing method that merely utilizes the water head. Therefore, with a flushing method that makes use of this flushing water jetting system, a large flow of flushing water can be discharged into the toilet even if the flushing water head is small. Reducing the flushing water head affords a reduction in the height of the flushing water tank, which in turn allows the entire tank to be smaller, which makes the bathroom more spacious and pleasant.

Although a flushing method that featured either the above-mentioned pressurization system or the flushing water jetting system did make the bathroom more spacious and pleasant, the following problems were also encountered.

With a flushing method featuring a pressurized system, a pressure vessel was essential for pressurizing the flushing water in the toilet flushing tank device. Thus, to ensure a good seal, assembly took longer and higher cost was inevitable, which meant that the toilet flushing tank device and in turn the flush toilet were more expensive. Also, by its very nature, the pressure vessel required care in its handling and maintenance so as to prevent the loss of sealing.

With the flushing water jetting system disclosed in Japanese Patent Laying-Open Gazette H10-102568, the spray nozzle must be positioned so as not to interfere with the flush valve, which is opened and closed by a chain, and this spray nozzle must face the opening in the flush valve seat. Because of this mechanical layout, the outlet of the spray nozzle got in the way of the chain that lifted the flush valve, and therefore could not be directly across from the flush valve seat opening, with the spray nozzle outlet instead set off to an angle from the opening in the flush valve seat. As a result, the stream emitted from the spray nozzle would sometimes hit the walls around the opening of the flush valve seat or the area close to the opening and be slowed down, or the jetted flushing water would be diverted as it flowed out of the valve opening. Consequently, the ejector action was not fully produced and a significant increase in flushing water discharge flow could not be achieved. This means that the flushing water has to be held in the tank device with a certain amount of head with respect to the toilet, so the flushing water tank position is once again higher and the bathroom space above the toilet is more cramped. Because of this, there was room for improvement in the bathroom environment in terms of expanding bathroom space above the toilet and ensuring a comfortable amount of bathroom space.

The above problems encountered with the supply of flushing water will be described using a flush toilet as an example. Nevertheless, these problems, namely, having to ensure a flushing water head, inadequate increase in flow by flushing water jetting, problems attendant to the use of a pressure vessel, and so on, also occur in devices that supply flushing water to destinations other than a flush toilet, and are common to flushing water supply devices.

The present invention was conceived in an effort to solve the above problems, and it is an object thereof to allow more freedom in how the flushing water is held and effectively increase the flushing water discharge flow to a flushing water destination. It is another object thereof to improve the bathroom environment with a flush toilet, in which the destination is a toilet. And another object of this invention is to provide a flush toilet that has a high quality of design and is not limited the manner of holding flushing water through increasing freedom in how the flushing water is held.

DISCLOSURE OF THE INVENTION

In order to solve at least part of these problems, the flush toilet of the present invention is:

- a flush toilet, which flushes a toilet bowl with flushing water, comprising:
- a toilet flushing tank device having a flushing water tank that reserves flushing water; and
- a supply line that is arranged to introduce flushing water from the toilet flushing tank device into the toilet bowl and has openings at both end of the supply line,
- the toilet flushing tank device including:
  - a jet pump having a spray nozzle and a throat disposed across from the nozzle; and
  - a nozzle water supply unit for supplying operating water to the spray nozzle and jetting the operating water from the spray nozzle into the throat,
  - the throat being connected to one end of the supply line so that the flushing water jetted from the throat flows into the supply line,
  - the jet pump being disposed submerged in the flushing water tank so that the flushing water in the flushing water tank flows into the throat along with the jetting of the flushing water from the spray nozzle.

Also, in order to solve at least part of these problems, the flushing water supply device of the present invention is:

- a water supply device for supplying flushing water, comprising:
- a flushing water tank that reserves flushing water;

a supply line that is arranged to introduce flushing water in the flushing water tank to its destination and has openings at both end of the supply line, a jet pump having a spray nozzle and a throat disposed across from the nozzle; and a nozzle water supply unit for supplying operating water to the spray nozzle and jetting the operating water from the spray nozzle into the throat, the throat being connected to one end of the supply line so that the flushing water jetted from the throat flows into the supply line, the jet pump being disposed submerged in the flushing water tank so that the flushing water in the flushing water tank flows into the throat along with the jetting of the flushing water from the spray nozzle.

With the flush toilet and the flushing water supply device of the present invention structured as above, the only difference in structure is that the flushing water supply destination is specified to be a toilet, and the flushing water supply function is the same. Thus, the following description will be of how the water is supplied and so forth in a flush toilet as the specified supply destination.

Because the flush toilet of the present invention has the above structure, the operating water supplied to the nozzle water supply unit is jetted from the spray nozzle. This jetted flushing water (operating water) flows into the throat without being slowed down because the spray nozzle and throat are disposed across from each other in the jet pump. Furthermore, the jetted flushing water is not diverted as it flows out of the throat. This creates a highly efficient ejector action, and the tank flushing water around the jet pump submerged in the flushing water tank is drawn into the throat along with the jetting of the flushing water by the spray nozzle. Beyond this throat, the jetted flushing water and the tank flushing water that flows into the throat both flow into the supply line and are guided to the toilet. Because this throat is directly connected to the one end of the supply line, which has openings at both end of the supply line, all of the flushing water is able to flow into the supply line even while the above-mentioned two flows of flushing water are going from the throat into the supply line. As a result, the flushing water discharge flow to the toilet (the flushing water supply destination) can be effectively increased.

The above-mentioned flush toilet and flushing water supply device of the present invention can assume the following configuration. The nozzle water supply unit supplies the operating water so that the flushing water jetted from the throat will be continuously gushed upward beyond a predetermined full level of the flushing water tank throughout the toilet flushing period. So, the toilet can be continuously flushed with flushing water in an increased state of flow. In the flushing water supply device, the flushing water from the throat will be continuously jetted throughout the required supply period.

Continuous flushing with flushing water in this state of increased flow yields the following advantages. The above increase in flow occurs without the benefit of any head between the toilet and the flushing water inside the flushing water tank. Thus, a tank flushing water head of zero with respect to the toilet can be attained, affording greater freedom in how the flushing water is held. Furthermore, with a flush toilet, this zero head also allows the flushing water tank position to be lower than the top of the toilet, so that the flushing water tank and the tank device having it to not stick up much above the top of the toilet. Accordingly, in which this tank device is disposed above the toilet, there is more bathroom space and the bathroom space is more pleasant. And, it is achieved to provide a flush toilet that has a high quality of design and is not limited the manner of holding flushing water.

In addition, the flush toilet and the flushing water supply device of the present invention require no pressure vessel to achieve the above-mentioned increase in flow. Accordingly, the structure can be simplified, assembly time and cost are reduced, and this leads to lower cost of the water supply device and the flush toilet. Furthermore, since no expensive pressure device is needed, the bathroom environment can be improved inexpensively.

The above-mentioned flush toilet and flushing water supply device of the present invention can assume the following another configuration. The supply line can have a line route that passes through a location higher than the full water level of the flushing water tank, and have a line terminal at a location higher than the full water level.

If so, when the supply of flushing water from the supply line to the toilet or other supply destination is halted upon completion of water supply and the tank is full, or more specifically, when the flushing of the toilet is finished and the toilet is ready for the next flush, air can be guided from the line terminal to a line route at a location higher than the full water level so that this air will be present in the above-mentioned line route. The supply line will therefore not be subjected to any siphoning action, so the flushing water will not be unintentionally released from the tank side to the supply line in this state. Furthermore, since the air present in the route halts the supply of flushing water, there is no need for a valve mechanism for opening and closing the supply line in the jetting of the flushing water from the jet pump. As a result, the flow of jetted flushing water will not be slowed by collision with the chain for opening and closing the valve or the like, as was discussed regarding prior art.

Also, the nozzle water supply unit can have a backflow check valve for preventing backflow of the flushing water from the spray nozzle side, or the supply line can have a backflow check valve for preventing backflow of the flushing water from the toilet side. This has the following advantages.

Two scenarios are envisioned with the flush toilet of the present invention: the backflow of the flushing water of the toilet through the supply line to the flushing water tank side, and the backflow of the flushing water of the flushing water tank through the jet pump to the side with the nozzle water supply unit and the primary water supply pipe upstream thereof. The former backflow can be avoided with a backflow check valve provided to the supply line, while the latter can be avoided with a backflow check valve provided to the nozzle water supply unit.

In this case, it is convenient for the backflow check valve to be a so-called vacuum breaker in which the inside of the valve is open to the atmosphere. When this vacuum breaker is provided to the supply line, installing it along the line route at a location higher than the above-mentioned full water level is preferable in terms of effectively opening the system to the atmosphere.

It is also possible for the quantity of flushing water guided through the supply line to the toilet bowl to be set to a selected one of a plurality of preset flushing water quantities. This allows the toilet to be flushed with a quantity of water that suits the water availability, local laws where the flush toilet is installed, and so forth.

The flush toilet of the present invention can further comprise:

a control component that is operated for enabling a user to select one of a plurality of flushing type including a first type flush and a second type flush, the second type flush being different in water quantity from the first type flush, and to instruct the nozzle water supply unit to start the flushing the toilet bowl; and a water quantity setting component for setting the quantity of the flushing water, which is introduced into the toilet through the supply line, according to the selected flushing type, wherein the water quantity setting component sets the flushing water quantity to a first water quantity during the first type flush when the control component is operated for a first instruction of starting to flush the toilet bowl with a first pattern, and sets the flushing water quantity to a second water quantity that is larger than the first water quantity during the second type flush when the control component is operated for a second instruction of starting to flush the toilet bowl with a second pattern.

This allows the toilet to be flushed at the first flush, for example after urination, with a first water quantity (a small quantity) of flushing water, or to be flushed at the second flush, for example after defecation, with a second water quantity (a larger quantity) of flushing water, according to how the control component is operated. In other words, the toilet can be flushed with a quantity of water corresponding to whether the toilet is used for defecation or urination.

In setting the water quantity in this way, the quantity in which the flushing water inside the flushing water tank flows into the throat along with the jetting of the flushing water by the spray nozzle can be limited. And, the quantity can be limited during the first type flush.

This allows setting the water quantity through limiting the quantity of the water flowing into the throat.

There are few method to limit the quantity of the water flowing into the throat. One is adjusting to wide or narrow a gap, which is formed between the spray nozzle outlet and throat inlet, another is adjusting to wide or narrow an effective passage area of throat in which flushing water flows.

The limiter for performing this limiting can have:

an in-tank shroud that surrounds the jet pump disposed submerged in the flushing water tank;

a water passage component that allows the flushing water in the tank to pass into and out of the in-tank shroud; and a water passage valve that prevents the passage of flushing water through the water passage component during the first flush, but allows the passage of flushing water through the water passage component during the second flush.

If so, the flushing water at a first type flush (for example after urination) will be the flushing water within the tank region and the quantity thereof will be small first supply quantity, but at a second type flush (for example after defecation), the flushing water will be the flushing water both inside and outside the tank region and the quantity thereof will be a second supply quantity which is larger the first supply quantity. This flow limiting can be easily accomplished by means of a water passage valve.

In the setting of the water quantity, the quantity of operating water supplied from the nozzle water supply unit to the spray nozzle can be set to a first supply quantity corresponding to the first water quantity during the first type flush, and can be changed to a second supply quantity corresponding to the second water quantity during the second type flush.

If this is done, the quantity of flushing water jetted from the spray nozzle will be either the smaller first supply quantity or the larger second supply quantity, and the flushing water sucked into the throat along with the jetting of the flushing water can be varied between a large and small quantity according to whether a large or small supply quantity of flushing water is jetted, and as a result, the quantity of flushing water going to the toilet can be varied between large and small.

Also, the throat can be a venturi tube having a constricted portion in which the line diameter is narrower, in which case a negative pressure will be generated at the constricted part inside the throat, by which an ejector action can be produced. Thus, the flow of the jet pump is increased more efficiently through better efficiency in the suction of the tank flushing water.

Also, an outer edge of the spray nozzle and an inlet edge of the throat are separated away and a gap, which is formed between the spray nozzle outlet and the throat inlet, opens into the internal space of the flushing water tank.

If so, the flushing water will be able to flow freely into the throat inlet from all directions of the gap between the spray nozzle outlet and the throat inlet. Accordingly, by jetting the flushing water from the spray nozzle, the flushing water around the jet pump can be efficiently made to flow into the throat inlet from all directions of the gap, and the flow of flushing water will be increased more efficiently. As a result, a greater flow of flushing water will be guided to the toilet through the supply line, allowing the toilet to be flushed more effectively.

In this case, the flushing water tank can have a depression in its bottom, and the jet pump can be installed in this depression. This allows all the flushing water in the tank except that in the depression to be expelled, so less flushing water remains in the tank without being sucked up by the jet pump. Furthermore, if the tank bottom slopes down toward the above-mentioned depression, the flushing water in the tank will accumulate in the depression more readily, which again helps to reduce the amount of water remaining in the tank.

Also, the spray nozzle can be arranged such that its outlet is directed upward, and preferably diagonally upward.

If this is done, the throat downstream from the spray nozzle will also face in this direction, so the flushing water can be supplied through the throat and the supply line to a location at substantially the same height as the flushing water level or a location above the water level. Thus, the flushing water tank can be disposed to the side of the toilet (more specifically, to the rear and the side of the toilet) or at a location lower than the toilet, which affords more freedom in how the flushing water is held in the flushing water tank. Accordingly, the entire tank device including the flushing water tank located as above will not stick up above the top of the toilet very much, allowing the tank device height to be kept low. As a result, there is more bathroom space above the toilet and the bathroom space is more pleasant, so the bathroom environment is improved. And, it is achieved to provide a flush toilet that has a high quality of design and is not limited the manner of holding flushing water.

Other structures are also possible when the nozzle orientation is as above. Specifically, the flush toilet can further comprise a rim formed so as to encircle an upper edge of the toilet bowl of the toilet, and have a rim water-discharge mechanism that allows flushing water to be discharged from this rim along the surface of the toilet bowl, and the throat disposed across from the spray nozzle can be linked to the rim water-discharge mechanism via the supply line.

With this structure, tank flushing water passes from a flushing water tank located to the rear and side of the toilet or located lower than the toilet without interfering with the rim water-discharge mechanism, allowing the toilet to be flushed by the discharge of water from the rim. Also, since the rim water-discharge mechanism is disposed in proximity to the flushing water tank and the device thereof, the supply line is shorter, which reduces friction between the inner walls of the branched pipes thereof and the water, and allows pressure loss to be minimized. Thus, the energy loss of the flushing water is reduced and the toilet flushing effectiveness of the flushing water is enhanced.

Alternatively, the jet pump can be constructed such that its height inside the flushing water tank is adjustable. This has the following advantages.

When the level of the flushing water inside the flushing water tank drops to the level of the throat inlet, air is drawn into the throat, so the flow increasing action of the jet pump stops and the large flow discharge of flushing water from the supply line and beyond ends. Therefore, the duration of the large flow discharge of flushing water is adjustable by adjusting the height at which the jet pump is located within the flushing water tank, and thereby raising or lowering the throat inlet. The total discharge flow of flushing water is adjustable by means of this duration adjustment. Accordingly, even though the total flushing water flow that is required may vary with the type of toilet (such as toilet types with different bowl capacities or quantities of standing water in the toilet bowl), the amount of waste, and so forth, flushing water can be discharged into the toilet in a total flow that is optimal for the type of toilet and so on through adjustment of the height at which the jet pump is located within the flushing water tank. This height adjustment can be accomplished with a piston or other suitable actuator.

In this case, if the jet pump height is adjusted according to urination or defecation, the toilet can be flushed using a flushing water quantity appropriate for how it is being used each time.

Also, the flush toilet further comprises a tank water supply unit that supplies flushing water to the flushing water tank until the flushing water level reaches the full level of the tank when the flushing water level inside the flushing water tank drops to a predetermined level where water supply is required.

This allows the tank to be refilled after flushing water has been jetted from the jet pump, and to be readied for the next flush.

The following are other options. The toilet flushing tank device can be unseparatively built in the toilet, or the toilet flushing tank device can be formed integrally with a toilet-body. In addition, the toilet flushing tank device can separatively rest directly on a toilet-body.

With any of these configurations, there is more bathroom space above the toilet, the bathroom feels more spacious, and the bathroom environment is improved. Furthermore, because integration with the toilet-body makes molding possible, fewer parts are required and parts control is simplified during the manufacture of the flush toilet, which lowers the manufacturing cost thereof. Even when the tank device rests on top of the toilet-body, the above-mentioned zero head for the flushing water makes it possible for the tank device to have a flat shape, so compared to a conventional toilet flushing tank device in which this tank device is arranged above the toilet-body, there is more bathroom space and the bathroom space is more pleasant.

Also, the spray nozzle can have an annular outlet for the operating water.

This allows the flow of jetted flushing water from the spray nozzle to consist of a large-diameter stream corresponding to the diameter of the annular outlet, and allows the jetted flushing water to flow into the throat in this stream state. Thus, the tank flushing water is sucked into the throat along with the jetting of the flushing water at a higher suction efficiency, and there is a greater flow of flushing water into the throat. Accordingly, the flushing water discharge flow of the jet pump is efficiently increased, and the toilet flushing effect of this flushing water is enhanced.

This annular outlet can also be an annular continuous opening, which is advantageous in manufacturing. Specifically, merely incorporating a cylindrical member into the opening of a nozzle having a simple jet opening results in a nozzle having an annular continuous opening, and this facilitates the manufacture of the spray nozzle and in turn the jet pump.

Also, the annular outlet can be formed by annularly disposing a plurality of operating water jetting holes. In other words, the annular outlet can be split up in its formation.

The streams of flushing water jetted from the plurality of operating water jetting holes arranged in a ring come together after being jetted and form a cylindrical stream. When the stream is thus cylindrical, the stream outside diameter is larger, as mentioned above, so the tank flushing water is sucked more efficiently into the throat along with the jetting of the flushing water.

In this case, the plurality of nozzle outlets can have any of a variety of annular shapes, but if the shape is circular, then a multipurpose machine such as a lathe or boring machine can be used to manufacture the outlets thanks to the characteristics of the circular shape, and this reduces the manufacturing cost. Disposing the jetting holes in a circular shape will be easier if they are laid out at an equal pitch. Naturally, these jetting holes may be simple circular holes.

Also, the spray nozzle can be a flushing water through-passage in which the flow path through the spray nozzle is surrounded by the annular outlet, and which allows the passage of flushing water through the through-passage to the throat.

This not only allows the tank flushing water on the outside of the cylindrical flushing water stream to be sucked from the annular outlet into the throat, but also allows the tank flushing water to be sucked into the throat through the above-mentioned flow path on the inside of the stream. Thus, the flow of flushing water into the throat is increased, the flushing water discharge flow of the jet pump is increased, and in turn the flushing performance is enhanced.

Also, the jet pump can be configured as a jet pump assembly in which a plurality of spray nozzles and a plurality of throats are integrally assembled.

If so, the flushing water jetting and the attendant flushing water suction brought about by the paired spray nozzles and throats will be brought about by each of the paired spray nozzles and throats, and the sum thereof will become the stream entrainer action and ejector action of the jet pump assembly. Accordingly, the flushing water discharge flow is greater than with a single jet pump. Furthermore, assembling a plurality of spray nozzles and a plurality of throats affords a more solid construction of the jet pump assembly.

The following structure is also possible.

The nozzle water supply unit that supplies the operating water can have:

- a main water supply pipe for supplying the operating water to the jet pump assembly; and
- a plurality of branch water supply pipes that branch off from the main water supply pipe for supplying water to the various spray nozzles of the jet pump assembly, and wherein the plurality of throats can merge on the terminal side and be connected to the supply line.

With this structure, directly supplying water from the individual branch water supply pipes to the various spray nozzles ensures proper water supply and also allows the flushing water streams from the various throats to be merged before being sent to the supply line. Thus, energy loss in the flushing water is minimized in the supply and discharge of the flushing water, and flushing water from the jet pump assembly can be sent to the supply line and in turn to the toilet.

The way the flushing water is jetted from the various spray nozzles can be varied if a flow adjustment mechanism such as a shutoff valve is provided to each of the branch water supply pipes. Thus, how the flushing water is discharged from the jet pump assembly, and in turn the flush pattern, can be variously controlled.

In jetting the flushing water from the various nozzles by supplying flushing water to the various spray nozzles as above, it is also possible to control the state in which the flushing water is jetted from the plurality of spray nozzles. For instance, it is preferable for the flushing water jetting pressure to be substantially uniform among the plurality of spray nozzles. To this end, the plurality of branch water supply pipes should have substantially the same pressure loss while the flushing water passes through, and the line length thereof should be substantially the same. Alternatively, the plurality of branch water supply pipes may be such that their ratio of line length and line diameter is substantially the same.

If so, the flushing water jetted from the various spray nozzles will flow into the corresponding throats without causing any channeling in the various flushing water streams. As a result, the ejector action will be induced substantially uniformly in all of the throats, with no maldistribution in the flushing water suction by the throats, and this affords an increase in the flushing water discharge flow of the jet pump assembly.

In discharging the flushing water jetted from the various spray nozzles as above through the throats, it is preferable for the flushing water discharge pressure to be substantially uniform among the plurality of throats. To this end, the plurality of throats should have substantially the same pressure loss while the flushing water passes through, and the line length thereof should be substantially the same. Alternatively, the plurality of throats may be such that their ratio of line length and line diameter is substantially the same.

This minimizes the occurrence of turbidity in the flushing water flow where the various throat terminals merge. Thus, separation of the flushing water flows from the inner walls of the line at the merge point and beyond is minimized, so pressure loss caused by this separation can also be minimized, and the discharge performance of the jet pump assembly can be enhanced.

The following is also possible in creating the above-mentioned jet pump assembly.

The nozzle water supply unit that supplies the operating water can have:

- a main water supply pipe for supplying the operating water to the jet pump assembly;
- a supply-side manifold that connects this main water supply pipe with the plurality of spray nozzles; and
- a discharge-side manifold that connects the plurality of throats to the supply line.

This allows the supply and discharge of flushing water upstream and downstream of the jet pump to be carried out via the manifolds on the respective sides. Accordingly, the management and handling of the line are simpler, the structure of the jet pump assembly is simplified, and the cost of manufacturing the jet pump assembly is reduced.

Also, the toilet flushing tank device can have a plurality of the jet pumps or the jet pump assemblies, and a supply line can be provided for each of this plurality of jet pumps or jet pump assemblies.

This makes it possible to vary the discharge pattern of the flushing water from the toilet flushing tank device, affording greater freedom in the design of the flush toilet.

In order to control the supply of the operating water for each of the jet pumps or the jet pump assemblies, or to control the supply of the flushing water for each of the supply lines, a flow adjustment mechanism such as a shutoff valve or a flow adjustment valve can be provided. This makes it possible to vary the way the flushing water is jetted from the various spray nozzles.

If, as above, a plurality of jet pumps or assemblies are installed, and supply lines are provided so as to guide the flushing water to different places in the toilet, such as to the rim water-discharge mechanism and a toilet bowl discharge mechanism that discharges flushing water to the bottom of the toilet bowl, then water can be discharged simultaneously from both the rim and the toilet bowl, which improves toilet flushing performance.

The above relates to a flush toilet in which the flushing water supply destination in a toilet, but the same applies to any flushing water supply device in which the water supply destination is a toilet or something else. For instance, this can also be applied as a flushing water supply device for a toilet flushing tank device that is configured separately from the toilet itself and is handled separately from the toilet. In this case, because of the freedom afforded in the installation of this toilet flushing tank device apart from the toilet, this tank device can be installed at a low location such as to the rear and side of the toilet, and as a result, there is more bathroom space above the toilet and the bathroom space is more pleasant, which helps improve the bathroom environment. Also, the flushing water discharge flow can be effectively increased in supplying the flushing water to the separate toilet.

In addition, in mountainous regions, on islands, at construction sites, and other places where a waterworks system has not been set up, the various configurations discussed above can also be applied to flushing water supply devices such as those which supply flushing water to shower faucets.

BRIEF DESCRIPTION OF THE DRAWINGS

FIG. 39 is a diagram of the relation between the inside diameter D2 of the inlets of various through holes 420*g*2 to 420*n*2 and the total flow Q of the flushing water used to flush the toilet.

BEST MODE FOR CARRYING OUT THE INVENTION

Figure 1:
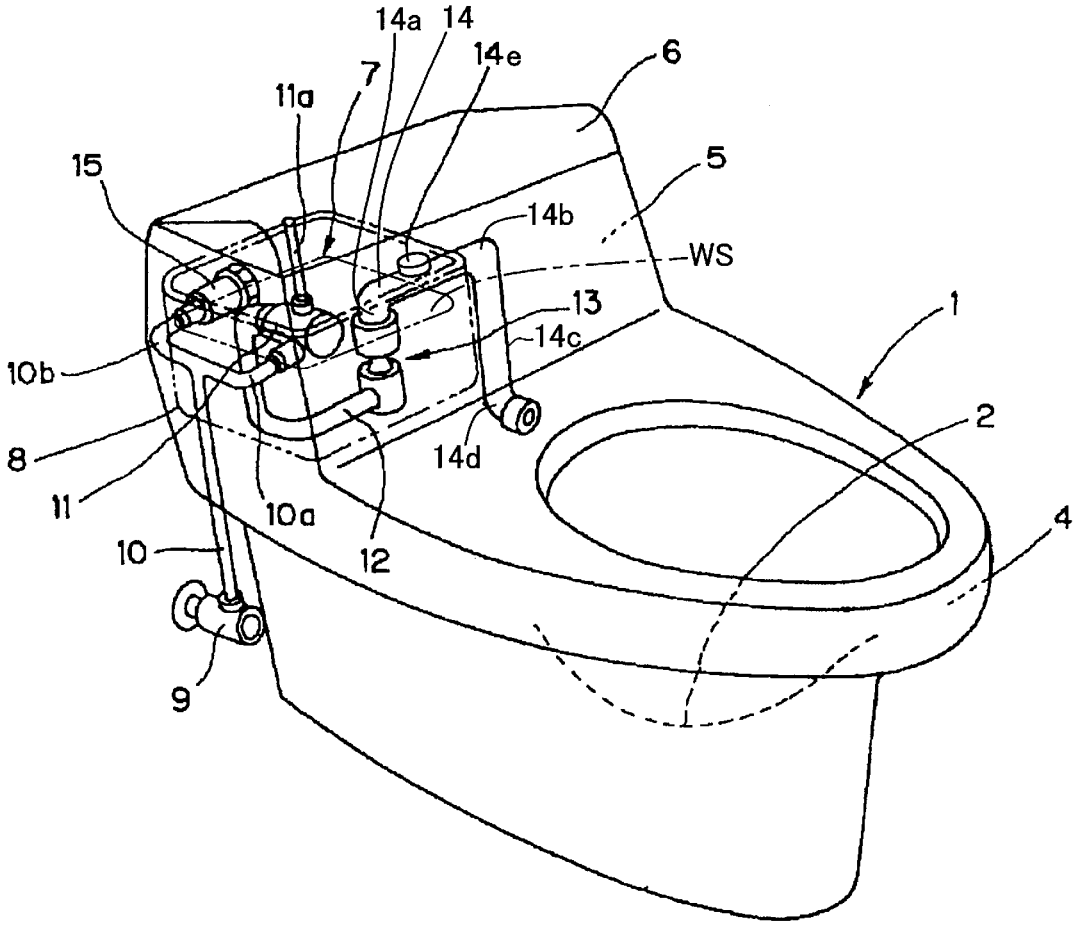
FIG. 1 is an oblique see-through view of part of the flush toilet pertaining to a first embodiment of the present invention.
Figure 2:
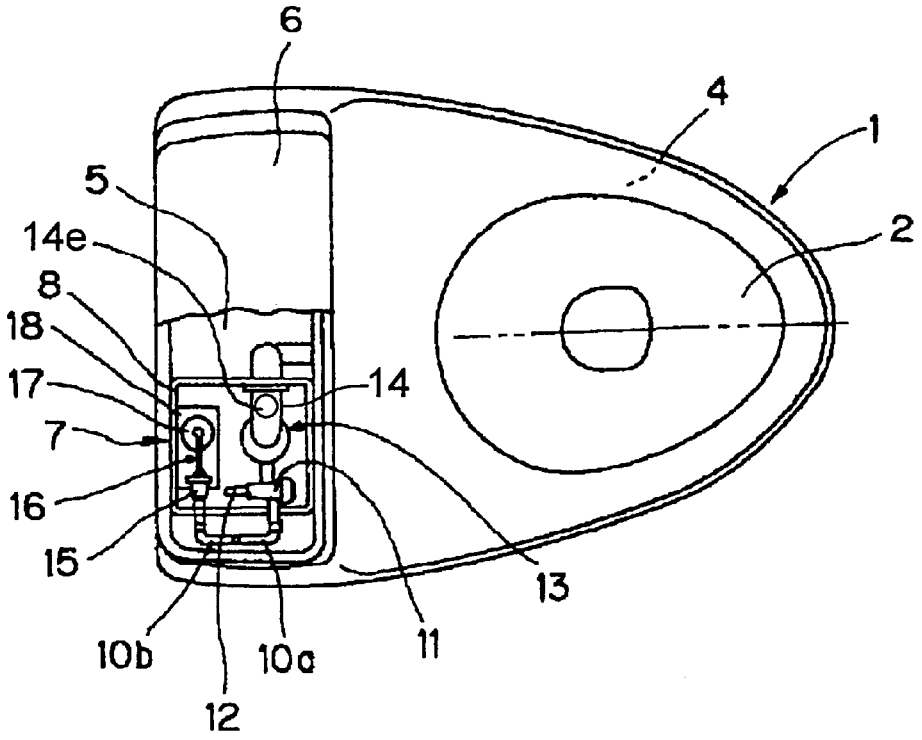
FIG. 2 is a top view of the flush toilet of the first embodiment, with part thereof cut away.
Figure 3:
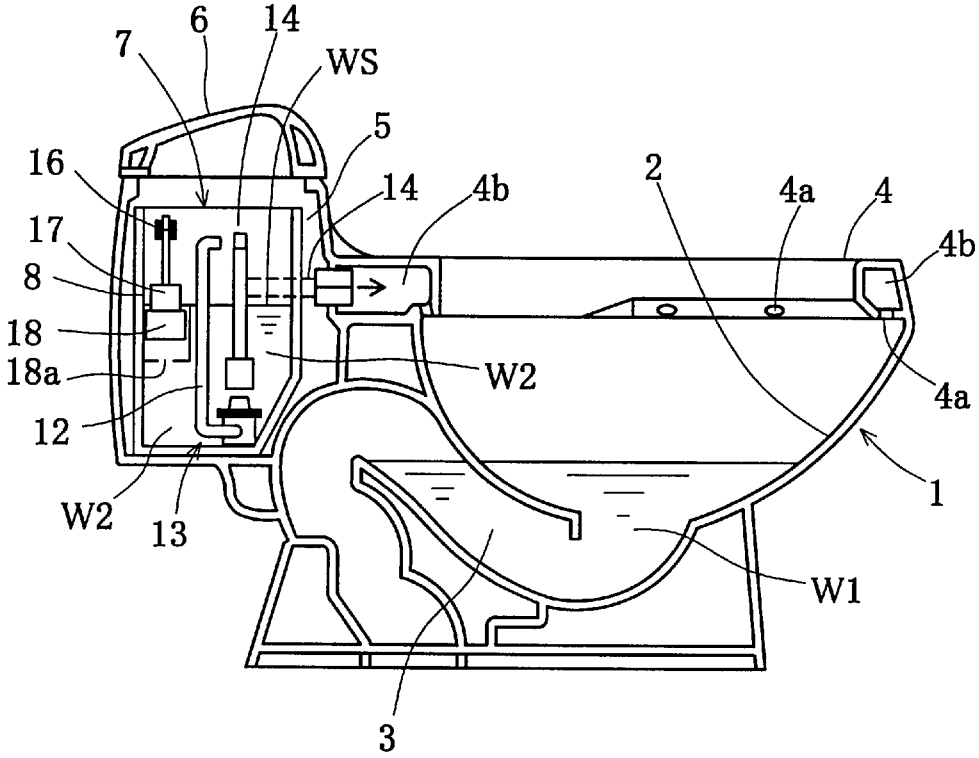
FIG. 3 is a simplified side cross section of the flush toilet of the first embodiment.

Next, embodiments of the present invention will be described through reference to embodiments of a flush toilet. FIG. 1 is an oblique see-through view of part of the flush toilet pertaining to a first embodiment of the present invention, FIG. 2 is a top view of the flush toilet of the first embodiment, with part thereof cut away, FIG. 3 is a simplified side cross section of the flush toilet of the first embodiment, and FIG. 4 is a detail top view in which the top of a toilet flushing tank device furnished to the flush toilet of the first embodiment has been enlarged.

The flush toilet 1 in the first embodiment is a porcelain siphon-type toilet. As shown in FIGS. 1 to 3, this toilet has a toilet bowl 2 and a bath-type siphon trap 3. The structure for discharging flushing water into the toilet bowl 2 when the toilet is flushed comprises a rim 4 having an annular rim water channel 4*b* on the inside part surrounding the top peripheral edge of the toilet bowl 2; a tank holding area 5 arranged to the rear the toilet bowl 2; and lid 6 for the tank holding area 5. This tank holding area 5 has a toilet flushing tank device 7 (discussed below). Numerous water discharge holes 4*a* are formed in the bottom of the rim water channel 4*b* and spaced out in the peripheral direction, and flushing water is discharged from these water discharge holes 4*a* onto the walls of the toilet bowl. The siphon trap 3 is connected to a drain pipe (not shown). When the inside of the trap is full, it exhibits a siphoning action, draining the waste in the toilet bowl 2 into the drain pipe along with the supplied flushing water and the water standing in the toilet bowl. The toilet bowl 2, siphon trap 3, rim 4, and tank holding area 5 are manufactured by integral molding in left and right molds and upper and lower molds in the manufacture of the toilet, followed by firing.

Figure 4:
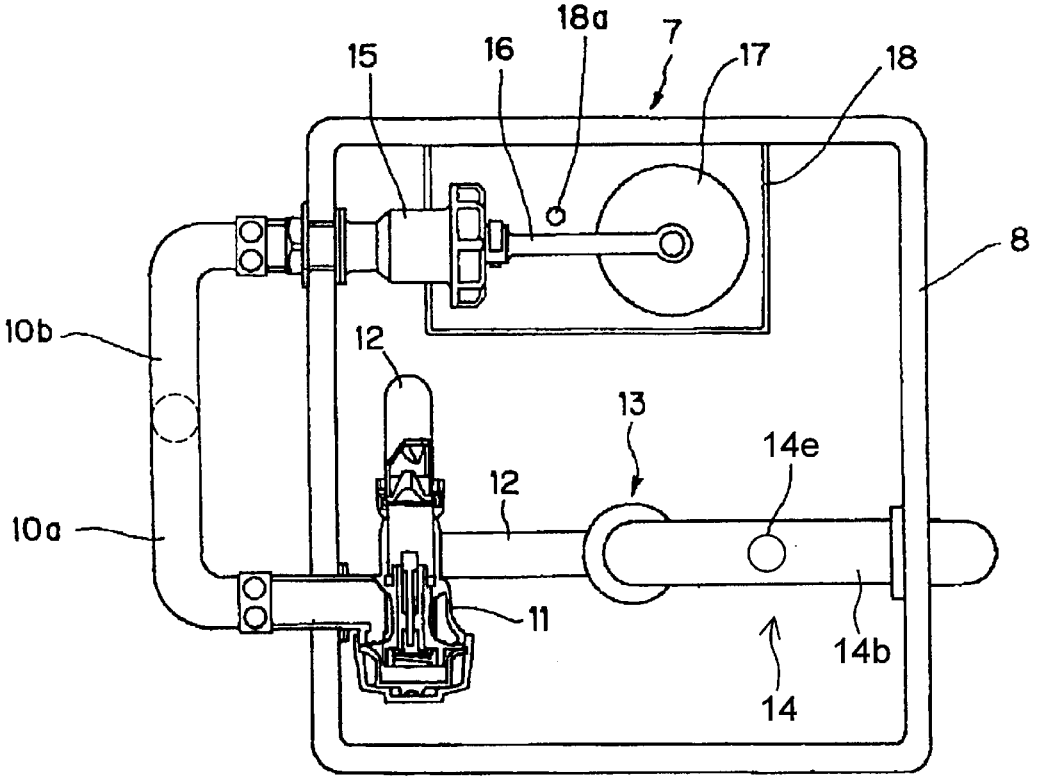
FIG. 4 is a detail top view in which the top of a toilet flushing tank device furnished to the flush toilet of the first embodiment has been enlarged.

As shown in detail in FIG. 4, the toilet flushing tank device 7 has a flushing water tank 8 that reserves flushing water. This toilet flushing tank device 7 also comprises a pipe 10 connected to a water pipe via a stop valve 9. This pipe branches into two branch pipes 10*a* and 10*b*, which go through the tank side wall and into the flushing water tank 8. The flushing water tank 8 is open at the top, which facilitates assembly and maintenance of a ball tap 15, jet pump 13, and so forth (discussed below) in the tank.

The branch pipe 10*a* has a flush valve 11 along the line inside the tank, and serves as the line through which the flushing water (operating water) passes to the jet pump 13, or more specifically, the spray nozzle 131 (discussed below). The flush valve 11 is equipped with a handle 11*a* that is operated when the toilet is flushed and that extends through the lid 6. The line is opened by operation of this handle, allowing the flushing water to flow downstream.

Downstream of the flush valve 11, a pipe 12 and a pipe 14 flank the jet pump 13 as the subsequent flushing water line. The pipe 12 goes down close to the bottom of the flushing water tank 8, follows a path that curves to the side along the tank bottom at the descending end, and is connected to the jet pump 13 at the line terminal end. The pipe 14 downstream from the jet pump 13 guides the flushing water jetted from the jet pump to the rim water channel 4*b*.

This pipe 14 follows the path shown in FIG. 1, and has a rising line section 14*a* that extends upward from the jet pump 13 to close to the tank top, a horizontal line section 14*b* that curves to the side and extends from the tank side wall to outside the flushing water tank 8, a descending line section 14*c* that descends in a curve along the tank outer wall, and a communicating line section 14*d* that communicates with the rim water channel 4*b* at the downstream end thereof. In this case, the horizontal line section 14*b* is positioned higher than the full level WS when the flushing water tank 8 has been filled with flushing water W2 for the next toilet flush, and has a vacuum breaker 14*e* along the line. Therefore, even if the flushing water should back up from the flush toilet 1 side for one reason or another, the backflow of the flushing water into the flushing water tank 8 is easily and effectively prevented by the atmospheric release of the line by the vacuum breaker 14*e*. The communicating line section 14*d* at the line terminal of the pipe 14 is connected to the rim water channel 4*b* at a location higher than the full level WS.

The branch pipe 10*b* is connected to the ball tap 15 inside the tank, and replenishes the flushing water in the flushing water tank 8 according to the opening and closing of the ball tap 15. The ball tap 15 is connected to one end of a float support rod 16, and the other end of the support rod is connected to a float 17. The float 17 is disposed inside a small tank 18 attached at the top of the flushing water tank 8. The upper end of the small tank 18 is open. A small-diameter through hole 18*a* is made in the floor of the small tank 18. Thus, the float 17 rises and falls with the amount (level) of flushing water in the small tank 18, and the ball tap 15 opens and closes with the rising and falling of the float, so the flushing water tank 8 is maintained at the specified full level WS by this opening and closing.

Figure 5A:
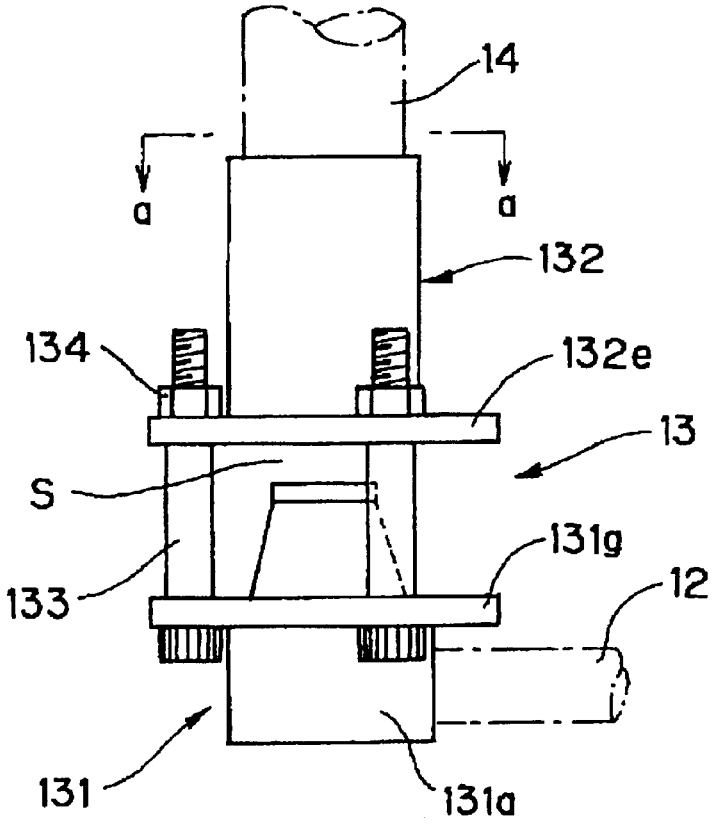
FIG. 5 is a diagram of the outside of the jet pump 13 furnished to he flush toilet 1 of the first embodiment.
Figure 5B:
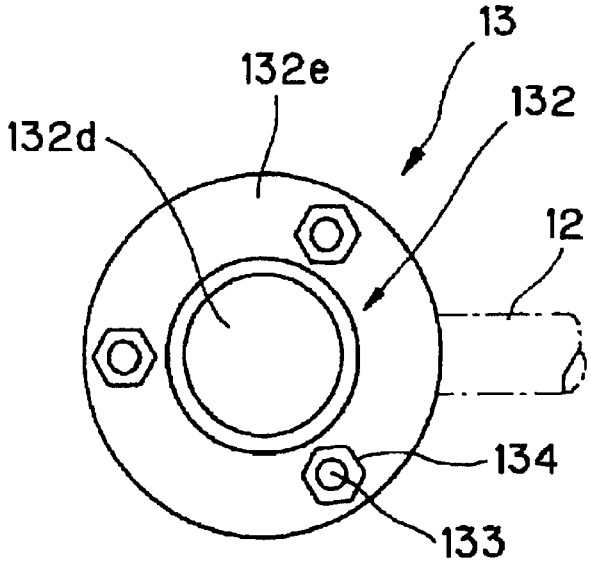

The jet pump 13 will now be described. FIG. 5 is a diagram of the outside of the jet pump 13 furnished to the flush toilet 1 of the first embodiment, where FIG. 5 (*a*) is a side view thereof, and FIG. 5 (*b*) is a view along the a—a line in FIG. 5 (*a*).

As shown in these figures, the jet pump 13 has a spray nozzle 131 and a throat 132 disposed directly across from this nozzle. The spray nozzle 131 comprises an outer cylinder 131*a* that provides the appearance of the nozzle tip, and a hollow inner cylinder 131*b* disposed coaxially with the outer cylinder 131*a*. The outer cylinder 131*a* tapers down to a smaller diameter on the nozzle tip side, and a flange 131*g* is integrally provided on the large diameter side. The inner cylinder 131*b* is supported in position with respect to the outer cylinder 131*a* by a cup-shaped bottom wall 131*e* that extends downward from the flange 131*g*. Because the spray nozzle 131 has this structure, the region bounded by the outer cylinder 131*a*, the inner cylinder 131*b*, and the bottom wall 131*e* is a cylindrical flow path 131*c* that surrounds the inner cylinder 131*b*. Also, the spray nozzle 131 is such that the gap between the small diameter end of the outer cylinder 131*a* and one end of the inner cylinder 131*b* serves as a jet port 131*d* in the form of a continuous circular ring, and this jet port opens at a width that is narrower than the downstream flow path 131*c*. Furthermore, the hollow portion of the inner cylinder 131*b* serves as a through flow path 131*h* that goes through the spray nozzle 131, with this through flow path surrounded by the above-mentioned circular jet port 131*d*. The spray nozzle 131 is fixed to the pipe 12 by connecting the end of the pipe 12 (discussed above) to an opening 131*f* in the cup-shaped bottom wall 131*e*, and the jet port 131*d* is oriented so that it faces upward.

The throat 132 across from this spray nozzle 131 has an inlet 132*a* on the spray nozzle 131 side located substantially directly across from the jet port 131*d* of the nozzle with a gap S in between. Thus, the throat 132 is oriented along the flow stream of the jetted flushing water from the spray nozzle 131, and the center of this stream (the center of the jet port 131*d*) substantially coincides with the center of the throat line. This throat 132 has on the inlet 132*a* side a line section 132*b* of constricted line diameter, downstream from which is a venturi tube comprising a straight expanded line section 132*c*, and is connected to the jet pump 13 at the outlet 132*d* of the line terminal. The end on the inlet 132*a* side comprises a fixing flange 132*e*.

As shown in FIG. 5, the spray nozzle 131 and the throat 132 are integrated by three bolts 133 extending through the flanges 131*g* and 132*e* of these components, and by three nuts 134 that thread onto the three bolts 133. The jet pump 13 is strengthened when the spray nozzle 131 and the throat 132 are integrally assembled. In this case, the throat 132 is fixed and supported such that it is across from the spray nozzle 131 as mentioned above.

The jet pump 13 with the above structure is disposed submerged near the bottom of the flushing water tank 8. The gap S between the jet port 131*d* of the spray nozzle 131 and the inlet 132*a* of the throat 132 opens into the flushing water tank 8 along the entire outer periphery thereof, and allows the tank flushing water around the pump to flow from this gap S into the inlet 132*a*. The tank flushing water around the pump is also able to flow through the through flow path 131*h* into the inlet 132*a*.

The operation of the flush toilet 1 pertaining to this embodiment will now be described.

As shown in FIG. 3, before the toilet is flushed (used), it is readied for the next use by filling the toilet bowl 2 and the flushing water tank 8 with the required amount of flushing water. Specifically, standing water WI fills the toilet bowl 2 up to a water level determined by the curved lip at the top of the line of the siphon trap 3. Flushing water W2 fills the flushing water tank 8 up to a water level (full level WS) maintained by the previously discussed float 17 and ball tap 15. The float 17 floats on the surface of the flushing water W2 in the small tank 18 inside the flushing water tank 8.

When the handle 11*a* of the flush valve is operated, the flush valve 11 opens. This opens up a passage for city water to flow from a water pipe (not shown) to the toilet flushing tank device 7. This city water passes through at a water pipe pressure of about 0.098 to 0.2 MPa (1 to 2 kgf/cm$^2$), and is supplied to the spray nozzle 131 of the jet pump 13 through the branch pipe 10*a*, the flush valve 11, and the pipe 12. In other words, city water from the water pipe is supplied as the operating water of the jet pump 13.

Figure 6:
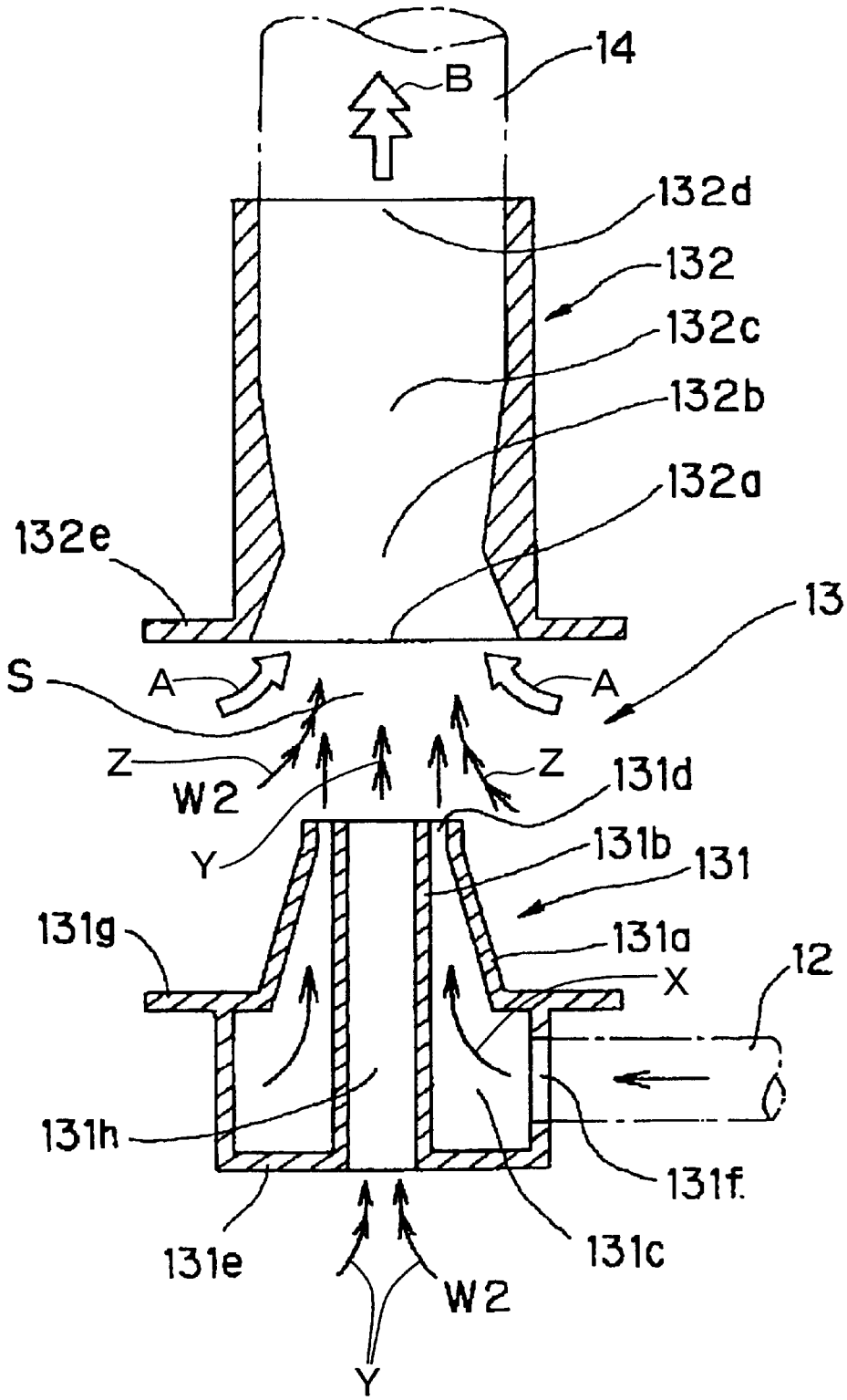
FIG. 6 is a side cross section of this jet pump 13.

As shown by the arrows X in FIG. 6, the city water supplied to the spray nozzle 131 goes through the cylindrical flow path 131*c* of the spray nozzle 131 and is jetted from the jet port 131*d* in the form of a cylindrical stream. This jet port 131*d* is narrower than the flow path 131*c* downstream, so the cylindrical stream is accelerated to a high-speed stream.

When the flushing water is jetted from the jet port 131*d* in this manner, because this jet is in the form of a cylindrical high-speed stream, the flushing water is drawn to the inside of the cylindrical stream, as shown by the arrows Y in FIG. 6. Because there is a through flow path 131*h* of flushing water that goes through the spray nozzle 131 on the inside of this stream, the flushing water W2 around the jet pump is drawn from the lower end opening of the through flow path 131*h* into the flow path. As a result, the flushing water jetted in the form of a cylindrical high-speed stream from the jet port 131*d* and the flushing water W2 entrained by this jetted flushing water are jetted from the spray nozzle 131 toward the throat 132. This jetted flushing water and entrained flushing water flow into the throat 132 without slowing down because the spray nozzle 131 is disposed directly across from the throat 132.

As shown by the arrows Z in FIG. 6, the flushing water is drawn to the outside of the above-mentioned cylindrical stream by the flow of the cylindrical stream of flushing water from the jet port 131*d* into the inlet 132*a*. This drawing occurs from all directions at the inlet because the illustrated gap S is open in all directions around the inlet 132*a*. Here, the above-mentioned entrained flushing water also flows into the inlet 132*a* in addition to the stream flushing water. Thus, the flow of flushing water into the throat 132 is increased in quantity and is not slowed down as mentioned above, so the drawing of the flushing water to the outside of the cylindrical stream is increased and as a result there is more entrained flushing water. The cylindrical high-speed stream of flushing water (city water) and the flushing water W2 entrained as above on the inside and outside thereof are unified, pass through the interior passage of the throat 132, and pick up speed during passage through the constricted line section 132*b*. As a result, a negative pressure is generated in the constricted line section 132*b* of the throat 132, and the flushing water W2 in the vicinity of the throat 132 is sucked by ejector action into the inlet 132*a* of the throat 132 as shown by the outlined arrows A in FIG. 6. The mixed flow of the flushing water W2 and the high-speed stream of flushing water (city water) that has passed through the constricted line section 132*b* goes through the expanded line section 132*c*, where pressure is restored, after which it is discharged from the throat 132 and in turn discharged from the jet pump 13, as shown by the outlined arrow B in FIG. 6.

The mixed flow of city water and flushing water W2 discharged from the jet pump 13 flows into the pipe 14, and flows through the pipe 14 into the rim water channel 4*b* of the flush toilet 1. This mixed flow is then discharged through the water discharge holes 4*a* of the rim water channel 4*b* into the toilet bowl 2. The mixed flow discharged into the toilet bowl 2 pushes the standing water W1 to the siphon trap 3 side and fills the siphon trap 3. Once the siphon trap 3 is full, a siphoning action is generated, so the mixed flow of the flushing water W2 and city water discharged into the toilet bowl 2, the standing water W1, and the waste in the standing water W1 are drained out of the flush toilet 1 all at once through the siphon trap 3.

When the toilet bowl 2 is emptied and the siphoning action comes to a halt, the level of the flushing water W2 in the flushing water tank 8 drops below the level of the inlet 132*a* of the throat 132 of the jet pump 13, and the flow increasing action of the jet pump 13 produced by the drawing-in of air comes to a stop. After this, the city water discharged from the spray nozzle 131 goes through the throat 132 and is discharged from the jet pump 13 and supplied to the flush toilet 1. As a result, city water flows into the empty bowl 2 and the standing water W1 fills the toilet bowl up to the above-mentioned water level.

The flush valve 11 automatically closes after a specific amount of city water has flowed in. The supply of city water to the jet pump 13 stops, and the operation of the jet pump 13 also stops. The timing at which the flush valve 11 stops the flow, that is, the timing at which the supply of city water is stopped, is adjusted so that the standing water WI in the toilet bowl 2 will reach the above-mentioned water level. The total quantity of flushing water used for a toilet flush, the quantity of standing water, the increase in flow produced by the jet pump 13, and other such factors are taken into account in this timing adjustment, and the flush valve 11 is designed and manufactured so that it will stop the flow at a timing based on these factors.

The flushing water W2 is drained from the flushing water tank 8 by the operation of the jet pump 13, causing the level of the flushing water W2 in the flushing water tank 8 to drop. As the level of the flushing water W2 in the flushing water tank 8 drops, the level of the flushing water W2 in the small tank 18 also drops. In this case, the flushing water W2 in the small tank 18 gradually flows into the flushing water tank 8 through the small diameter through hole 18*a* formed in the bottom wall, so the rate at which the level of the flushing water W2 drops in the small tank 18 is lower than the rate at which the level of the flushing water W2 drops in the flushing water tank 8. Therefore, the float 17 descends slowly, so the opening of the ball tap 15 lags behind the supply of flushing water to the jet pump 13. The descent rate of the float 17 is dependent on the rate at which the flushing water passes through the through hole 18*a*, that is, the through hole diameter, so the timing at which the ball tap 15 opens is adjustable by adjusting the through hole diameter. The following was done in this embodiment. The diameter of the through hole 18*a* was adjusted so that the float 17 would descend to the specified level at the point when the operation of the jet pump 13 had stopped and the flushing of the flush toilet 1 had been completed through the closing of the flush valve 11. Thus, the opening of the ball tap 15 and the supply and replenishment of the flushing water to the flushing water tank 8 begin at substantially the same time as the completion of the toilet flushing, after which the flushing water W2 is held at the full level WS in the flushing water tank 8.

The flush toilet 1 pertaining to this embodiment having the above structure has the following advantages.

In the jet pump 13, the jet port 131*d* of the spray nozzle 131 and the inlet 132*a* of the throat 132 were directly across from one another with the gap S in between. Thus, first of all, the high-speed stream of flushing water (city water) jetted from the spray nozzle 131 can be made to flow into the throat 132 without slowing down. Second, this high-speed stream of flushing water is not diverted as it flows out of the throat 132. Accordingly, the ejector action attendant to the flow of the flushing water stream into the throat 132 can be produced very efficiently. Therefore, the tank flushing water around the jet pump, which is submerged near the bottom of the flushing water tank 8, is sucked into the throat 132 highly efficiently along with the jetting of the flushing water from the spray nozzle 131, and this flushing water is supplied to the pipe 14 downstream from the throat 132 and in turn to the flush toilet 1. Furthermore, since this throat 132 is directly connected to the pipe 14 all of the tank flushing water the flows into the throat and the flushing water jetted from the spray nozzle 131 can flow into the pipe 14. As a result, the flushing water used to flush the toilet can be supplied in an effectively increased flow of discharged flushing water to the flush toilet 1, which is the destination of the flushing water.

This will now be described using specific numbers.

With a similar jet pump in Japanese Laying-Open Gazette H10-102568, featuring a spray nozzle in which the drain water valve seat opening and the discharge opening face each other diagonal to the above-mentioned opening, when city water was supplied to the spray nozzle at a flow of 25 L/min and a pressure of about 0.098 MPa (1 kgf/cm$^2$), flushing water could be supplied to the toilet at a flow of about 50 L/min, the effect being an approximately two-fold increase in flow. In contrast, in the present embodiment, when city water is supplied to the jet pump 13 at the above-mentioned pressure and flow, a mixed flow of the supplied city water (flushing water stream) and entrained flushing water (the flushing water W2 in the tank) can be discharged at a flow of about 100 L/min, the effect being a four-fold increase in flow. This flow of about 100 L/min is about the same as the flow of flushing water discharged from a conventional toilet flushing tank device that utilized the flushing water head. Therefore, it can be seen that zero head can be achieved by using the jet pump 13.

As shown in FIG. 3, flushing water can be held in the flush toilet pertaining to the present embodiment in a state in which the flushing water W2 is held in the flushing water tank 8 with the full level WS at the downstream end of the pipe 14 and in turn at substantially the same level or lower than the rim water channel 4*b*. Accordingly, with the present embodiment there is greater freedom in the layout of the toilet flushing tank device 7 with respect to the flush toilet 1. Also, it is easy to achieve zero head, which was difficult with the flush toilet in Japanese Laying-Open Gazette H10-102568, and the toilet flushing tank device 7 does not have to be placed on the rim of the flush toilet 1. Because the toilet flushing tank device 7 is not placed on the rim of the flush toilet 1, there is more available space in the bathroom, making the bathroom more pleasant and improving the bathroom environment. Also, since there is no need for the toilet flushing tank device 7 to be a pressure vessel, bathroom space can be expanded at low cost. Therefore, the present embodiment provides a flush toilet equipped with a toilet flushing tank device and a toilet to which flushing water is supplied from the toilet flushing tank device, wherein this flush toilet allows bathroom space to be increased more effectively and less expensively than with prior art.

With the flush toilet pertaining to the present embodiment, along with the above-mentioned increase in layout freedom, the toilet flushing tank device 7 was built into the rear part of the toilet bowl 2 of the flush toilet 1. Thus, as shown in FIG. 1 or 3, the top part of the toilet flushing tank device 7 that is out in the open (the part of the tank holding area 5 that sticks up from the top of the toilet, or the lid 6 thereof) can be lower. This provides more space in the bathroom, contributing to a more pleasant bathroom and an improved bathroom environment. Because zero head is possible along with an increase in layout freedom, it is possible for the toilet flushing tank device 7 to be installed next to the toilet itself in the dead space to the side or rear of the flush toilet 1, for instance. Here again the advantages include a more spacious bathroom.

With the flush toilet pertaining to this embodiment, the jet port 131*d* of the spray nozzle 131 of the jet pump 13 was formed in the shape of a continuous circular ring. This widens the outside diameter of the high-speed stream of city water discharged from the spray nozzle 131, and increases the contact surface area between this high-speed stream and the flushing water W2. As a result, the flow of flushing water W2 that is entrained by the high-speed stream of city water and flows into the throat 132 is increased, and the jet pump 13 more efficiently increases the flushing water discharge flow.

By increasing the contact surface area between the high-speed stream and the flushing water W2, the gap S between the jet port 131*d* of the spray nozzle 131 and the inlet 132*a* of the throat 132 can entrain at least a sufficient flow of the flushing water W2. This makes it possible to lower the height of the flushing tank device 7 even more.

With the flush toilet pertaining to this embodiment, flushing water W2 is entrained into the cylindrical high-speed stream of city water discharged from the spray nozzle 131, via the through flow path 131*h* of the spray nozzle 131. This also increases the flow of flushing water W2 that is entrained by the high-speed stream of city water and flows into the throat 132, and the jet pump 13 more efficiently increases the flushing water discharge flow.

With the flush toilet pertaining to this embodiment, the outer periphery of the gap S between the jet port 131*d* of the spray nozzle 131 of the jet pump 13 and the inlet 132*a* of the throat 132 is open to the internal space of the flushing water tank 8, allowing the flushing water W2 to flow freely to the throat 132 from all directions. Thus, the flow of flushing water W2 that is entrained by the high-speed stream of city water and flows to the throat 132, and the flow of flushing water W2 sucked into the throat 132 by the ejector action are increased, so the jet pump 13 increases the flushing water discharge flow even more efficiently.

The toilet flushing tank device 7 is built into the flush toilet 1 and installed at a low height, so the location where the jet pump 13 is installed is lower than the rim water channel 4*b*, as can be seen in FIG. 3. Therefore, as shown in FIG. 3, the pipe 14 extending from the jet pump 13 is connected to the rim water channel 4*b* after first rising above the jet pump 13. Coupled with the fact that the toilet flushing tank device 7 and the rim 4 are disposed close to each other, the flushing water from the jet pump 13 can be supplied to the rim water channel 4*b* by the pipe 14, which has a short line length. This affords a reduction in pressure loss caused by friction with the walls inside the pipe 14, and also allows for a reduction in energy loss in the mixed flow of the flushing water W2 and city water supplied to the flush toilet 1. Thus, the toilet flushing performance of flushing water that makes up this mixed flow can be enhanced.

As mentioned above, in this embodiment the pipe 14 from the jet pump 13 to the rim water channel 4*b* has a horizontal line section 14*b* that goes through a location higher than the full level WS of the flushing water tank 8, and even the communicating line section 14*d* at the end thereof is located higher than the full level WS. This has the following advantages.

When the flushing water tank 8 is full and ready for the next toilet flush, the communicating line section 14*d* at the line terminal is opened, so air enters the horizontal line section 14*b* from this part of the line. Thus, air cuts off the state of being full of water of the pipe 14 in its horizontal line section 14*b*, and no siphoning occurs. Accordingly, the tank flushing water in the flushing water tank 8 can be kept from inadvertently being released through the pipe 14 to the rim water channel 4*b* and in turn to the toilet bowl 2, so no water is wasted in between flushes. Furthermore, since the air present in the line cuts off the flushing water supply, there is no need for a valve mechanism for opening and closing the line of the pipe 14 in the jetting of the flushing water from the jet pump. As a result, the flow of jetted flushing water will not be slowed in any way by collision with the chain for opening and closing the valve or the like, as was discussed regarding prior art.

Also, the toilet flushing tank device 7 can be installed on the floor to the side of the flush toilet 1, for example, in which case the pipe 14 must be raised above the jet pump 13. In such a case, if the jet port 131*d* of the spray nozzle 131 of the jet pump 13 is pointed up, the length of the pipe 14 can be reduced compared to when the jet port 131*d* of the spray nozzle 131 is pointed down and the line from the jet pump on is an ascending pipe. Thus, the above-mentioned pressure loss due to friction with the pipe walls is reduced and the toilet flushing effectiveness of the flushing water is enhanced.

Figure 7:
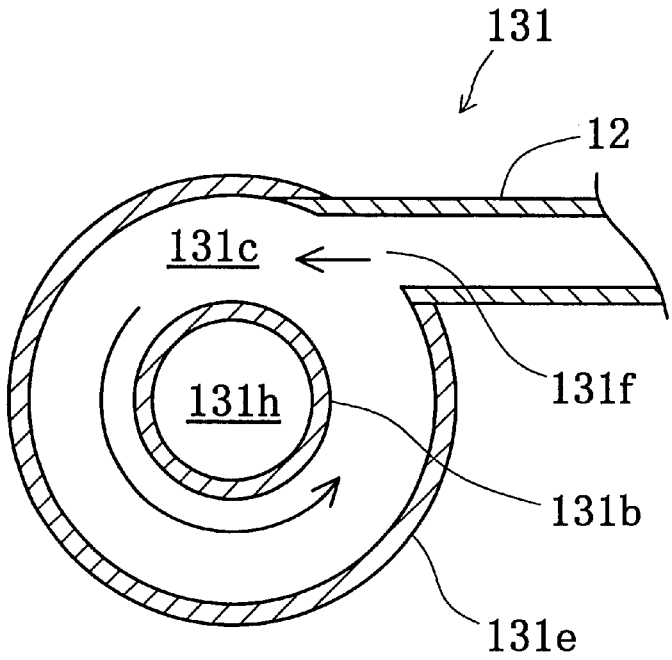
FIG. 7 is a diagram illustrating a variation embodiment of the jet pump 13.

A variation embodiment of the jet pump 13 will now be described. FIG. 7 is a diagram illustrating a variation embodiment of the jet pump 13.

As shown in the figure, the pipe 12 from the flush valve 11 is connected such that it is offset with respect to the spray nozzle 131. This allows the flushing water (city water) from the pipe 12 to flow into the cylindrical flow path 131*c* of the spray nozzle 131 without directly colliding with the outer walls of the inner cylinder 131*b*. Thus, this flushing water flows in while rotating as shown by the arrows in the figure in the cylindrical flow path 131*c*, with the flow speed thereof maintained, and is jetted as an annular stream from the jet port 131*d* (see FIG. 6) at the top end of the cylindrical flow path 131*c*. Accordingly, the stream speed can be raised, so the flushing water around the pump is drawn in more efficiently and the flow increasing effect is enhanced.

Figure 8:
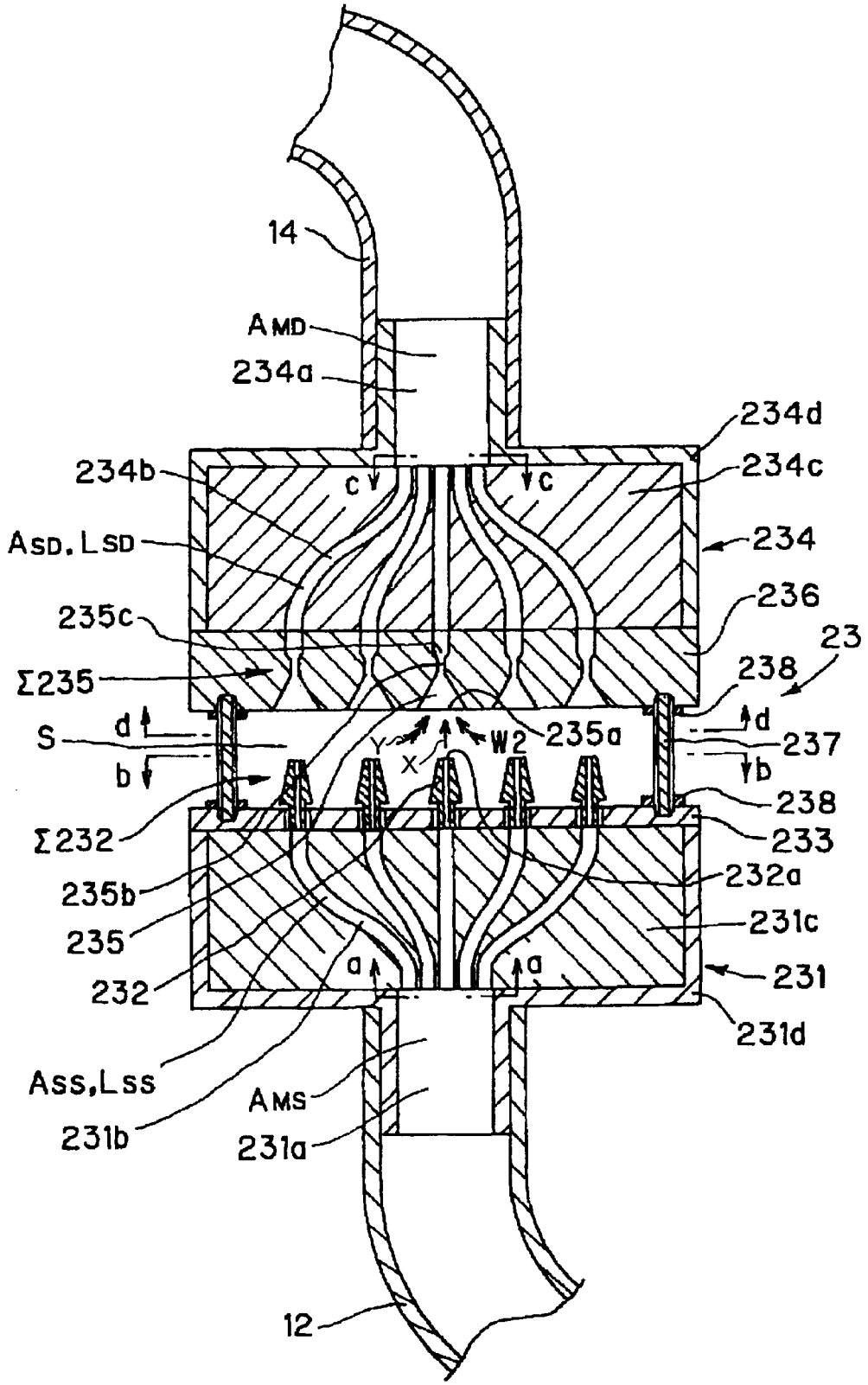
FIG. 8 is a side cross section of the jet pump assembly furnished to the flush toilet pertaining to this second embodiment.
Figure 9:
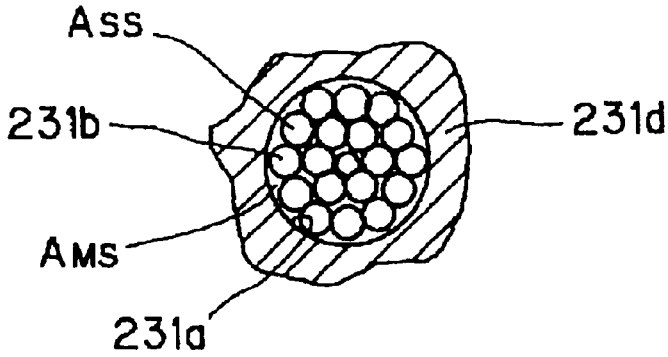
FIG. 9 is a view along the a—a line in FIG. 8.
Figure 10:
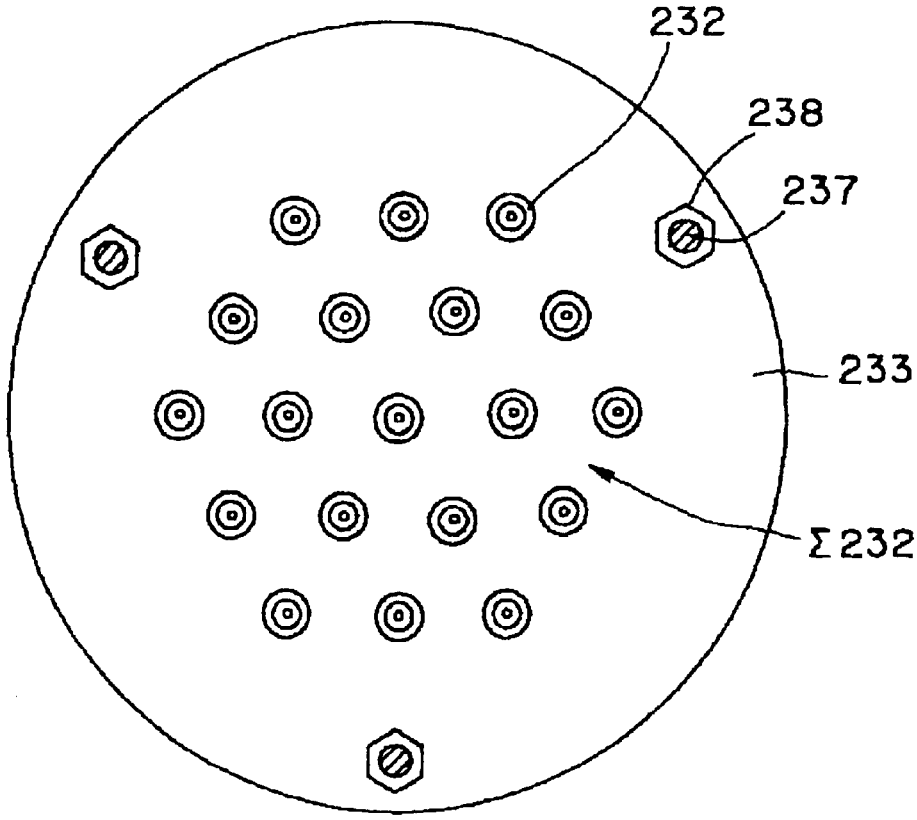
FIG. 10 is a view along the b—b line in FIG. 8.
Figure 11:
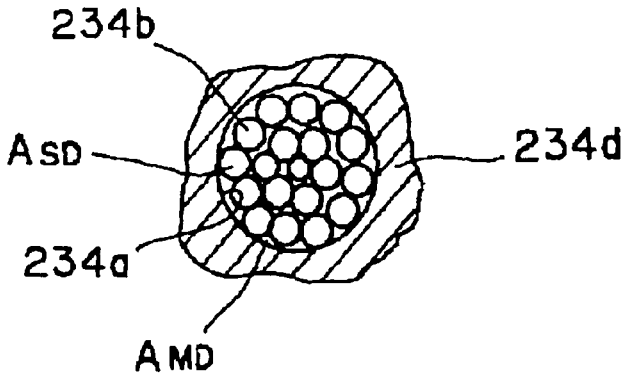
FIG. 11 is a view along the c—c line in FIG. 8.
Figure 12:
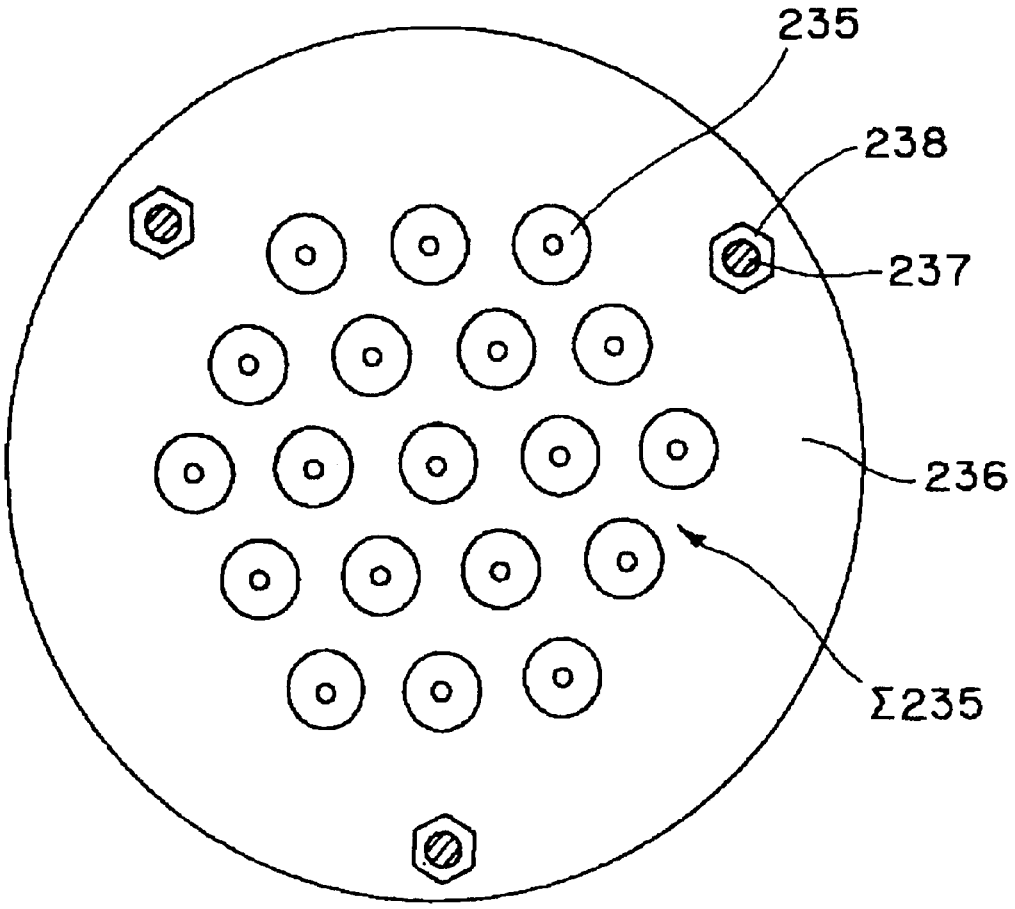
FIG. 12 is a view along the d—d line in FIG. 8.

Next, a second embodiment of the present invention will be described. FIG. 8 is a side cross section of the jet pump assembly furnished to the flush toilet pertaining to this second embodiment, FIG. 9 is a view along the a—a line in FIG. 8, FIG. 10 is a view along the b—b line in FIG. 8, FIG. 11 is a view along the c—c line in FIG. 8, and FIG. 12 is a view along the d—d line in FIG. 8.

In this second embodiment, a jet pump assembly 23 is installed in place of the jet pump 13 used in the first embodiment.

As shown in FIG. 8, the jet pump assembly 23 comprises a water supply pipe casing 231 above and a discharge pipe casing 234 below. These casings are integrated by support columns 237 and fasteners 238 in a state in which they are facing each other.

The water supply pipe casing 231 comprises a cylindrical body 231*d* and a top plate 233 that are fixed by screws (not shown), and has a main water supply pipe 231*a* connected to the pipe 12 in the center at the lower end of the cylindrical body. A branch pipe block 231*c* made of molded plastic is fitted and fixed on the inside of the casing. This branch pipe block 231*c* has in its interior a plurality of branch pipes 231*b*, and each branch pipe 231*b* is formed so that it branches off from the downstream end of the main water supply pipe 231*a* and goes all the way to the top plate 233. These branch pipes consist of flexible tubing or plastic or metal pipe, and the branch pipe block 231*c* can also be produced by molding this flexible tubing or pipe from plastic.

As shown in FIG. 9, these plurality of branch pipes 231*b* are densely bundled at their upstream end, that is, at the main water supply pipe 231*a* end. The cross sectional area AMS of the main water supply pipe 231*a* is substantially equal to the sum ΣASS of the cross sectional areas ASS of the branch pipes 231*b*. The ratio LSS/ASS of the length LSS of the branch pipe 231*b* to the cross sectional area ASS of the branch pipe 231*b* is constant in all of the branch pipes 231*b*. The plurality of branch pipes 231*b* are formed such that they are dispersed at their downstream end, that is, at the top plate 233 end.

The water supply pipe casing 231 has a plurality of spray nozzles 232 in the top plate 233 according to the dispersed layout of the branch pipes 231*b* at the top plate 233 end. The spray nozzles 232 have circular jet ports 232*a* and are threaded into screw holes (not shown) in the top plate 233 at substantially the same height. The plurality of spray nozzles 232 are connected to the corresponding branch pipes 231*b* with the jet ports 232*a* pointed up. These plurality of spray nozzles 232 are disposed so as to form a spray nozzle group Σ232 that is substantially circular when viewed in elevation, as shown in FIG. 10.

As shown in FIG. 8, the discharge pipe casing 234 opposite the above-mentioned water supply pipe casing 231 comprises a cylindrical body 234*d* fixed to a bottom end plate 236, in substantially the same manner as with the water supply pipe casing 231. A main discharge pipe 234*a* connected to the pipe 14 is provided in the center of the top end of the cylindrical body, and a branch pipe block 234*c* made of molded plastic is provided inside the casing. This branch pipe block 234*c* has in its interior a plurality of branch pipes 234*b*, and the branch pipes 234*b* are formed so that they merge at the terminals and go from the bottom end plate 236 all the way to the main discharge pipe 234*a*. These branch pipes can also be formed by molding flexible tubing or pipe from plastic.

As shown in FIG. 11, the branch pipes 234*b* of the discharge pipe casing 234 are densely bundled at their downstream end, that is, at the main discharge pipe 234*a* end. The cross sectional area AMD of the main discharge pipe 234*a* is substantially equal to the sum ΣASD of the cross sectional areas ASD of the branch pipes 234*b*. The ratio LSD/ASD of the length LSD of the branch pipe 234*b* to the cross sectional area ASD of the branch pipe 234*b* is constant in all of the branch pipes 234*b*. The plurality of branch pipes 234*b* are formed such that they are dispersed at their upstream end, that is, at the bottom end plate 236 end.

The branch pipes 234*b* of the discharge pipe casing 234 are each connected to a venturi pipe 235 formed in the bottom end plate 236. The venturi pipes 235 have circular inlets 235*a*, constricted line sections 235*b*, and expanded line sections 235*c*, and are formed in a tapered shape from the inlets 235*a* to the constricted line sections 235*b*. The plurality of venturi pipes 235 are formed by drilling out the bottom end plate 236 or by molding the bottom end plate 236 as a plastic molding. As a result, the venturi pipes 235 assume the same positions on the bottom end plate 236. These plurality of venturi pipes 235 are disposed so as to form a venturi pipe group Σ235 that is substantially circular when viewed in elevation, as shown in FIG. 12. The venturi pipes 235 in the bottom end plate 236 are laid out in a mirror image of the spray nozzles 232 in the top plate 233.

Because the jet pump assembly 23 has the above structure, as shown in FIG. 8, the plurality of inlets 235*a* of the venturi pipes 235 are disposed directly across from the plurality of jet ports 232*a* of the spray nozzles 232, with a gap S in between. Thus, a single jet pump is formed by a pair of a opposing spray nozzle 232 and a venturi pipe 235, resulting in a jet pump assembly 23 having a plurality of jet pumps. With this jet pump assembly 23, as shown in the various figures mentioned above, the outer periphery of the gap S between the spray nozzle group Σ232 and the venturi pipe group Σ235 opens in all directions into the internal space of the flushing water tank 8.

Except for the above, the flush toilet pertaining to the second embodiment has the same structure as the flush toilet pertaining to the first embodiment.

With the flush toilet pertaining to this second embodiment, when the handle 11*a* of the flush valve is operated, the flush valve 11 opens and flushing water begins to pass from the water pipe. As a result, city water is supplied to the jet pump assembly 23 through the pipe 10, the branch pipe 10*a*, the flush valve 11, and the pipe 12 at a water pipe pressure of about 0.098 to 0.2 MPa (1 to 2 kgf/cm$^2$). This city water flows into the main water supply pipe 231*a* of the water supply pipe casing 231, goes through the branch pipes 231*b* that branch off from the main water supply pipe 231*a*, and is jetted as a high-speed stream from the plurality of jet ports 232*a* of the spray nozzles 232, as shown by the arrow X in FIG. 8.

When the flushing water is thus jetted from the jet ports 232*a*, the high-speed streams of city water flow from the spray nozzles 232 into the opposing venturi pipes 235 while entraining the flushing water W2 near the spray nozzles 232, as shown by the arrows Y in FIG. 8. These streams also flow without being slowed down because the spray nozzles 232 are disposed directly opposite the venturi pipes 235. Furthermore, since the venturi pipes 235 are formed in a tapered shape at their inlets 235*a*, the streams flow into the venturi pipes 235 more effectively. The high-speed streams of city water and the flushing water W2 then come together, pass through the constricted line sections 235*b* of the venturi pipes 235, and speed up. As a result, negative pressure is generated in the constricted line sections 235*b* of the venturi pipes 235, and the flushing water W2 in the vicinity of the venturi pipes 235 is sucked by ejector action into the inlets 235*a* of the venturi pipes 235. The high-speed mixed flows of flushing water W2 and city water that have passed through the constricted line sections 235*b* then go through the expanded line sections 235*c*, where the pressure is restored, after which they flow into the branch pipes 234*b* of the discharge pipe casing 234. These mixed flows then merge at the terminals of the branch pipes 234*b* and flow into the main discharge pipe 234*a*, and this merged flow is discharged from the jet pump assembly 23 and supplied to the flush toilet 1 through the pipe 14. From the pipe 14 on, the flushing water is the same as in the first embodiment, and the toilet is flushed with this flushing water.

With the flush toilet pertaining to this second embodiment, the spray nozzles 232 are disposed opposite the venturi pipes 235 in the plurality of jet pumps that form the jet pump assembly 23. Thus, as was described in the first embodiment, these jet pumps create an ejector action at a high efficiency along with the flow of the jetted flushing water into the venturi pipes 235. Accordingly, when these jet pumps are assembled into the jet pump assembly 23, the flushing water used for flushing the toilet can be supplied to the flush toilet, which is the destination of the flushing water, in a state of effectively increased flushing water discharge flow. Substantially the same flow increasing effect as in the first embodiment was again obtained with a flush toilet having the jet pump assembly 23 pertaining to this second embodiment. In other words, when city water was supplied at a flow of 25 L/min and a pressure of about 0.098 MPa (1 kgf/cm$^2$), a flushing water discharge was obtained at a flow of 80 to 100 liters/minute downstream from the jet pump assembly 23, or more specifically, at the pipe 14 terminal and in turn at the rim water channel 4*b*. Thus, an increase in flow of about 3 to 4 times was obtained. In addition, zero head can be achieved with the flushing water just as in the first embodiment, and the various effects mentioned above can be realized.

With the flush toilet pertaining to the second embodiment, the plurality of branch pipes 231*b* that branched off from the downstream end of the main water supply pipe 231*a* were used in supplying the flushing water to the spray nozzles 232 that made up the jet pump assembly 23. Also, the flushing water jetted from the spray nozzles 232 and the flushing water entrained therewith were made to flow into corresponding venturi pipes 235 disposed directly across from each of the spray nozzles 232, and these flows of flushing water were sent into the branch pipes 234*b* of each of the venturi pipes 235, after which they were merged at the branch pipe terminals. As a result, flushing water with substantially the same flow path surface area passes from the main water supply pipe 231*a*, through the jet pump assembly 23, and to the main discharge pipe 234*a*. Thus, there is no sudden expansion of the flow path surface area or accompanying separation of the flushing water from the flow path walls, so the pressure loss that would be caused by this separation can be avoided and there is no corresponding decrease in the efficiency of the flow increase.

Because the outer periphery of the gap S between the spray nozzle group Σ232 and the venturi pipe group Σ235 opens into the internal space of the flushing water tank 8, it is possible for the flushing water W2 to flow freely into the venturi pipe group Σ235 from all directions. Thus, just as with the first embodiment, there is an improvement in the efficiency at which the flushing water is sucked into the venturi pipe group Σ235 by the ejector action, and the effect of increasing the flushing water discharge flow can be enhanced.

Also, in this second embodiment, the cross sectional area AMS of the main water supply pipe 231*a* is substantially equal to the sum SASS of the cross sectional areas ASS of the branch pipes 231*b*. Thus, there is no sudden expansion or reduction in the flow path surface area when the flushing water passes from the main water supply pipe 231*a* into the various branch pipes. This means that the separation of the flushing water from the flow path walls that would accompany an expansion in the flow path surface area can be avoided, and the pressure loss that would be caused by separation can be suppressed. Also, the increase in pressure loss caused by friction with the flow path walls that would accompany a reduction in the flow path surface area can be suppressed. As a result, a decrease in flushing water jetting pressure is suppressed not only for the individual spray nozzles for also for the spray nozzle group Σ232, which increases the flushing water discharge flow of the jet pump assembly 23. The same applies to the flushing water that passes downstream from the venturi pipes, and the cross sectional area AMD of the main discharge pipe 234*a* is substantially equal to the sum ΣASD of the cross sectional areas ASD of the branch pipes 234*b*. Thus, pressure loss caused by sudden changes in the flow path surface area can also be suppressed during passage of the flushing water through the various branch pipes downstream from the venturi pipes, which increases the flushing water discharge flow of the jet pump assembly 23.

Furthermore, in this second embodiment, in disposing the spray nozzles and venturi pipes across from each other, the plurality of spray nozzles 232 are provided at substantially the same height on the top plate 233, and the plurality of venturi pipes 235 are also provided at the same locations on the bottom end plate 236. Thus, there is no need for the nozzle heights or venturi pipe locations to be adjusted individually, thereby facilitating the manufacture of the jet pump assembly 23.

In this second embodiment, since the ratio LSS/ASS of the branch pipe length LSS to the branch pipe cross sectional area ASS is constant among the branch pipes 231*b*, the pressure loss due to friction with the line walls can be equalized for all of the branch pipes 231*b*. Thus, the discharge pressure will be the same for all of the spray nozzles 232, so the stream group discharged from the spray nozzle group Σ232 will flow into the venturi pipe group Σ235 without being diverted, and the ejector action will be produced in all of the venturi pipes 235. Furthermore, if the nozzle heights and venturi pipe locations are made the same, as mentioned above, the spacings between the nozzles and venturi pipes for flushing water suction will all be the same in the individual jet pumps consisting of a spray nozzle and a venturi pipe disposed directly across from one another. As a result, the conditions under which the streams flow into the venturi pipes and the flushing water is sucked into the venturi pipes as a result thereof will be the same among the individual jet pumps, so the ejector action produced in the venturi pipes 235 will be equal, as mentioned above. As a result, there will be no bias in the flushing water suction in the venturi pipe group Σ235, so the performance by the jet pump assembly 23 in terms of increasing the flushing water discharge flow can be enhanced.

Because the ratio LSD/ASD of the branch pipe length LSD to the branch pipe cross sectional area ASD is constant for all of the branch pipes 234*b* on the discharge pipe casing 234 side, pressure loss due to friction with the surrounding walls is equalized for all of the branch pipes 234*b*. As a result, turbidity of the flushing water flow is suppressed at the inlet to the main discharge pipe 234*a* where the branch pipes 234*b* merge. Accordingly, separation of the flushing water flow from the line wall surfaces at the main discharge pipe 234*a* and beyond is suppressed, so pressure loss that would be caused by this separation can be suppressed. This allows decreases in discharge pressure of the jet pump assembly 23 to be minimized, and enhances the discharge performance of the jet pump assembly 23, that is, enhances the performance in terms of increasing the flushing water discharge flow.

As can be seen in FIG. 10, with the flush toilet pertaining to the present embodiment, the plurality of spray nozzles 232 are laid out so as to form the spray nozzle group Σ232, which is circular when viewed in elevation, and the surface area (viewed in elevation) of the spray nozzle group Σ232 is minimized. As a result, the jet pump assembly 23 is more compact.

With the flush toilet pertaining to this embodiment, the water supply pipe casing 231, the spray nozzles 232, the venturi pipes 235, and the discharge pipe casing 234 are integrally assembled, the result of which is a more solid jet pump assembly 23.

With the flush toilet pertaining to this embodiment, the plurality of branch pipes 231*b* and 234*b* are formed inside the branch pipe blocks 231*c* and 234*c*, which are made of plastic. Thus, if even if the branch pipes are small in diameter, there will be no unintended movement thereof during flushing water passage, so the jetting of the flushing water is stable. Also, since the plurality of branch pipes 231*b* and 234*b* can be handled in an integrated state, they are easier to handle. Furthermore, the block construction affords a more solid jet pump assembly 23.

Figure 13:
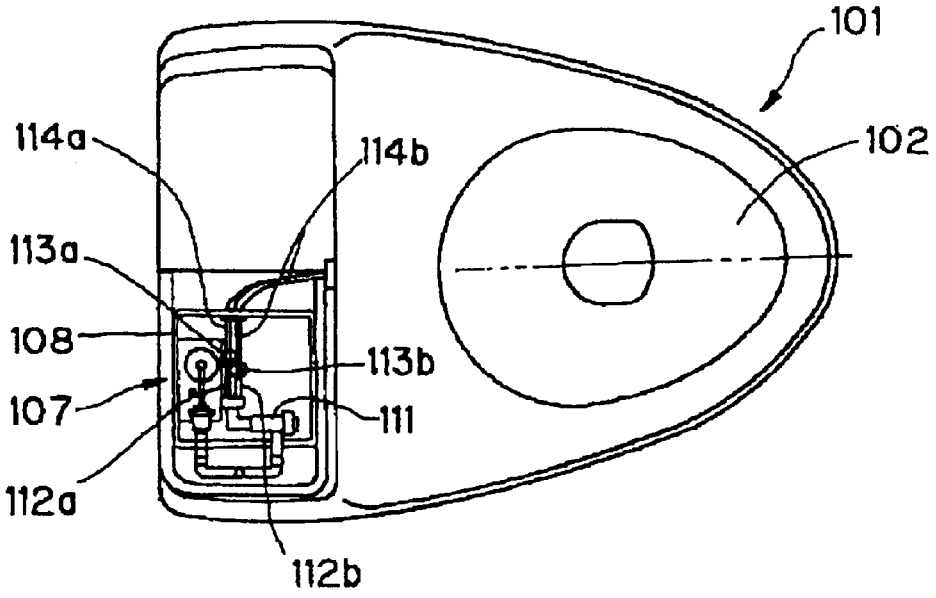
FIG. 13 is a top view of the flush toilet pertaining to a third embodiment, with part thereof cut away.
Figure 14:
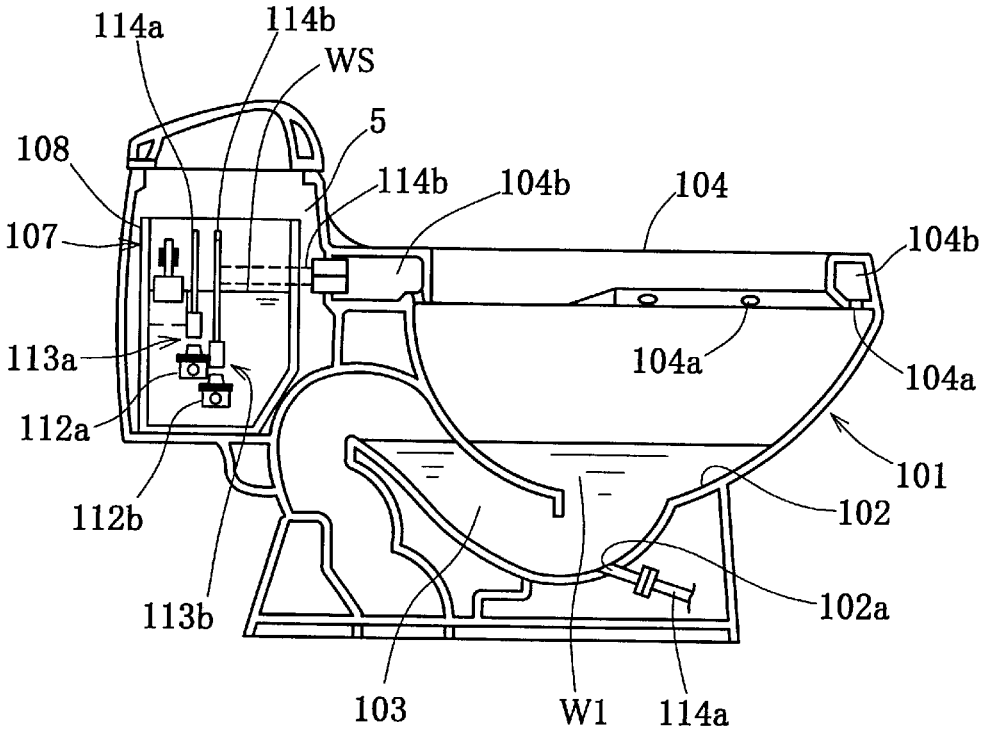
FIG. 14 is a simplified side cross section of the flush toilet pertaining to the third embodiment.
Figure 15:
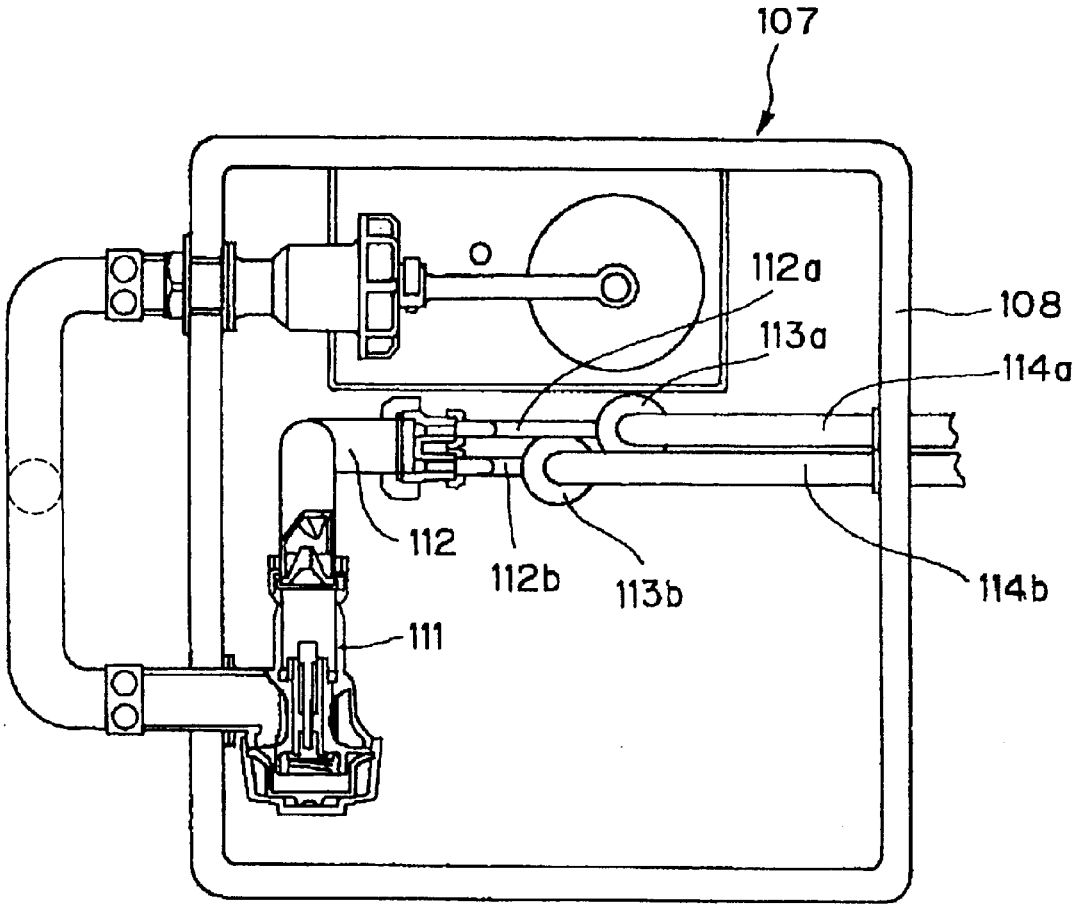
FIG. 15 is a top view of the toilet flushing tank device furnished to this flush toilet.

Next, a third embodiment of the present invention will be described. FIG. 13 is a top view of the flush toilet pertaining to this third embodiment, with part thereof cut away, FIG. 14 is a simplified side cross section of the flush toilet pertaining to the third embodiment, and FIG. 15 is a top view of the toilet flushing tank device furnished to this flush toilet.

As shown in these figures, the flush toilet 101 of the third embodiment is a so-called siphon jet type of toilet in which the flushing water is jetted directly into the toilet bowl in order to boost siphoning efficiency, and is structured as follows. This flush toilet 101 has a jet stream discharge port 102*a* pointed at a siphon trap 103 at the bottom of a toilet bowl 102, in addition to water discharge holes 104*a* provided to a rim water channel 104*b* of a rim 104.

This flush toilet 101 of the third embodiment, just as with the first embodiment, has a toilet flushing tank device 107 built into a tank holding area 5. The toilet flushing tank device 107 is provided inside the flushing water tank 8, with jet pumps 113*a* and 113*b* submerged in the flushing water in the tank. These jet pumps 113*a* and 113*b* have the same structure as the jet pump 13 in the first embodiment. The jet pump 113*a* is provided submerged at a location above the jet pump 113*b*. A pipe 112 that extends from a flush valve 111 branches into two branch pipes 112*a* and 112*b*. One branch pipe 112*a* is connected to the jet pump 113*a*, and the other branch pipe 112*b* to the jet pump 113*b*, and the branch pipes supply flushing water to their respective jet pumps by the opening of the flush valve 111. With the jet pump 113*a*, a pipe 114*a* is provided directly across from a spray nozzle (not shown), and this pipe 114*a* extends all the way to the jet stream discharge port 102*a* at the bottom of the toilet bowl 102. With the jet pump 113*b*, a pipe 114*b* provided directly across from a spray nozzle (not shown) is connected to the rim water channel 104*b*. This line configuration makes possible a flushing water discharge aimed at the toilet bowl surface from the water discharge holes 104*a* in the rim water channel 104*b*, and a flushing water discharge aimed at the siphon trap 103 from the jet stream discharge port 102*a*. Except for the above, the structure of the flush toilet pertaining to this embodiment is the same as that of the flush toilet pertaining to the first embodiment.

With the flush toilet pertaining to the third embodiment, the opening of the flush valve 111 causes flushing water (city water) to be supplied to the jet pumps 113*a* and 113*b* through the branch pipes 112*a* and 113*a*. This brings about the discharge of the mixed flow of city water and flushing water W2 from the two jet pumps. The mixed flow of city water and flushing water W2 discharged from the jet pump 113*a* goes through the pipe 114*a* and is discharged directly from the jet stream discharge port 102*a* toward the siphon trap 103, thereby creating a so-called jet discharge. The mixed flow of city water and flushing water W2 discharged from the jet pump 113*b* goes through the pipe 114*b* and the rim water channel 104*b* and is discharged from the water discharge holes 104*a* toward the toilet bowl 102, thereby creating a so-called rim discharge.

Because of this rim discharge and jet discharge, the standing water WI in the toilet bowl 102 behaves as follows. This standing water W1 is pushed to the siphon trap 103 side by the rim discharge from above the standing water surface. Furthermore, this standing water W1 receives a stream of the mixed flow of city water and flushing water W2 produced by jet discharge, and therefore flows toward the siphon trap 103. Thus, the siphon trap 103 is instantly filled with water, instantly generating a siphoning action. As a result, the standing water W1 and the waste therein are evacuated to the outside of the flush toilet 101 all at once through the siphon trap 103 by the discharged flushing water produced by rim discharge and jet discharge, which enhances the toilet flushing performance.

When the toilet bowl empties and the siphoning action comes to a stop, once the level of the flushing water W2 in the flushing water tank 8 drops below the level of the inlet to the throat (not shown) of the jet pump 113*a*, air is sucked in and the action of the jet pump 113*a* of increasing the flow comes to a stop. Since the jet pump 113*b* is submerged even at this point, the flow increasing discharge of the jet pump 113*b* continues even after the jet pump 113*a* has stopped. In other words, although the rim discharge and jet discharge commenced simultaneously when the flush valve 11 was opened, the jet discharge finishes first, after which the rim discharge finishes. The flushing water that flows into the toilet bowl 102 as a result of the rim discharge after the jet discharge has finished is stored as the standing water W1 for the next flush.

In this third embodiment, as discussed above, there are a plurality of jet pumps, and the jet pump 113*a* and the jet pump 113*b* are installed at different heights inside the tank. This pump installation height determines when the flow increasing discharge by the jet pump will be finished, as discussed above. Thus, the timing of the completion of flushing water discharge (in this embodiment, rim discharge and jet discharge) accompanied by the flow increasing action of the jet pumps can be variously adjusted by adjusting the pump installation height. In other words, the operating states of the jet pumps can be controlled individually, so it is possible to vary the pattern in which the flushing water is discharged during a toilet flush, which affords greater freedom in the design of the flush toilet. The same applies when a plurality of jet pump assemblies are used.

Figure 16:
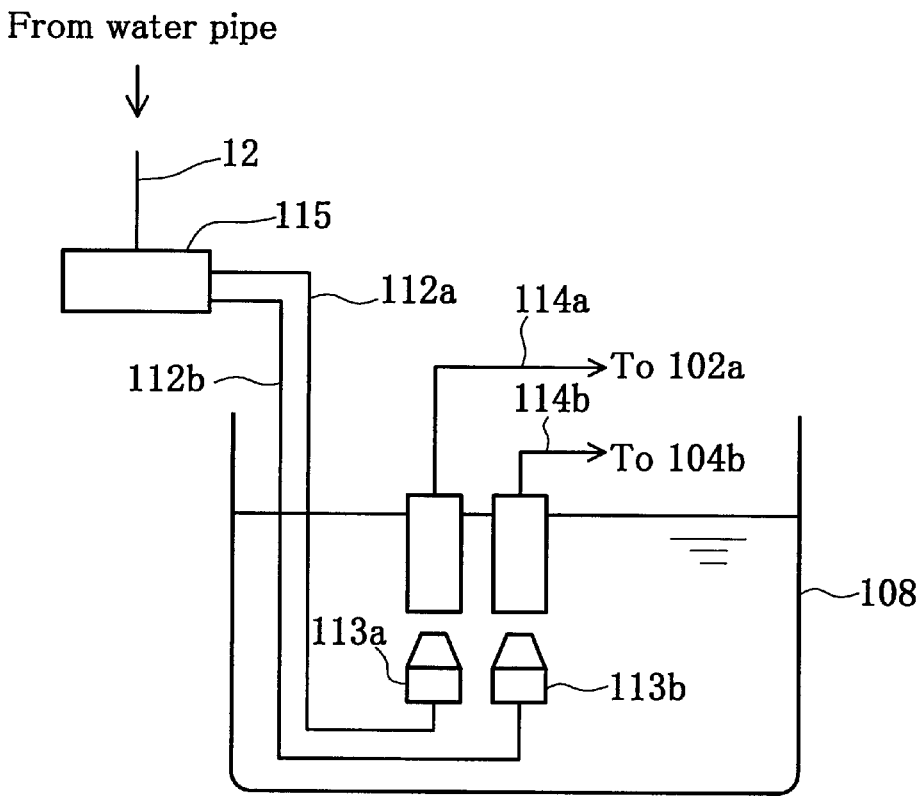
FIG. 16 is a block diagram of the simplified structure of the toilet flushing tank device in a variation embodiment.

With the third embodiment above, the operating states of the jet pumps were individually controlled by adjustment of the pump installation height, but the following variations are also possible. FIG. 16 is a block diagram of the simplified structure of the toilet flushing tank device in a variation embodiment. As shown in the figure, in this variation embodiment, the jet pumps 113*a* and 113*b* are disposed submerged in a flushing water tank 108 at the same height, and flushing water (city water) is supplied to the jet pumps through a flow path switching valve 115. In this case, the flow path switching valve 115 may have an electromagnetic valve structure incorporating an actuator such as a solenoid, or may have a valve structure in which the hydraulic pressure of the inflowing flushing water is utilized to slide the valve body. If the valve structure makes use of hydraulic pressure, there will be no need for electrical wiring or an actuator drive controller, which is advantageous in terms of both structure and cost. When this hydraulic valve structure is used, it is preferable to employ a so-called self-closing type of valve structure in which the opening and closing of the valve line is performed in parallel with flow path switching by pressure equilibrium on the left and right of the valve body.

Incorporating the flow path switching valve 115 in this way has the following advantages. If the flow path is sequentially switched by the flow path switching valve 115, the jet pumps 113*a* and 113*b* can be sequentially operated and controlled in different timing patterns. For instance, at the start of the supply of city water from the water pipe, the flow path is opened on the jet pump 113*b* side and rim discharge is performed by this pump, after which the flow path is switched to the jet pump 113*a* side so that jet discharge can be performed. In other words, the discharges for flushing the toilet can be carried out in the order of rim discharge and then jet discharge. If the flow path is switched back to the jet pump 113*b* upon completion of the jet discharge, the discharges can be carried out in the order of rim discharge, jet discharge, and then rim discharge. Therefore, incorporating the flow path switching valve 115 affords a greater degree of freedom in the discharge pattern.

In this case, the two jet pumps 113*a* and 113*b* downstream from the flow path switching valve 115 can also have different discharge capacities (instantaneous flow capacities). If so, flushing water can be discharged from these two jet pumps in different quantities during the respective discharges, affording even greater freedom in designing the discharge pattern. Furthermore, if sequential discharge is performed as above using the flow path switching valve 115, the discharge quantities during the various discharges can be different. For instance, flushing water can be discharged in a small instantaneous flow during rim discharge and in a large instantaneous flow during jet discharge. The flow amounts can also be reversed for the rim discharge and jet discharge. If the discharge time is varied between the rim discharge and jet discharge, or more specifically, if the switching time of the flow path switching valve 115 is varied, then the discharge quantity itself can also be adjusted during rim discharge and jet discharge.

Figure 17:
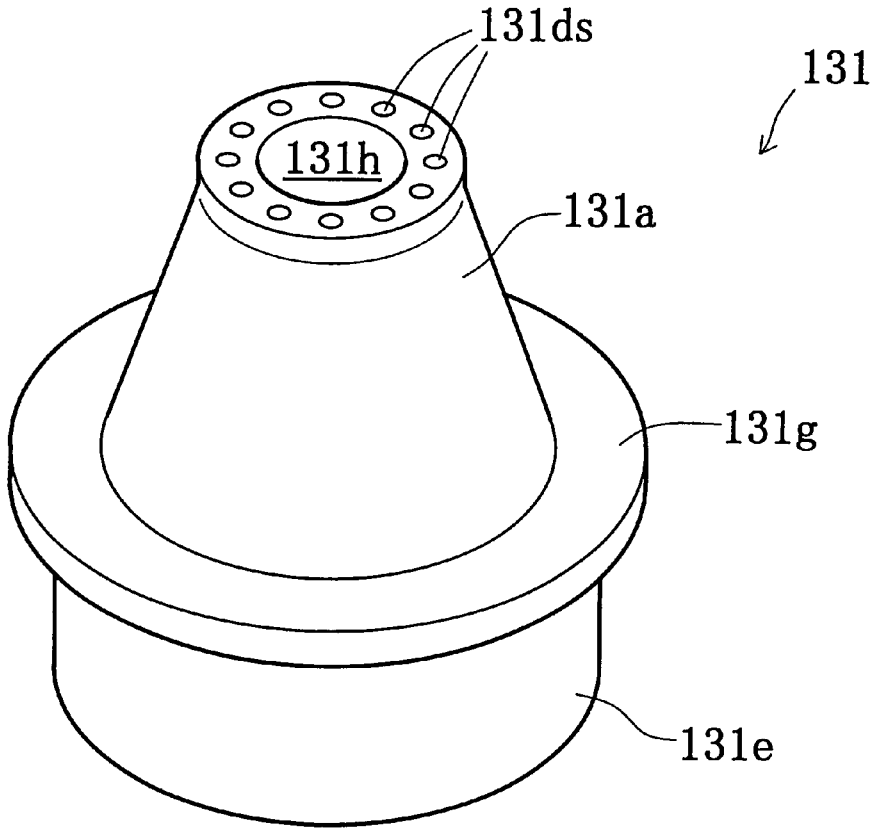
FIG. 17 is a simplified oblique view illustrating a variation embodiment of the spray nozzle in the jet pump 13 in the first embodiment.
Figure 18:
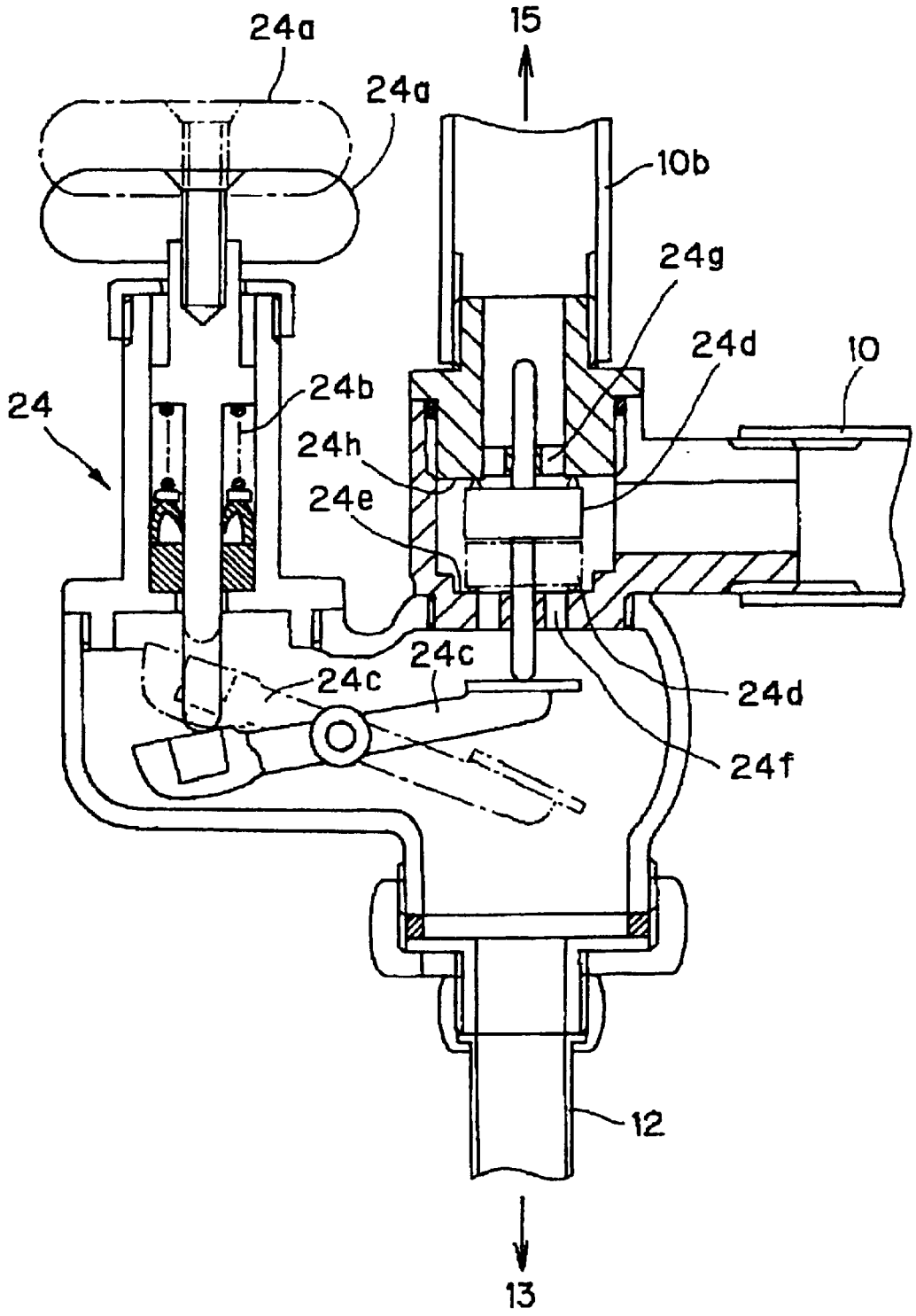
FIG. 18 is a side cross section of a variation embodiment of the device for water supply to the jet pump 13 in the first embodiment.
Figure 19:
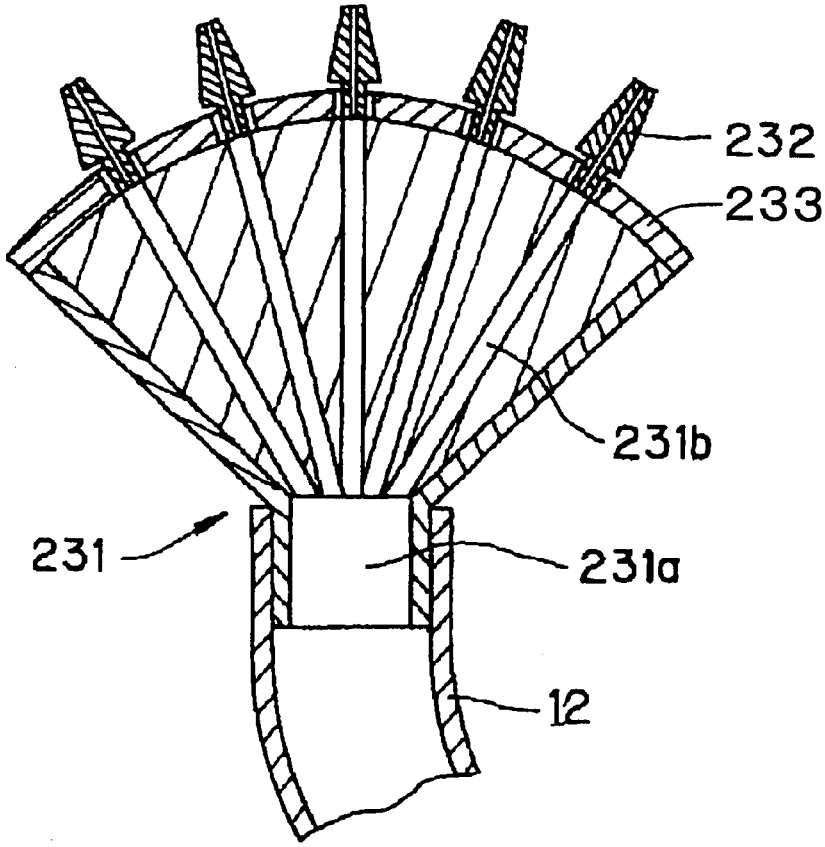
FIG. 19 is a partial side cross section of a variation embodiment of the jet pump assembly in the second embodiment.
Figure 20:
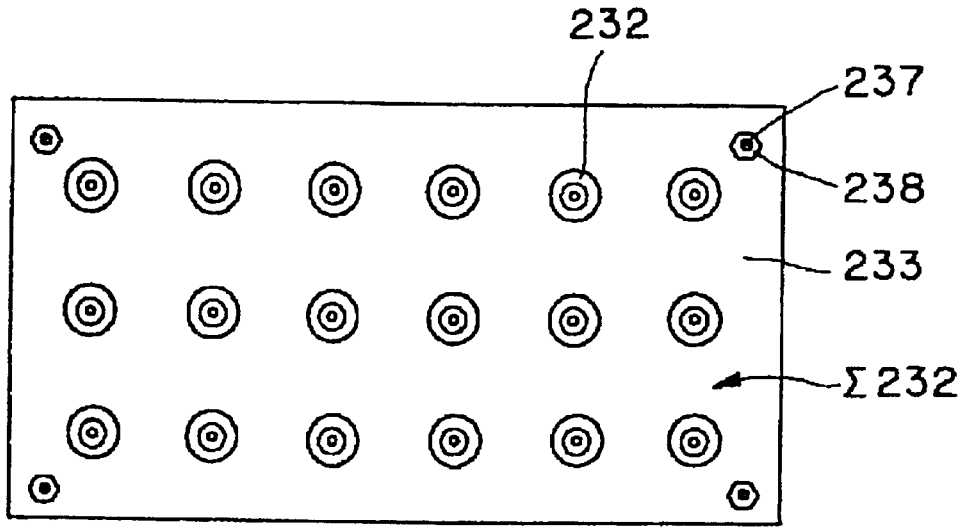
FIG. 20 is a front view of a variation embodiment of the spray nozzles in the jet pump assembly of the second embodiment.
Figure 21:
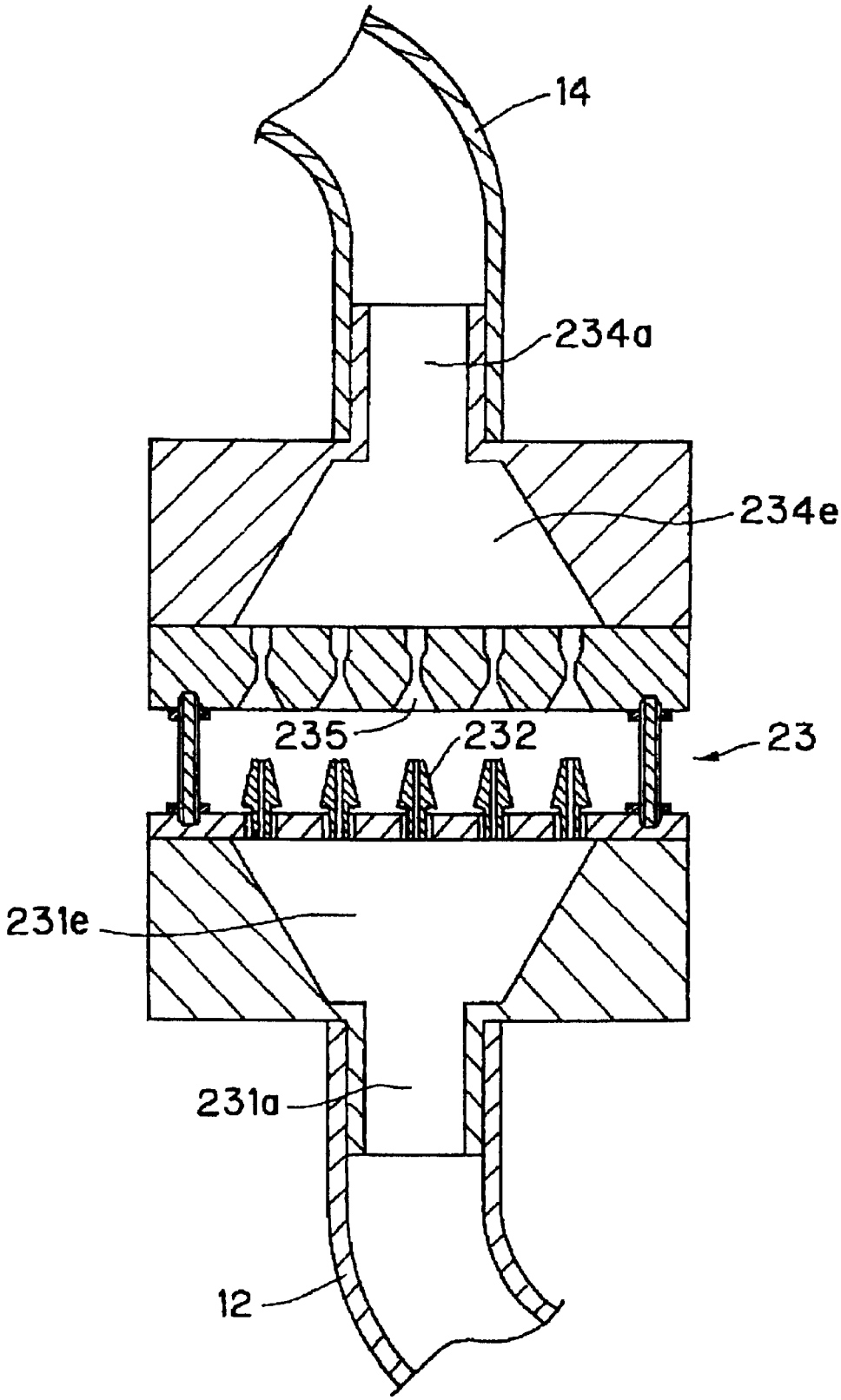
FIG. 21 is a side cross section of another variation embodiment of the jet pump assembly in the second embodiment.
Figure 22:
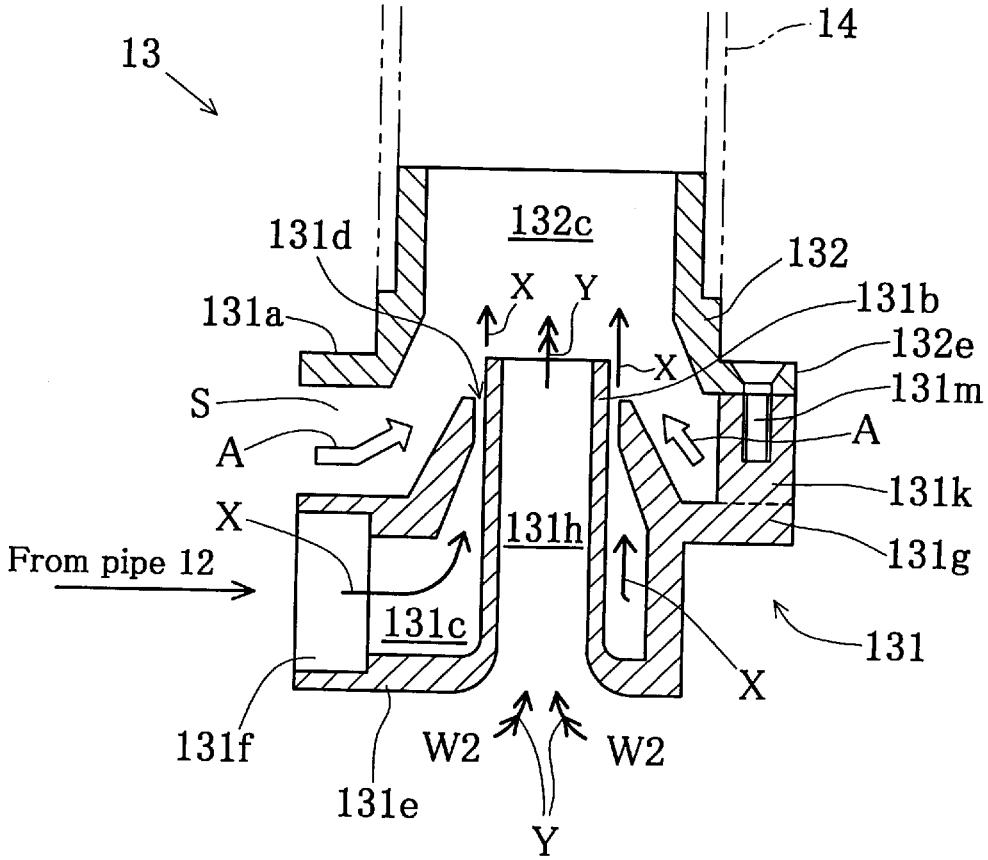
FIG. 22 is a diagram illustrating through a cross section yet another variation embodiment of the spray nozzle in the jet pump 13 of the first embodiment.

Variations on the above embodiments will now be given. FIG. 17 is a simplified oblique view illustrating a variation embodiment of the spray nozzle in the jet pump 13 in the first embodiment. FIG. 18 is a side cross section of a variation embodiment of the device for water supply to the jet pump 13 in the first embodiment. FIG. 19 is a partial side cross section of a variation embodiment of the jet pump assembly in the second embodiment. FIG. 20 is a front view of a variation embodiment of the spray nozzles in the jet pump assembly of the second embodiment. FIG. 21 is a side cross section of another variation embodiment of the jet pump assembly in the second embodiment. FIG. 22 is a diagram illustrating through a cross section yet another variation embodiment of the spray nozzle in the jet pump 13 of the first embodiment In the first embodiment, as shown in FIG. 6, the jet port 131*d* of the spray nozzle 131 was a continuous opening in the form of a circular ring whose width was narrower than the line upstream (the flow path 131*c*) there from. The shape of the opening of the jet port 131*d*, however, is not limited to being a continuous circular ring, nor is the opening width limited to being narrower than the line upstream from the jet port (the flow path 131*c*). The annular opening may be in any shape desired, such as an elliptical ring, an oval ring, or a polyhedral ring. In this case, an advantage to the jet port 131*d* being in the form of a circular ring is that it is easier to manufacture. Also, the opening width of the jet port 131*d* can be substantially the same as that of the line upstream from the jet port (the flow path 131*c*).

In the first embodiment, the jet port 131*d* of the spray nozzle 131 was in the form of a narrow, continuous circular ring. It is not limited to this, however, and as shown in FIG. 17, a plurality of jet ports 131*d*s can be arranged in a ring to produce a jet port cluster, and this jet port cluster can serve as the jet port 131*d*. Again with a spray nozzle 131 in which a plurality of jet ports 131*d*s are arranged in a ring in this way, the high-speed streams of city water jetted from the jet ports 131*ds* merge downstream from the jet ports to form a cylindrical high-speed stream. Thus making the stream cylindrical increases the outside diameter of the high-speed stream of city water, so the increase in flushing water discharge flow provided by the jet pump 13 will be more efficient, as described in the first embodiment.

The shape in which the plurality of jet ports 131*ds* are arranged can be any annular shape desired, such as a circular ring, an elliptical ring, an oval ring, or a polyhedral ring. The openings of the jet ports 131*d* s that are laid out annularly can also have various shapes, such as circular or polyhedral. In this case, if the jet ports 131*ds* are circular in shape, the jet ports can be formed using multipurpose machinery such as a drill, which helps lower manufacturing costs.

In the first embodiment, the supply of water to the jet pump 13 and the supply of water to the ball tap 15 were performed through the flush valve 111 and from the branch pipes 10*a* and 10*b*, which the pipe 10 connected to the water pipe are branched into, and the point when the ball tap 15 was opened (the point when the flushing water was replenished) was adjusted and delayed by means of the small tank 18 and the float 17. However, the supply of water to the jet pump 13 and the supply of water to the ball tap 15 may be switched using a flow path switching valve 24 as shown in FIG. 18.

This flow path switching valve 24 places a lever 24*a* at the upper location indicated by the imaginary line by means of the biasing force of a spring 24*b* when no pushing force has been applied to the lever 24*a* (when the toilet is not being flushed). At this point, a rocker rod 24*c* is under the weight of a valve body 24*d* and is at its first rotational position, indicated by the imaginary line. The valve body 24*d* descends by its own weight until it hits a valve seat 24*e* and closes a communicating hole 24*f*. As a result, a communicating hole 24*g* opens to allow communication between the pipe 10 and the branch pipe lob, and city water is supplied to the ball tap 15. Once the flushing water has been replenished and the tank filled to the full level from the ball tap 15 in this manner, the ball tap 15 is closed to stop the supply of flushing water. In this state, the valve body 24*d* is in contact with the valve seat 24*e*, and because the line is shut off by the closure of the ball tap 15, there is no leakage of the flushing water.

If a pushing force is applied to the lever 24*a* when the toilet is to be flushed, the lever 24*a* moves against the biasing force of the spring 24*b* to the lower position, indicated by the solid line. The rocker rod 24*c* is pushed by the lever 24*a* and moves to its second rotational position, indicated by the solid line. The valve body 24*d* is pushed up by the rocker rod 24*c* until it hits a valve seat 24*h* and closes the communicating hole 24*g*. As a result, the communicating hole 24*f* opens, allowing communication between the pipe 10 and the pipe 12, and city water is supplied to the jet pump 13.

The branching of the pipe 10 and the relatively expensive flush valve 11 in the first embodiment can be eliminated by using the flow path switching valve 24 shown in FIG. 18, or a flow path switching valve that operates in the same way. Thus, the cost of manufacturing the toilet flushing tank device 7 can be reduced.

As shown in FIG. 19, the water supply pipe casing 231 in the jet pump assembly 23 of the second embodiment can be such that the top plate 233 thereof is curved in a spherical shape, and the spray nozzles 232 are distributed over the spherical surface. If so, the branch pipes 231*b* to the spray nozzles 232 should be formed in a substantially radial shape so that the length LSS of all the branch pipes 231*b* can be easily made the same. Thus, pressure loss due to friction with the line walls during the passage of water through the branch pipes can be easily equalized merely by having the cross sectional area ASS be the same for the branch pipes 231*b*. Accordingly, the discharge pressure of all the spray nozzles 232 can be easily made the same, so there will be no divergence in the streams jetted from the spray nozzles of the jet pump assembly 23. Therefore, as mentioned above, the ejector action can be equalized in all of the venturi pipes, and there will be no divergence in the suction of the flushing water, which enhances the performance of the jet pump assembly in terms of increasing the flushing water discharge flow.

As shown in FIG. 20, in the second embodiment, the plurality of spray nozzles 232 may be provided so as to form a spray nozzle group Σ232 that is rectangular when viewed in elevation. With this nozzle layout, the venturi pipe group Σ235 is also rectangular when viewed in elevation. Compared to the circular venturi pipe group Σ235 (see FIG. 12), the rectangular venturi pipe group Σ235 allows for a shorter distance from the venturi pipes 235 in the center of the group to the edges of the jet pump assembly 23. This means that the distance that the flushing water has to move from this edge to the venturi pipes 235 in the center of the group is shorter, so there is an increase in the flow of flushing water W2 sucked into the venturi pipes 235 in the center of the group. As a result, the performance of the jet pump assembly in terms of increasing the flushing water discharge flow is better than when the circular spray nozzle group Σ232 is used.

As shown in FIG. 21, in the second embodiment, the jet pump assembly 23 has a manifold in the shape of a conical frustum on both the nozzle side and the venturi pipe side. The main water supply pipe 231*a* is connected to the plurality of spray nozzles 232 via a supply-side manifold 231*e*, and the plurality of venturi pipes 235 are connected to the main discharge pipe 234*a* via a discharge-side manifold 234*e*. This eliminates the need for forming branch pipes and simplifies the structure of the jet pump assembly 23, which lowers the cost of manufacturing the jet pump assembly 23.

The spray nozzle in the jet pump 13 of the first embodiment can also be varied as follows. As shown in FIG. 22, the jet pump 13 in this variation embodiment has an internal flow path that is straight, so the throat lower end opening and the jet port 131*d* of the spray nozzle 131 are disposed in proximity. Also, fixing legs 131*k* are provided at an equal pitch (such as a pitch of 1200) on the top surface of the flange 131*g*, and the throat 132 is fixed by screws 131*m* to these fixing legs 131*k*. In other words, in this variation embodiment, in supporting the throat and the spray nozzle across from one another, these two members are directly fixed without the use of a member that is separated from these two members, such as the bolts 133 shown in FIG. 5. Thus, the jet pump 13 can be handled as a solid assembly part.

Furthermore, with the jet pump 13 in this variation embodiment, the inner cylinder 131*b* for forming the jet port 131*d* and the through flow path 131*h* protrudes from the upper end of the outer cylinder 131*a*. Accordingly, the stream of flushing water jetted from the jet port 131*d* is guided to the protruding part of the through flow path 131*h* beyond the jet port 131*d* and flows into the throat 132. Thus, with the jet pump 13 in this variation embodiment, and the stream of flushing water can flow into the throat 132 without any turbidity developing in its flow, which enhances the suction efficiency of the flushing water in the tank as indicated by the outlined arrow A in the figure, and this enhances the performance of the jet pump 13 in terms of increasing the flushing water discharge flow.

Figure 23:
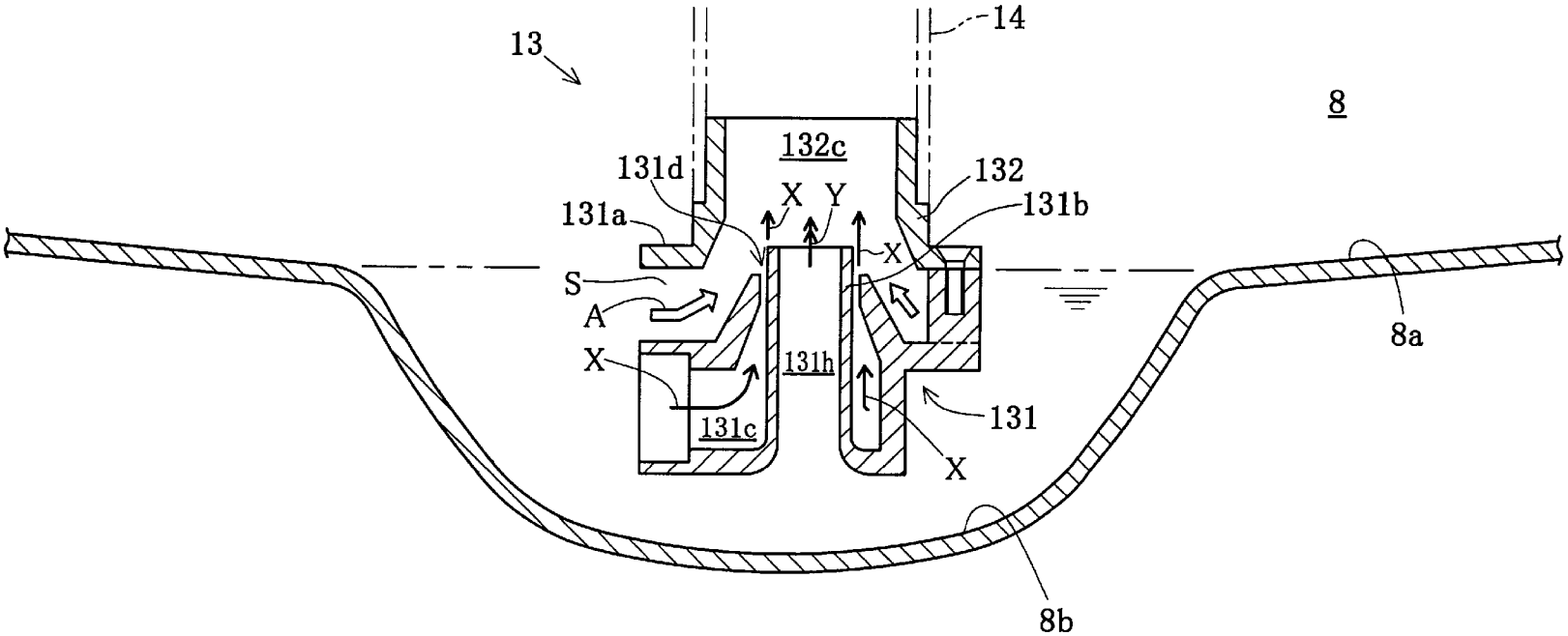
FIG. 23 is a diagram illustrating a variation embodiment of the submerged disposition of the jet pump 13.

Next, a variation embodiment will be described in which the jet pump 13 or the jet pump assembly 23 is disposed submerged in the tank. FIG. 23 is a diagram illustrating a variation embodiment of the submerged disposition of the jet pump 13.

As shown in the figure, in this variation embodiment a sunken depression 8*b* is provided at the bottom 8*a* of the flushing water tank 8, and the bottom 8*a* is a sloped surface all the way to this depression 8*b*. The jet pump 13 is installed such that it is located inside the depression 8*b*, and the height thereof is such that the upper end location of the depression 8*b* substantially coincides with the lower end opening location of the throat 132.

With this configuration, pumping stops when the water level in the tank drops below the upper end location of the depression 8*b* due to the operation of the jet pump 13 that has received a flushing water supply. Therefore, any flushing water remaining in the tank as a result of the stopping of the pumping can be kept to just the flushing water held inside the depression 8*b*, affording a reduction in the quantity of flushing water remaining behind in the tank without being drawn into the jet pump. Also, with this variation embodiment, because the tank bottom 8*a* is sloped toward the depression 8*b*, the flushing water in the tank readily accumulates in the depression 8*b*, allowing the remaining water in the tank to be used more effectively as flushing water in the depression.

In the first embodiment, the pipe 12 and the portion of the pipe 14 extending into the flushing water tank 8 may consist of flexible tubing or may have an expandable structure, and the height location of the jet pump 13 within the flushing water tank 8 may be adjustable.

When the level of the flushing water W2 in the flushing water tank 8 drops to the level of the inlet 132*a*, as discussed above, air is sucked in and ends the flow increasing discharge of the jet pump 13. Thus, the duration of the large-flow discharge of the mixed flow of city water and flushing water W2 is adjustable by adjusting the height location of the jet pump 13 inside the flushing water tank 8.

In general, the total amount of flushing water required to flush a toilet varies with the type of toilet (such as a siphon toilet or a siphon jet toilet), the toilet bowl volume, the amount of waste, and so forth, and the required duration of flow increasing discharge of the above-mentioned mixed flow also varies. Therefore, the duration of the flow increasing discharge of the mixed flow, and in turn the flushing water flow, is adjustable through adjustment of the height location of the jet pump 13.

In the second embodiment, the pipe 12 and the portion of the pipe 14 extending into the flushing water tank 8 may consist of flexible tubing or may have an expandable structure, and the height location of the jet pump assembly 23 within the flushing water tank 8 may be adjustable.

Figure 34:
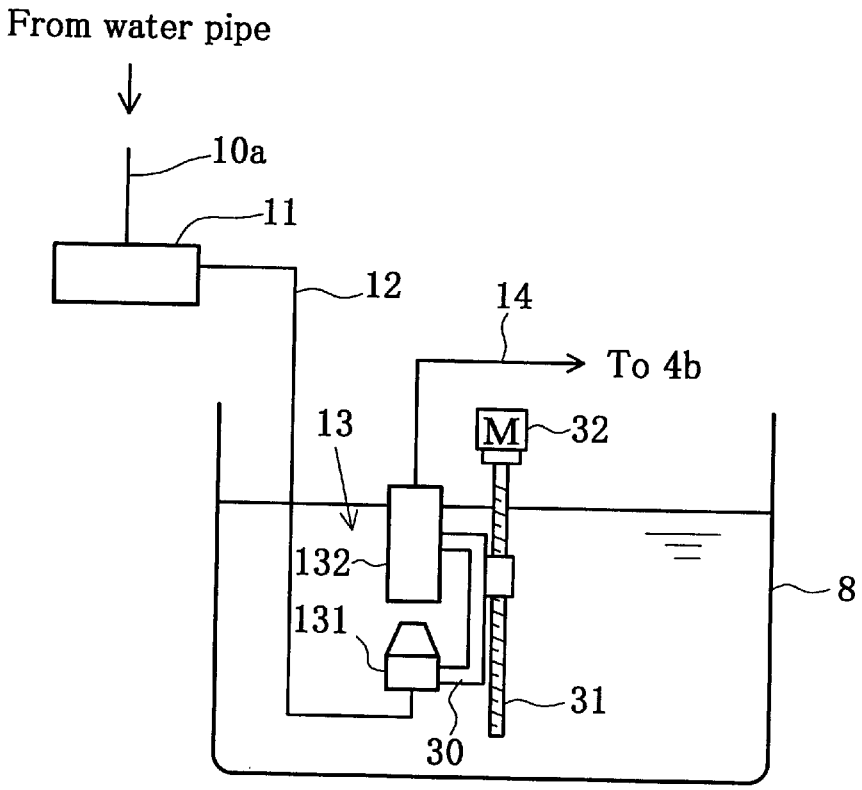
FIG. 34 is a block diagram illustrating a variation embodiment in which the height location (submerged location) of the jet pump 13 is adjusted.

FIG. 34 is a block diagram illustrating a variation embodiment in which the height location (submerged location) of the jet pump 13 is adjusted. As shown in the figure, in this variation embodiment the jet pump 13 has a fixed slider table 30, a ball screw 31 for moving this table up and down, and a motor 32 that is the rotational drive source thereof. The ball screw 31 and the motor 32 are installed in the tank by fasteners (not shown), and the motor 32 is rotationally controlled by a controller (not shown). The controller determines from how the large/small control button (not shown) is operated, for example, whether to provide a large flush, which requires a large flow of flushing water discharge, or a small flush, which needs only a small flushing water discharge. The controller also rotates the motor 32 to put the jet pump 13 at a low position for a large flush so that the jet pump 13 will be located on the tank bottom side. For a small flush, it rotates the motor 32 so that a higher position will be assumed. Since the jet pump position can thus be adjusted, the pipe 12 and the pipe 14 are made of flexible tubing so as to be able to conform to the up and down movement of the jet pump. A ball screw and motor do not necessarily have to be used, and the height location of the jet pump 13 can also be adjusted using a piston, a reciprocating actuator, or the like.

The jet port 131*d* of the spray nozzle 131 was aimed upward in the first embodiment, and the jet ports 232*a* of the spray nozzles 232 were aimed upward in the second embodiment, but the direction in which the jet ports 131*d* and 232*a* are aimed does not have to be up, and may instead be down, to the side, diagonally up, or diagonally down.

In the various embodiments given above, the toilet flushing tank device 7 or 107 was built into the flush toilet 1 or 101, but the toilet flushing tank device 7 or 107 may instead rest on the rim of the flush toilet 1 or 101. Because zero head can be achieved, the toilet flushing tank device 7 or 107 can be formed extremely flat. As a result, even when the toilet flushing tank device 7 or 107 is placed on the rim of the flush toilet 1 or 101, the bathroom will be more spacious and the bathroom space more pleasant than when a conventional toilet flushing tank device was placed on the rim of a toilet.

Because the toilet flushing tank devices 7 and 107 do not make use of head, they can be lower in height. Therefore, replacing an existing toilet flushing tank device resting on the rim of a flush toilet with the toilet flushing tank device 7 or 107 pertaining to the present embodiments can reduce the height of a flush toilet. Therefore, an existing toilet can be easily converted to a flush toilet that is low in height and the existing bathroom environment improved by installing the toilet flushing tank device 7 or 107 in a flush toilet.

Figure 24:
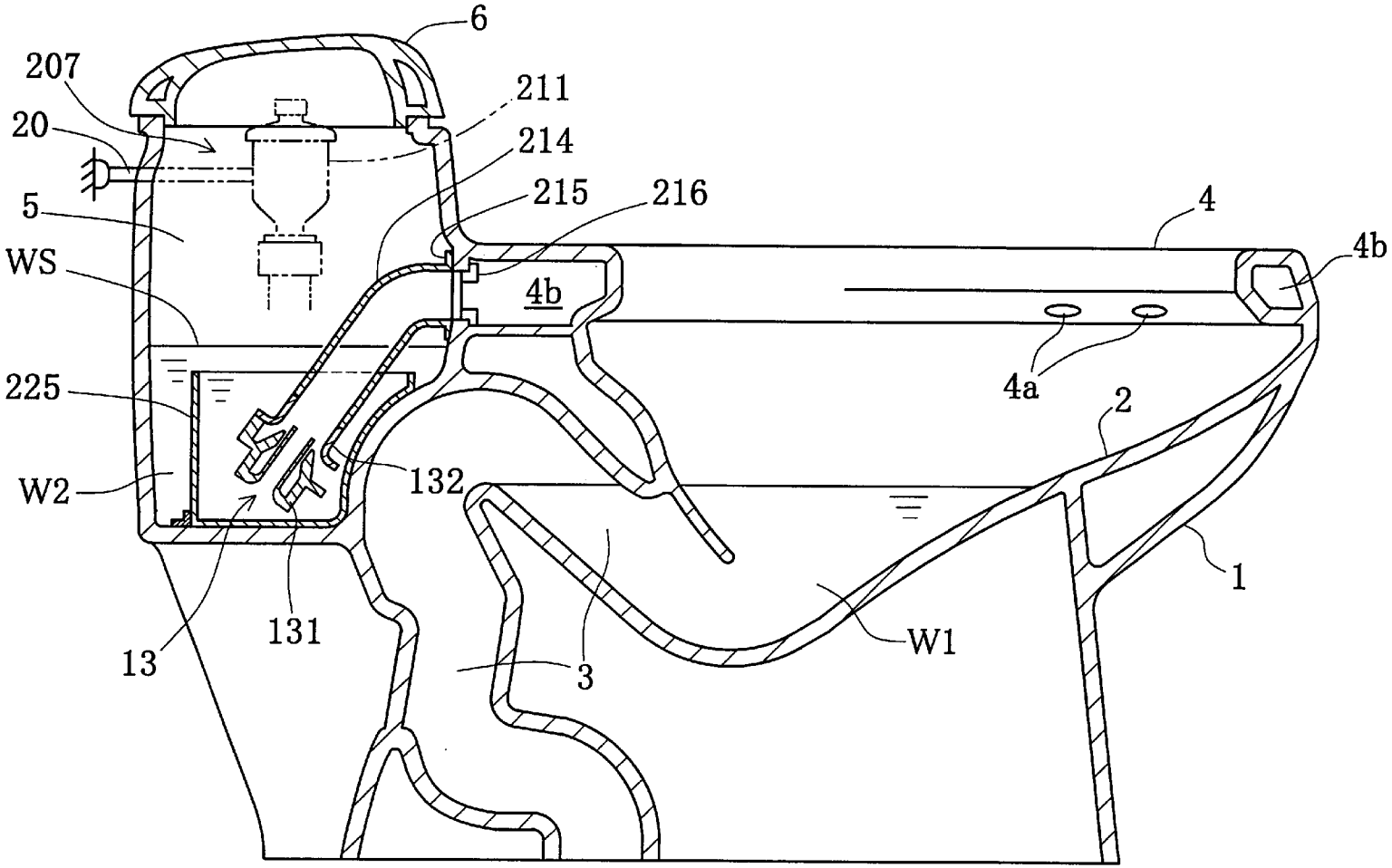
FIG. 24 is a diagram illustrating how the flushing water is held, how the jet pump 13 is installed, and so on, through a vertical cross section of the flush toilet 1 in a fourth embodiment.
Figure 25:
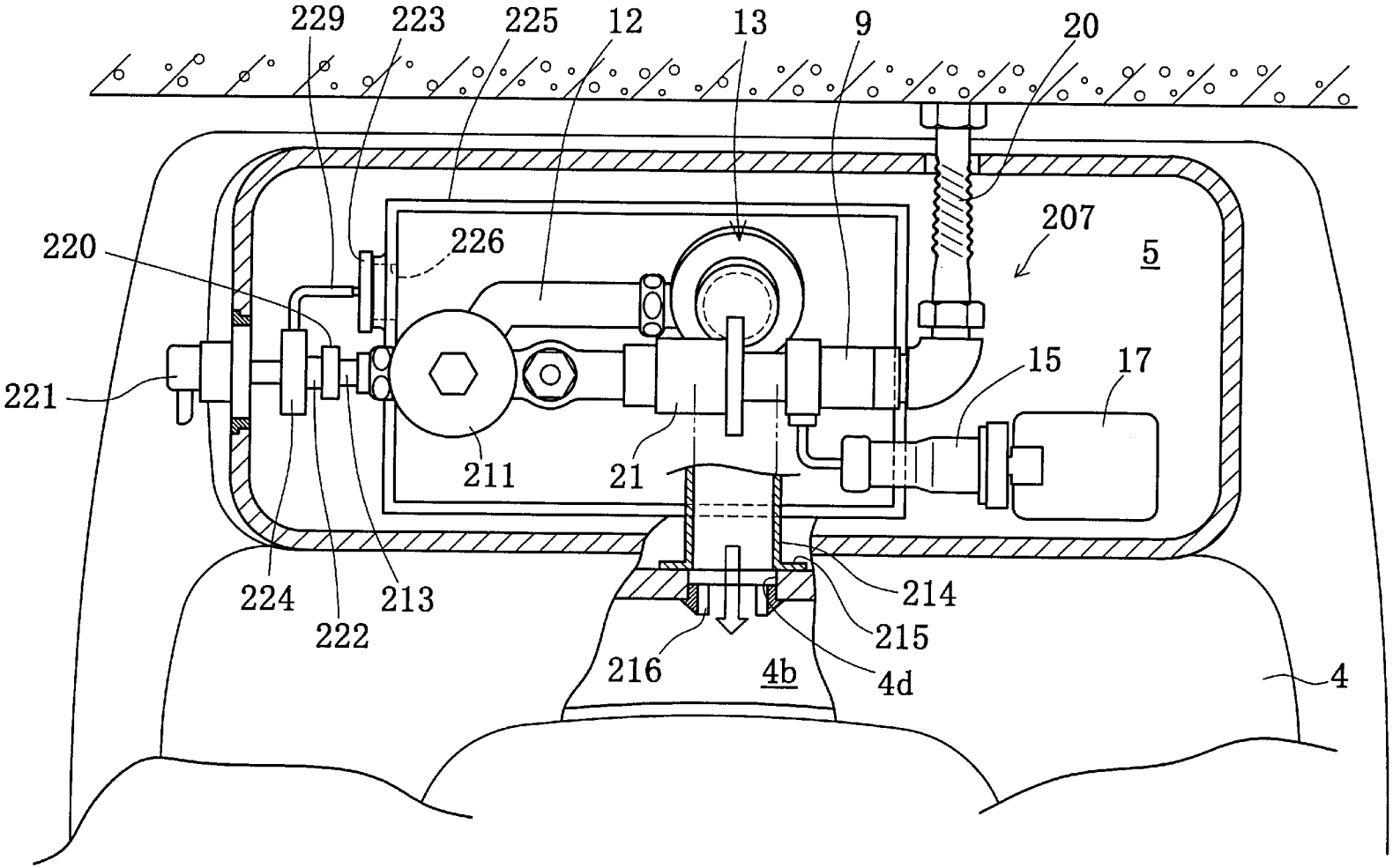
FIG. 25 is a diagram illustrating the layout of the tank device components through a horizontal cross section of the main part of the toilet.
Figure 26:
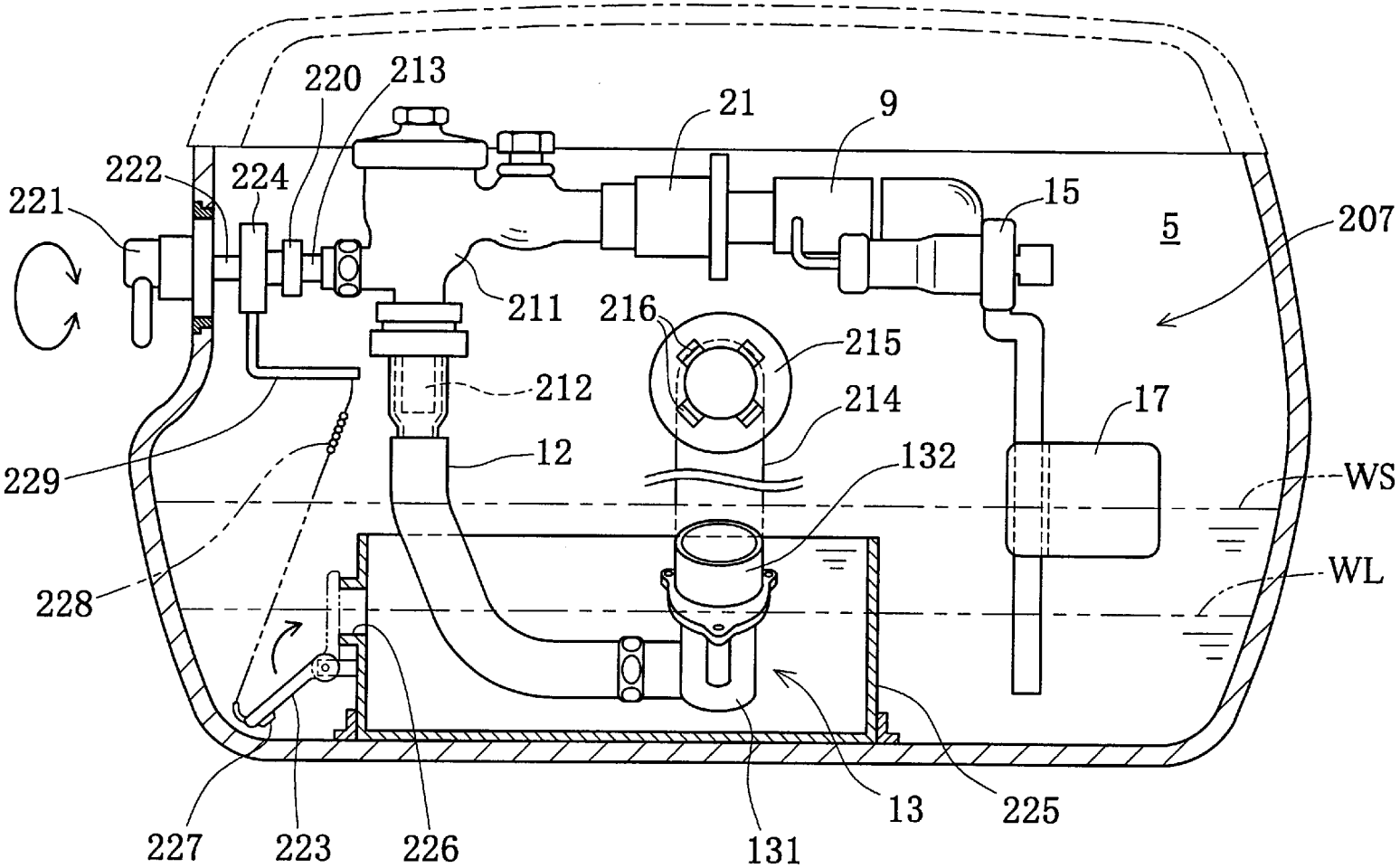
FIG. 26 is a diagram illustrating the layout of the tank device components through a vertical cross section of the main part of the toilet.

A fourth embodiment will now be described. Among other features, this fourth embodiment is characterized in that the flushing water tank and the toilet are integrated using the jet pump 13 illustrated in FIG. 22, and in that the quantity of flushing water supplied for flushing the toilet differs for large and small flushes. FIG. 24 is a diagram illustrating how the flushing water is held, how the jet pump 13 is installed, and so on, through a vertical cross section of the flush toilet 1 in the fourth embodiment. FIG. 25 is a diagram illustrating the layout of the tank device components through a horizontal cross section of the main part of the toilet. FIG. 26 is a diagram illustrating the layout of the tank device components through a vertical cross section of the main part of the toilet.

As shown in these figures, the flush toilet 1 in this fourth embodiment makes use of the inside of the tank holding area 5 itself to store the flushing water. Thus, there is no need for the separate provision of the flushing water tank 8, so fewer parts and less assembly labor are required. Accordingly, parts management and process management during the manufacture of the toilet are easier, which lowers the cost of manufacturing the flush toilet.

With this flush toilet 1, a toilet flushing tank device 207 is disposed as follows in the tank holding area 5 used for holding the flushing water. With this toilet flushing tank device 207, a primary pipe 20 connected to a water supply source (water pipe; not shown) is brought directly into the tank holding area 5. The primary pipe 20 is connected to the stop valve 9. The toilet flushing tank device 207 is equipped with a constant flow valve 21, a flush valve 211, and the pipe 12 along the line beyond this stop valve, and the pipe 12 is connected to the spray nozzle 131 of the jet pump 13.

Regardless of the original pressure of the water supply source (water pipe), the constant flow valve 21 guides the flushing water downstream of the valve at a constant flow (instantaneous flow). Providing this constant flow valve 21 upstream from the jet pump has the following advantages.

If the original water pressure is high, the flushing water (city water) will be supplied in a large instantaneous flow. Thus, if the line structure has no constant flow valve, then when the original water pressure is high, the supply of flushing water in a large instantaneous flow will allow the supply of the required quantity of water to be completed in a short time. If this is the case, the discharge of flushing water from the jet pump 13 will also be completed in a short time, and the toilet will not be flushed sufficiently. With the present embodiment, however, the constant flow valve 21 provided to the line allows the supply of a constant flow of flushing water to continue regardless of how high the original water pressure is, so proper toilet flushing can be ensured.

In supplying a constant flow of flushing water, a pressure reducing valve may be incorporated to the line instead of the constant flow valve. In this way, the flushing water can be supplied under a constant hydraulic pressure, therefore in a constant flow. It is also possible to provide to the line a flow sensor or a pressure sensor and the flow adjustment valve for adjusting the surface area of the line by an actuator, then to perform flow adjustment according to a sensor signal, thereby supplying the flush water with a constant flow.

Conversely, if the original water pressure is low, the flushing water will be supplied in a small flow, so the flushing water will not be jetted as forcefully from the jet pump 13, and again the toilet will not be sufficiently flushed. In this case, the supply of a constant flow of flushing water can be ensured by providing an auxiliary booster mechanism such as a booster pump to the route of the primary pipe 20, so proper toilet flushing can be ensured.

As shown in FIG. 24, this jet pump 13 is disposed submerged in the flushing water in the tank holding area 5 and aimed diagonally upward. A downstream pipe 214 is connected to the throat 132 facing the same direction. This downstream pipe 214 has a flange 215 on the terminal side thereof, and has a fixing tab 216 at the end. The downstream pipe 214 rises at an angle until it is at substantially the same height as the rim water channel 4*b*, and is connected substantially horizontally with the rim water channel 4*b*. In connecting with the rim water channel 4*b*, the tab 216 is fitted into a fixing hole 4*d* at the rear end of the rim, and the prong at the distal end of the tab is hooked onto the peripheral wall of the fixing hole.

The flush valve 211 has a vacuum breaker 212 on a secondary line. Thus, even if a backflow of flushing water toward the flush valve 211 side should occur for some reason, it will be eliminated by this vacuum breaker 212. The above valves, including the flush valve 211, are fixed at locations above the flushing water full level WS, as shown in the figures.

A knob 213 for opening this flush valve 211 is connected to a conversion mechanism 220 for converting forward and backward rotational action into straight-ahead action. This conversion mechanism 220 is designed such that the valve opening knob 213 is pushed in when it receives, via a rotary shaft 222, the forward or backward rotation of a handle 221 that is operated when the toilet is flushed. The flush valve 211 supplies flushing water (city water) to the secondary side, that is, to the jet pump 13 side, when this valve opening knob is pushed in. In this case, the handle 221 is designed to be operated in different directions for large and small flushes. A link mechanism 224 for driving a closing cover 223 (discussed below) only when the handle is rotated for a small flush is incorporated into the rotary shaft 222.

The flush valve 211 that opens as above is no different in its internal valve structure from existing types, and has a self-closing construction that works through pressure equilibrium between the primary and secondary sides. In this fourth embodiment, the flush valve 211 closes (self-closes) after having been kept open for a predetermined length of time, whether for a flush after urination (small flush) or for a flush after defecation (large flush), which is discussed below, and supplies the specified quantity of flushing water (city water) to the jet pump 13.

Also, the toilet flushing tank device 207 has a refilling line that branches off from directly beneath the stop valve 9, that is, it branches off from the stop valve housing, and this line is connected to the ball tap 15. The ball tap 15 refills the flushing water in the tank holding area 5 through the floating and sinking of the float 17. This refilling will be discussed below.

In addition, the toilet flushing tank device 207 has a pump area container 225 surrounding the jet pump 13 on the inside of the tank holding area 5. This pump area container 225 is open at the top and closed at the bottom, and is fixed to the tank bottom. The pump area container 225 has the closing cover 223, which is hinged beneath the opening, and a weight 227 fixed to the cover. A water passage opening 226 is opened and closed by this closing cover 223.

The pump area container 225 is submerged in the flushing water held in the tank holding area 5, and the top end thereof is lower than the full level WS of the flushing water. The water passage opening 226 is formed so that the lowest water level WL of the flushing water upon completion of a flush is located within the opening, as described in the first embodiment. Therefore, the closing cover 223 allows the flushing water in the tank holding area 5 to pass into the pump area container 225 when the water passage opening 226 is in the open mode shown in the figure. Meanwhile, when the closing cover 223 is blocking the opening, it is impossible for the flushing water to pass through the water passage opening 226. Consequently, the jet pump 13 allows the flow of the flushing water in the tank holding area 5 from the full level WS down to the top of the pump area container 225, and allows the flow of the flushing water in the pump area container 225 from the top of the pump area container 225 down to the lowest water level WL, with the quantity being less than when the water passage opening is open.

The closing cover 223 is linked by a chain 228 to an opening and closing arm 229 of the link mechanism 224. The link mechanism 224 swings the opening and closing arm 229 around the rotary shaft 222 and lifts the closing cover 223 only when the handle 221 has been operated in the rotational direction of a small flush. As a result, the water passage opening 226 is closed by the closing cover 223. The link mechanism 224 has built into it a delay drive mechanism including an oil damper, gears, and so forth, and this drive mechanism maintains the position of the opening and closing arm 229 for a specific time, namely, from the start until the completion of a small flush, after which it returns the opening and closing arm 229 to its original position shown in the figure. Thus, when the handle 221 is operated for a small flush, the above-mentioned closing of the water passage opening 226 limits the amount of flushing water that can flow into the throat 132 to a small quantity. Because the heaviness of the weight 227 comes into play as the opening and closing arm 229 is being returned to its original position, the closing cover 223 quickly moves away from the closed position of the water passage opening 226 and opens this opening.

The toilet structure of the toilet bowl 2, the siphon trap 3, and so forth in the fourth embodiment above is the same as in the first embodiment.

Next, the operation of the flush toilet 1 in the fourth embodiment will be described.

With the flush toilet of this fourth embodiment, when the handle 221 is rotated in the direction of a large flush, the flush valve 211 opens while the water passage opening 226 remains open. Thus, a mixed flow is discharged from the jet pump 13 just as in the first embodiment, this mixed flow (the flushing water discharged from the jet pump) flows directly into the downstream pipe 214, goes through the rim water channel 4*b*, and is discharged from the water discharge holes 4*a* into the toilet bowl 2. In other words, flushing water is discharged into the toilet bowl in an amount determined by the full level WS and the lowest water level WL.

Meanwhile, when the handle 221 is rotated in the other direction for a small flush, the flush valve 211 opens as above to commence the supply of flushing water to the jet pump 13, and the water passage opening 226 is closed off to limit the quantity of flushing water that flows into the throat 132. Thus, while the above-mentioned discharge of the mixed flow from the jet pump 13 results from the opening of the flush valve 211, the quantity of discharged flushing water is limited to a small quantity by limiting the quantity that flows into the throat. Again with this small flush, the flushing water discharged from the jet pump goes through the downstream pipe 214 and the rim water channel 4*b*, and is discharged from the water discharge holes 4*a* into the toilet bowl 2.

Accordingly, with the flush toilet 1 in the fourth embodiment, the toilet can be flushed with a small amount of flushing water after urination or with a larger amount of flushing water after defecation, according to how the handle 221 is operated. Thus, with the flush toilet 1 of the fourth embodiment, the toilet can be flushed with a quantity of water appropriate for whether the toilet is used for urination or defecation.

Next, the refilling of the tank holding area 5 with flushing water will be described. Regardless of how the toilet is used, when flushing water is discharged from the jet pump 13 and the flushing water level in the tank holding area 5 drops, the float 17 descends. At substantially the same time as this descent of the float, that is, at substantially the same time as the start of the flush, the ball tap 15 is actuated and begins replenishing the flushing water. As a result, the flushing of the toilet by discharge of flushing water from the jet pump as above is carried out in parallel with the refilling of the tank holding area 5 with flushing water.

The amount of replenishing flushing water is determined by the pipe structure branching off from the stop valve 9 and is adjustable by adjusting the branch pipe diameter or the like, but is smaller than the amount of flushing water that flows into the throat 132. Thus, even though toilet flushing and flushing water replenishment are carried out in parallel, jet pump discharge from the jet pump 13 is accompanied by a drop in the water level in the tank holding area 5, which eventually falls to the lowest water level WL. When this happens, just as in the first embodiment, the toilet flushing is complete, after which flushing water is discharged to fill the toilet bowl 2 with standing water. Once the toilet bowl is filled with standing water, the flush valve 211 self-closes, after which only the flushing water replenishment from the ball tap 15 continues. As a result, the tank holding area 5 reaches the full level WS after the completion of a toilet flush.

The discharge of flushing water for the standing water will now be described. This flushing water discharge comprises the flushing water supplied from the flush valve 211 and the flushing water replenished from the ball tap 15 after the lowest water level has been reached. For a large flush, this replenishing flushing water flows through the water passage opening 226 and into the pump area container 225, and then flows into the throat 132 and on to the toilet bowl 2. For a small flush, the flushing water flows down from the top of the pump area container 225 into the container, and passes to the toilet bowl 2 just as for a large flush.

The present embodiment involves the following, so that the total quantity of flushing water used will be approximately 6 liters for a large flush and approximately 4 liters for a small flush.

The total quantity of flushing water is the sum of the quantity of flushing water that flows into the throat 132 and is discharged into the toilet bowl 2 (in-flow flushing water) and the quantity of flushing water supplied from the flush valve 211 (operating flushing water). As mentioned above, the amount of flushing water supplied through the flush valve 211 is the same for both large and small flushes, so the difference between a large and a small flush is the quantity of in-flow flushing water.

Out of the flushing water held in the tank holding area 5 prior to the start of flushing, the in-flow flushing water for a large flush comprises the flushing water between the full level WS and the lowest water level WL (the flushing water after filling) and the flushing water replenished from the ball tap 15, which is carried out concurrently with toilet flushing. The quantity of the above-mentioned flushing water after filling is determined by the internal volume of the tank holding area 5, for instance, and the quantity of replenishing flushing water is determined by the diameter of the branch pipes from the stop valve 9, for instance.

With a small flush, the in-flow flushing water comprises the flushing water between the top of the pump area container 225 and the full level WS in the tank holding area 5 prior to the start of flushing (the flushing water in the upper part of the container), the flushing water between the lowest water level WL and the top of the pump area container 225 prior to the start of flushing (the flushing water inside the container), and the above-mentioned replenishing flushing water. The quantity of the above-mentioned flushing water in the upper part of the container is determined by the internal volume of the tank holding area 5, the size of the pump area container 225, and so forth, the quantity of flushing water inside the container is determined by the container size, and the quantity of replenishing flushing water is determined by the diameter of the branch pipes from the stop valve 9 and so forth.

The in-flow flushing water quantity per unit of time going into the throat 132 along with the supply of operating flushing water to the spray nozzle 131 of the jet pump 13 is determined by the pump specifications. The flushing water discharge quantity when the standing water refills the toilet bowl after completion of a flush is determined by the size of the toilet bowl 2, for instance. Therefore, not only the pump specifications, but also the diameter of branch pipes from the stop valve 9, the pump area container size, the toilet bowl size, and other such design parameters were taken into account at the toilet design stage, and the above-mentioned pump specifications were set so that the total quantity of flushing water used would be approximately 6 liters for a large flush and approximately 4 liters for a small flush.

Overflow and flushing water backflow in the flush toilet 1 structured as above will now be discussed.

As discussed above, if the ball tap 15 does not stop the water properly during the replenishing of flushing water, the water level in the tank holding area 5 will exceed the full level WS and too much water will come in. In this case, however, the line from the jet pump 13 to the downstream pipe 214 functions as an overflow pipe, allowing the excess flushing water to run out to the rim water channel 4*b*. Thus, in the event of abnormal refilling, the flushing water will only fill the tank holding area 5 to the height of the top of the rim water channel 4*b*, and no leakage outside of the toilet will occur. If a blockage should occur for some reason in the rim water channel 4*b* or the siphon trap 3, the flushing water will rise over the height of the top of the rim water channel 4*b*. Thus, in order to avoid a situation such as this, it is preferable to install an overflow pipe to outside the toilet (not shown), which goes from a location between the bottom height and top height of the rim water channel 4*b* to a drain pipe (not shown) outside of the toilet.

Backflow of the flushing water inside the tank holding area 5 will occur if negative pressure should be generated in the primary line upstream from the flush valve 211. As shown in FIG. 26, however, this backflow can be avoided by means of the vacuum breaker 212 downstream from the flush valve 211. Furthermore, even if backflow should occur through the rim water channel 4*b* from the toilet bowl 2 side, backflow can be avoided if the vacuum breaker 212 is installed higher than the top of the rim water channel 4*b*. If the above-mentioned overflow pipe to the outside of the toilet is installed in this case, backflow of the flushing water to the flush valve 211 side can be avoided more effectively.

Furthermore, backflow from the rim water channel 4*b* to the tank holding area 5 side can also be avoided by providing the backflow check valve in the vicinity of the upper curved part of the downstream pipe 214 shown in FIG. 26.

In the above embodiments, it is also possible to eliminate the setting of the total quantity of flushing water for a large or small flush. In this case, the members related to setting the flow, such as the link mechanism 224, the pump area container 225, and the closing cover 223 and so on ancillary to these, can be eliminated, and the jet pump 13 can be installed directly submerged in the tank holding area 5.

Figure 35:
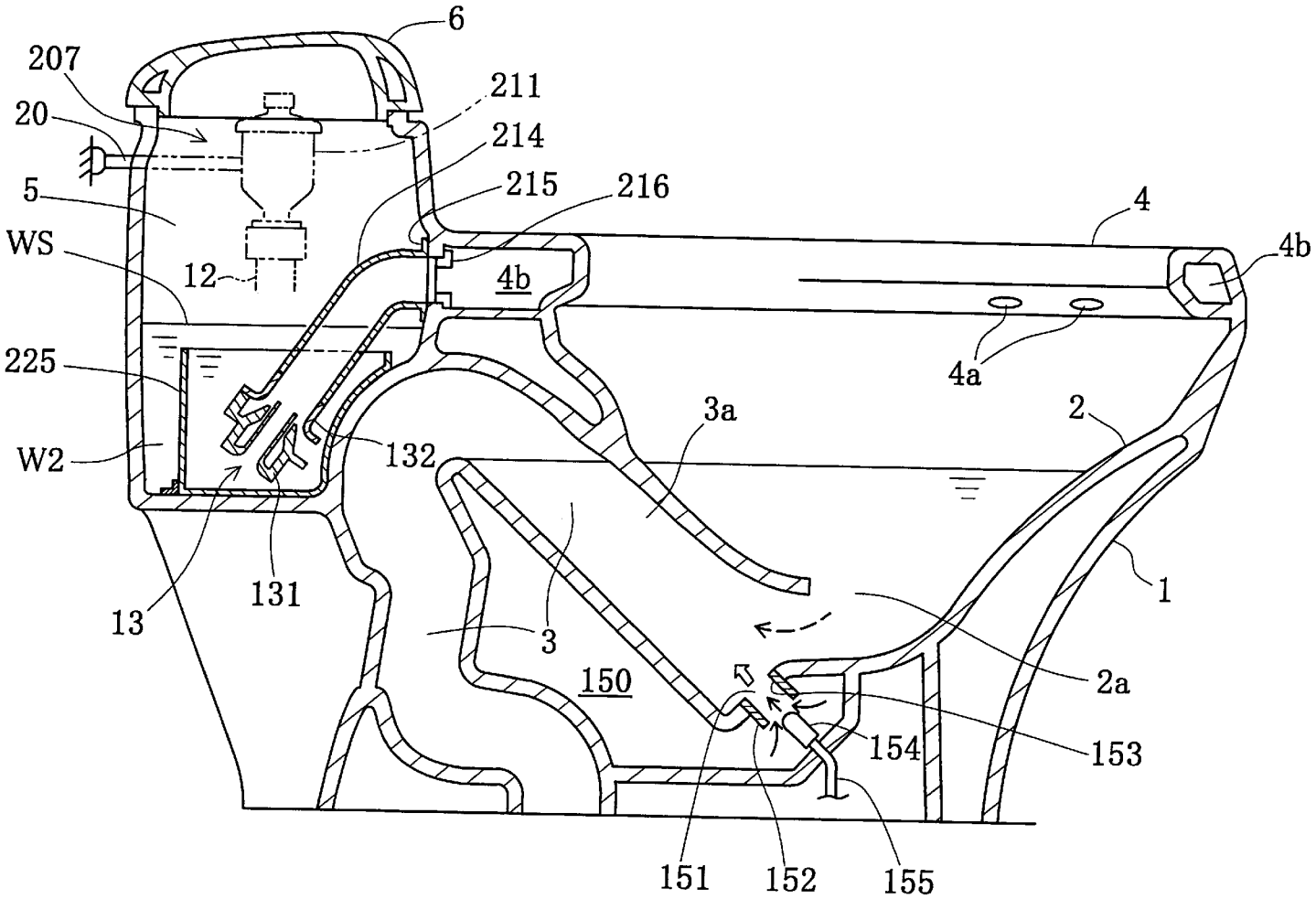
FIG. 35 is a cross section of a toilet, illustrating a variation embodiment of the fourth embodiment.

Variation embodiments on the above fourth embodiment will now be described. FIG. 35 is a cross section of a toilet, illustrating a variation embodiment of the fourth embodiment.

As shown in the figure, the flush toilet 1 in this variation embodiment has the siphon trap 3 linked to the waste receptacle 2*a* of the toilet bowl 2 below the toilet bowl. A riser 3*a* of this siphon trap 3 rises up from a location lower than the waste receptacle 2*a* and links to this receptacle.

The flush toilet 1 of this variation embodiment also has a flushing water holding component 150 for holding flushing water at the lower part of the riser 3*a*. This flushing water holding component 150 is formed at the base of the toilet bowl, from beneath the riser 3*a* to beneath the waste receptacle 2*a*. The flushing water holding component 150 is equipped in the center portion of the lowermost end thereof with a communicating hole 151 that communicates with the riser 3*a*. A cylinder 152 is fixed to the communicating hole 151 substantially parallel to the line direction of the riser 3*a*. This cylinder 152 is fixed so that the lower end reaches into the flushing water holding component 150. A discharge nozzle 154 with its communicating hole 153 aimed is provided below the cylinder 152 with a gap maintained between it and the cylinder. This discharge nozzle 154 is aimed at the line of the riser 3*a* through the cylinder 152. When flushing water is jetted from the discharge nozzle 154, the flushing water in the flushing water holding component 150 is sucked into the cylinder 152 as shown in the figure. As a result, the flushing water is increased in flow and jetted from the cylinder 152. Thus, the jet pump may consist of this discharge nozzle 154 and cylinder 152, and this jet pump jets flushing water from the place where the riser 3*a* rises up, and aimed at the line of the riser. The discharge nozzle 154 is linked to a linking pipe 155. The linking pipe 155 is disposed branching off from the pipe 12 downstream from the flush valve 211, and supplies operating water to the discharge nozzle 154.

Because of this structure, when the flush valve 211 is opened for a large or small flush, operating water (city water) is supplied to the jet pump 13 and the discharge nozzle 154 at substantially the same time. The above-mentioned jetting of flushing water by the jet pump 13 and the jetting of flushing water from the jet pump including the discharge nozzle 154 are then performed.

In this case, a flow path switching valve can also be provided downstream from the flush valve 211. If so, the supply of operating water to the jet pump 13 and the supply of operating water to the jet pump including the discharge nozzle 154 can be carried out sequentially with this switching valve. Thus, as discussed above, flushing water can be discharged to the toilet bowl 2 in the sequence of rim-jet-rim for both large and small flushes.

As shown in the figures, the flushing water holding component 150 communicates with the riser 3*a* and the waste receptacle 2*a* via the communicating hole 153 of the cylinder 152. Thus, if flushing water is standing in the toilet bowl 2, flushing water also flows through this communicating hole 153 and into the flushing water holding component 150, so the flushing water holding component 150 is filled with flushing water. The internal volume of the filled portion is about 0.5 liter, and this quantity of flushing water is sucked into the cylinder 152 and used to flush the toilet. An air bleed line (not shown) is provided to this flushing water holding component 150 so that the standing water will flow into the flushing water holding component 150 and the flushing water in the filled portion will be sucked into the cylinder 152. For instance, an air bleed line may be provided from the top of the flushing water holding portion to the tank holding area 5 so as not to interfere with the siphon trap 3.

A variation embodiment structured in this way has the following advantages in addition to the above-mentioned effect of the jet pump 13. Flushing water is discharged by the jet pump including the discharge nozzle 154 in a state of increased flow along the line of the riser 3*a* from place where the riser begins to rise up. The standing water (flushing water) in the waste receptacle 2*a* is enveloped in the water discharged from the cylinder 152 from the place where this receptacle communicates with the riser 3*a*. In other words, the flushing water flows into the riser 3*a* along the line thereof in a state of increased flow due to the jet pump consisting of the discharge nozzle 154 and the cylinder 152, increased flow due to being enveloped with the standing water, and increased instantaneous flow.

Thus, a large quantity of flushing water is sent into the riser 3*a* of the siphon trap 3 all at once through this flow increase and an increase in instantaneous flow. The waste in the waste receptacle 2*a* is forcefully pushed up along the line of the riser 3*a* along with this large quantity of flushing water. Furthermore, the discharge of this increased flow of flushing water causes the riser 3*a* and the trap line downstream therefrom (such as a downtake) to rapidly fill with this flushing water, effectively and quickly creating a siphoning action in the siphon trap 3. Also, the flow of flushing water discharged from the cylinder 152 into the riser 3*a* envelops the standing water as mentioned above, becoming a broad flow as indicated by the outlined arrow in the figure. Accordingly, if waste is present at the place where the riser 3*a* begins to rise up, it can be moved along the riser 3*a* by this broad flow together with the surrounding water. Therefore, regardless of the amount of waste in the toilet bowl, the waste can be transported to the toilet bowl more effectively, and the toilet can also be flushed more effectively. Furthermore, since this waste transport and toilet flushing involve nothing more than the discharge of flushing water from the discharge nozzle 154, there is, of course, the advantage of water conservation.

Next, a fifth embodiment will be described. The difference in this fifth embodiment is the supply of flushing water to the jet pump 13 in a large flush and a small flush in the setting of the total amount of flushing water to large or small. The flush toilet in the fifth embodiment is structured the same as the flush toilet in the fourth embodiment, except that it does not have the pump area container 225 or the ancillary closing cover 223 and so on. In other words, the flushing water is held in the tank holding area 5 itself, and the jet pump 13 is disposed diagonally.

Figure 27:
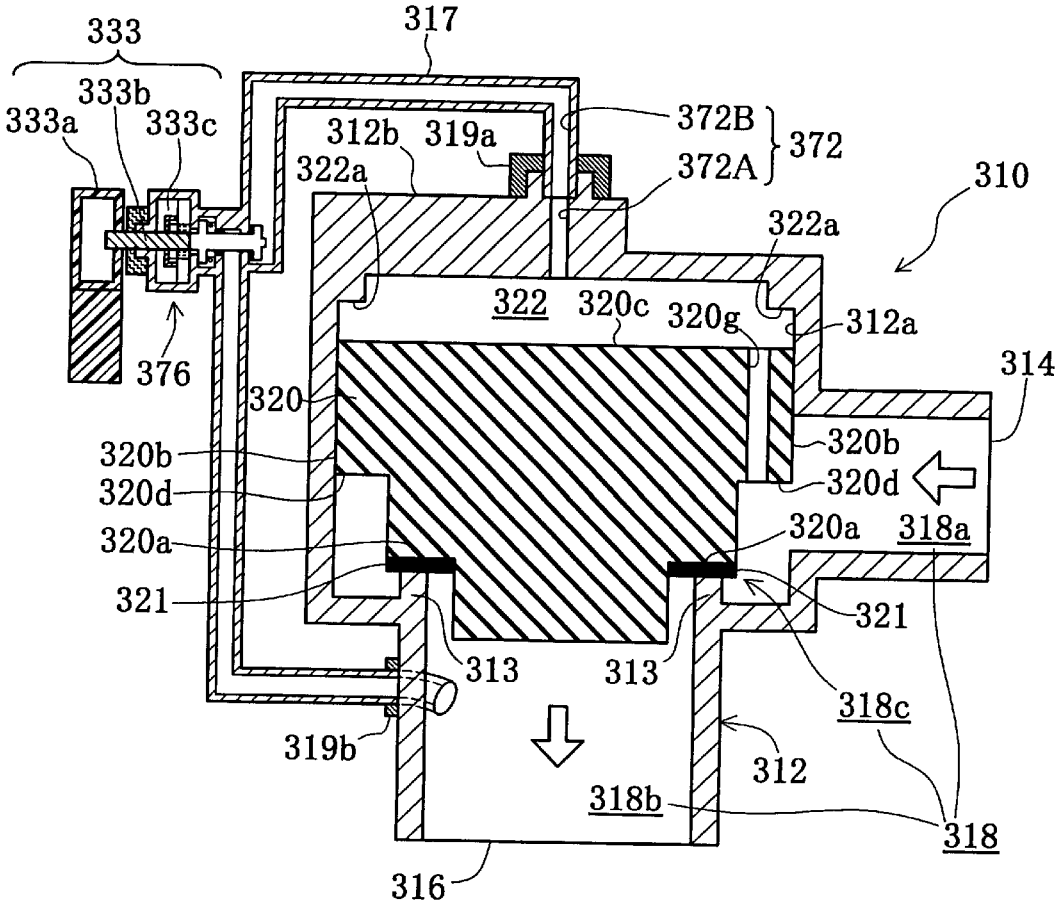
FIG. 27 is a simplified cross section of a flush valve 310 which is used in a fifth embodiment and allows the quantity of flushing water that passes to the secondary side to be varied between large and small.
Figure 28:
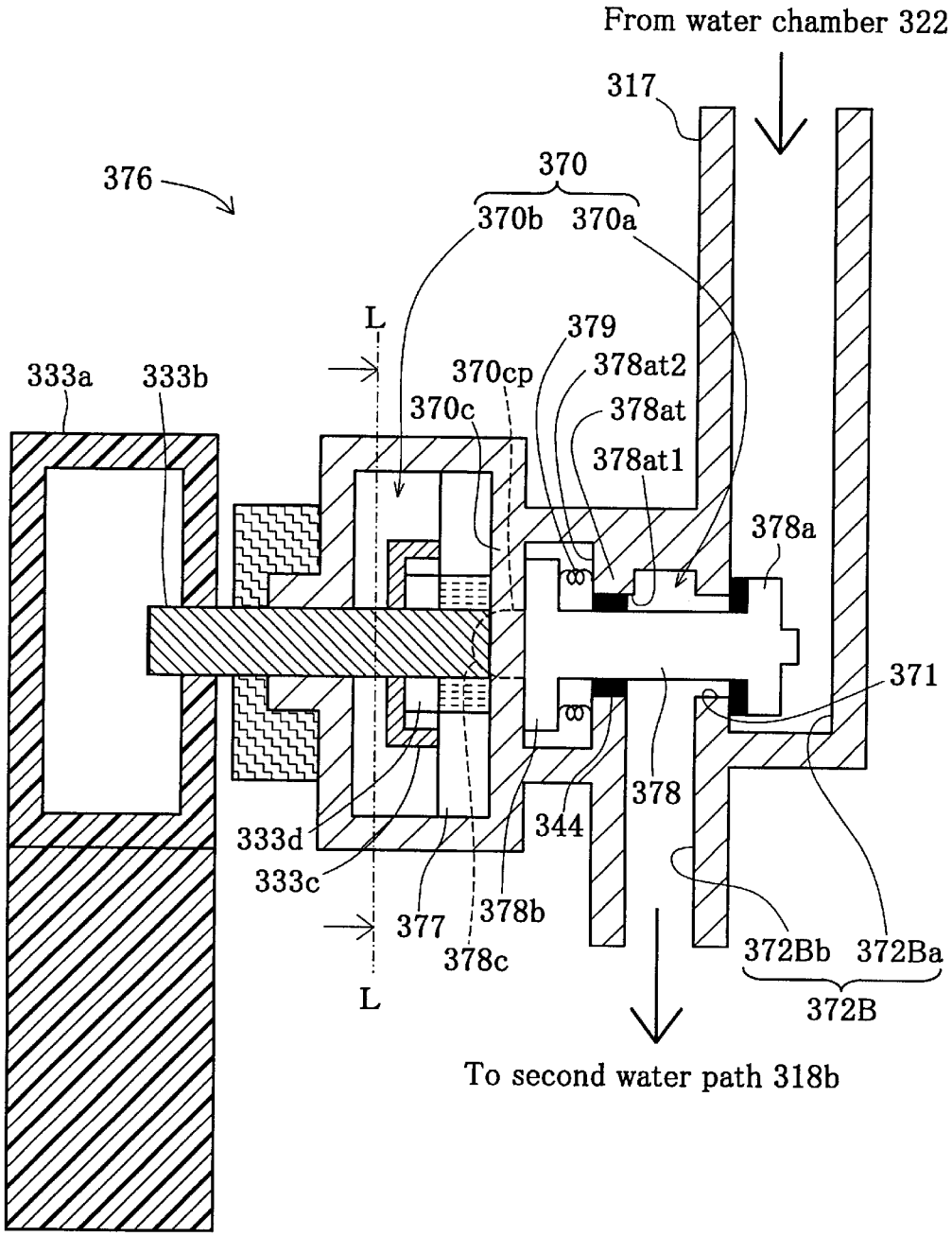
FIG. 28 is a detail cross section illustrating a shutoff valve 376.
Figure 29:
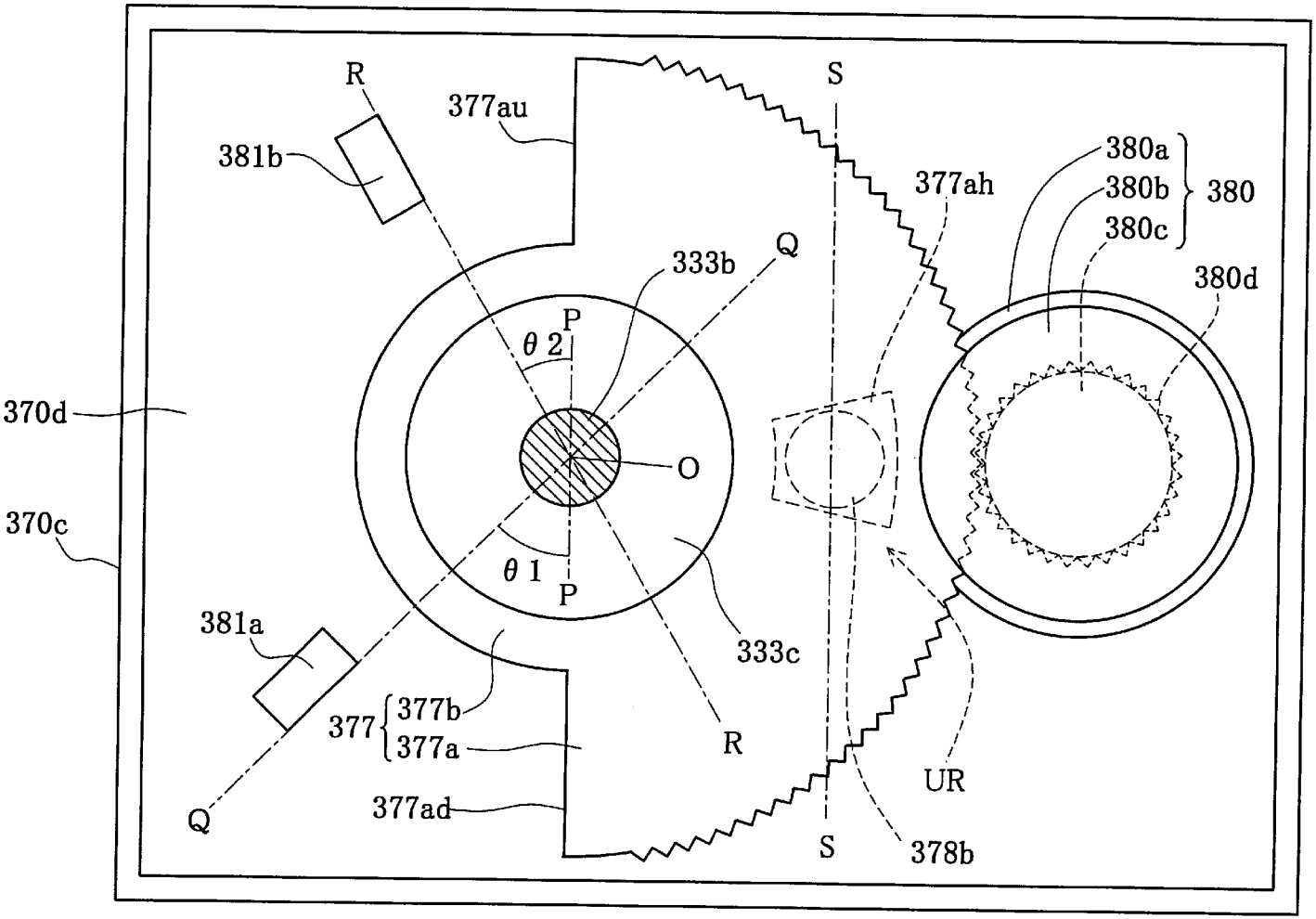
FIG. 29 is a cross section of the shutoff valve 376 along the L—L line in FIG. 28.
Figure 30:
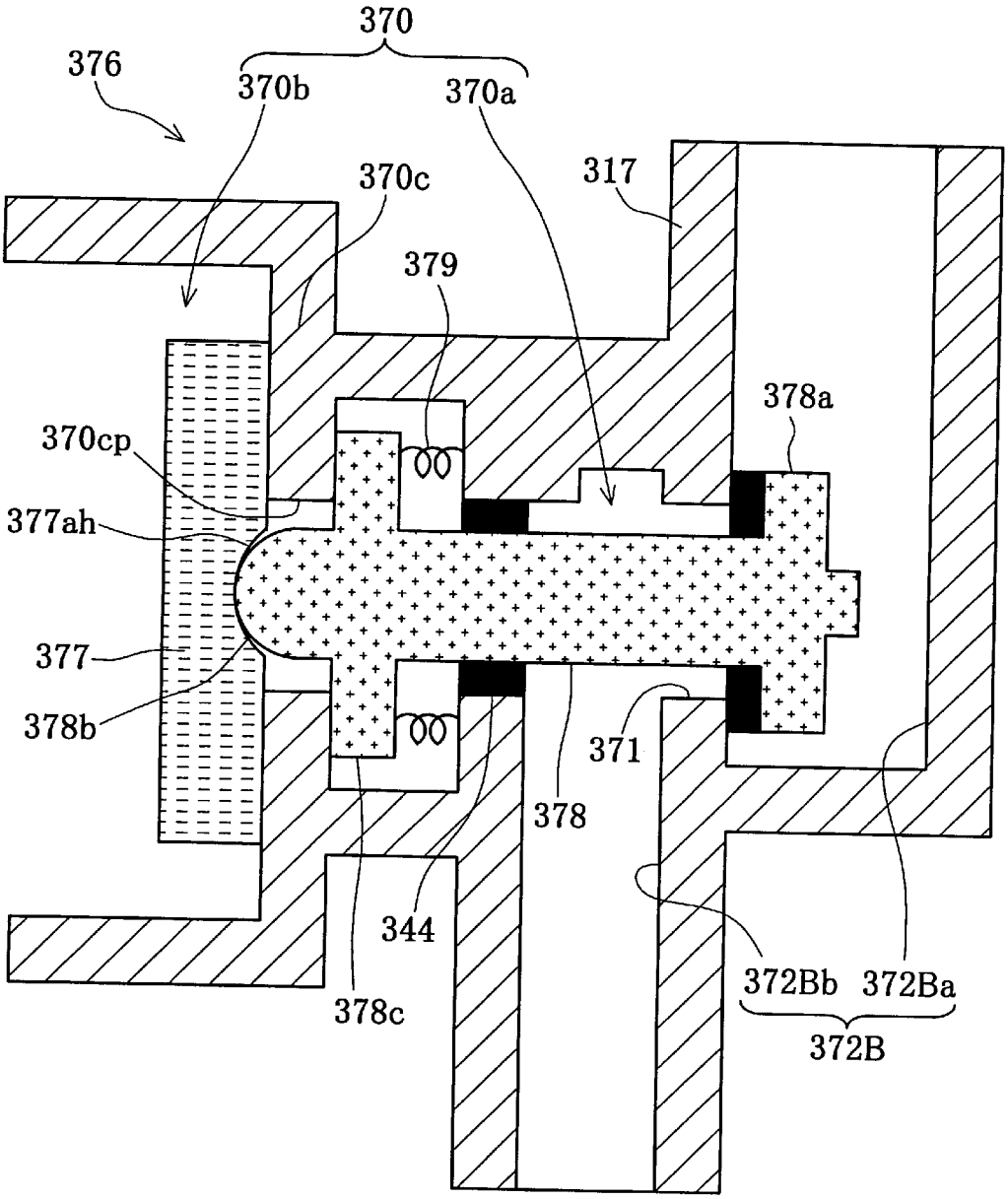
FIG. 30 is a cross section of the inside of a disk chamber 370*b* of the shutoff valve 376 along the S—S line in FIG. 29.

FIG. 27 is a simplified cross section of a flush valve 310 which is used in a fifth embodiment and allows the quantity of flushing water that passes to the secondary side to be varied between large and small. FIG. 28 is a detail cross section illustrating a shutoff valve mechanism 376, which makes up part of the above flush valve 310. FIG. 29 is a cross section of the shutoff valve mechanism 376 along the L—L line in FIG. 28. FIG. 30 is a cross section of the inside of a disk chamber 370*a* of the shutoff valve 376 along the S—S line in FIG. 29.

As shown in FIG. 27, the flush valve 310 has a valve unit 312 containing a valve body 320, and a control component 333. This flush valve 310 is provided in the tank holding area 5 in place of the flush valve 211 used in the fourth embodiment. In other words, a water supply port 314 of the valve unit 312 is connected to the constant flow valve 21 along the primary flow path, and a water discharge port 316 thereof is connected to the pipe 12 (the secondary flow path) via the vacuum breaker 212. The control component 333 is provided to the tank holding area 5 in place of the handle 221, the conversion mechanism 220, the valve opening knob 213, and so on in the fourth embodiment.

First, the mechanism related to opening and closing the valve body will be described. The control component 333 plays a part in this valve body opening and closing mechanism, and has an incoming water path 372A, an outgoing water path 372B, a shutoff valve mechanism 376, a handle 333*a*, a support rod 333*b*, and a return mechanism 333*c*.

On the inside of the valve unit 312, above the valve body 320 is a water chamber 322 in and out of which flows the primary-side flushing water. The incoming water path 372A is formed from the ceiling of this water chamber 322 all the way through to the top surface 312*b* thereof. One end of a linking pipe 317 having the outgoing water path 372B on its inside is connected by a nut 319*a* to the outlet of the incoming water path 372A located on the top surf ace 312*b*. The other end of this linking pipe 317 is connected by a nut 319*b* to a second water path 318*b*. The water chamber 322 communicates with the 318*b* by means of the incoming water path 372A and the outgoing water path 372B.

The shutoff valve mechanism 376 is provided at a point along the linking pipe 317. This shutoff valve mechanism 376 commences the flow of the water out of the water chamber 322 and into the second water path 318*b* when the handle 333*a* is operated. This lowers the internal pressure of the water chamber 322 and disrupts the pressure equilibrium on either side of the valve body, causing the valve body 320 to rise. As a result, the flush valve 310 opens, flushing water flows out directly from a first water path 318*a* side to the second water path 318*b* side, and operating flushing water is supplied to the jet pump 13. The jet flushing water discharge discussed above is performed along with this flushing water supply. Along with this valve opening action, the shutoff valve mechanism 376 stops the flow of water from the water chamber 322 to the second water path 318*b* after a specific time has elapsed after the operation of the handle 333*a*. Here, the shutoff valve mechanism 376 allows the time at which the flow of water from the water chamber 322 to the second water path 318*b* is stopped to be adjusted to two settings. This valve body opening and closing and the adjustment of the stop time will be discussed below.

The linking pipe 317 is formed as a pipe around the outside of the valve unit to afford communication between the water chamber 322 and the second water path 318*b*, but can also be formed integrally with the casing of the valve unit 312.

The following structure was employed in order to lower the valve body 320 once it has risen as above, and thereby close the flush valve 310. As shown in FIG. 27, a through hole 320*g* that goes from the top 320*c* to the wing 320*d* of the valve body 320 is provided to the valve body 320. This through hole 320*g* forms a water flow path that communicates between the first water path 318*a* and the water chamber 322. Specifically, the water that has flowed from the first water path 318*a* into a main water path 318*c* after the opening of the valve body 320 flows through this through hole 320*g* and into the water chamber 322. This raises the pressure inside the water chamber 322, and the valve body 320 descends and closes under this pressure. This interrupts the passage of flushing water from the first water path 318*a* side to the second water path 318*b* side, and completely stops the action of the jet pump 13, including the jetting of flushing water from the spray nozzle 131.

With this flush valve 310, the stoppage of flushing water passage to the second water path 318*b* side and in turn the stoppage of the operation of the jet pump 13 are adjusted with the above-mentioned shutoff valve mechanism 376. Accordingly, the shutoff valve mechanism 376 is structured as follows.

As shown in FIG. 28, a valve chamber 370 is formed integrally with the linking pipe 317 at a point along the linking pipe 317 from the water chamber 322. This valve chamber 370 consists of a stem chamber 370*a* and a disk chamber 370*b* that communicates with the stem chamber 370*a*. The stem chamber 370*a* contains a stem 378, and the disk chamber 370*b* contains a disk 377, the return mechanism 333*c*, and part of the support rod 333*b*.

A communicating hole 371 is formed in the stem chamber 370*a* so that the water that has flowed in from the water chamber 322 communicates with the second water path 318*b*. With this communicating hole 371 as a boundary, the outgoing water path 372B is divided into a first outgoing water path 372Ba that is upstream from the communicating hole 371, and a second outgoing water path 372Bb that is downstream from the valve chamber 370.

A washer 378*a*, which is part of the stem 378, is housed inside the first outgoing water path 372Ba over the communicating hole 371. In the state shown in FIG. 28, in which the shutoff valve mechanism 376 is closed, the washer 378*a*, which is tightly pressed against the inner wall of the first outgoing water path 372Ba, blocks off the communicating hole 371. When the stem 378 is in this state, water is prevented from flowing out of the first outgoing water path 372Ba and into the second outgoing water path 372Bb.

When the washer 378*a* moves away from the inner wall of the first outgoing water path 372Ba, so that there is a change from the closed state shown in FIG. 28 to a state in which the communicating hole 371 is open, a gap is formed between the communicating hole 371 and the stem 378. This puts the shutoff valve mechanism 376 in an open state, and the water in the first outgoing water path 372Ba, which had been held back by the stem 378, goes through this gap and moves into the stem chamber 370*a*, after which it flows through the second outgoing water path 372Bb and into the second water path 318*b*.

A protrusion 370*at* is formed in the stem chamber 370*a* by making part of the inner peripheral wall thereof protrude inward. An O-ring 344 of a specific thickness is embedded in the top 370*at*1 of this protrusion 370*at*, which is the side protruding furthest inward, and this O-ring 344 is in close contact with the outer periphery of the stem 378. This structure prevents the water that has entered the stem chamber 370*a* due to the opening of the shutoff valve mechanism 376 from entering the disk chamber 370*b*.

One end of a spring 379 is fastened to a side surface 370*at*2 on the disk chamber 370*b* side of the protrusion 370*at*. These springs 379 are fastened at four places on the side surface 370*at*2, although the mounting positions at only two of these places are shown in FIG. 28. These four springs 379 exert force in the disk chamber 370*b* direction, and the other ends of the springs 379 press on wide arms 378*c* formed in the vicinity of the distal end 378*b* of the stem 378.

The stem chamber 370*a* and the disk chamber 370*b* are separated by a partition 370*c*. As indicated by the broken line in FIG. 28, this partition 370*c* is provided with a hole 370*cp* that is larger in diameter than the distal end 378*b* of the stem 378. The location where this hole 370*cp* is provided will be discussed below. In the state shown in FIG. 28, in which the shutoff valve mechanism 376 is closed, the arms 378*c* are pressed on by the springs 379, which causes the stem 378 to be pressed against the partition 370*c*, and the distal end 378*b* to protrude into the disk chamber 370*b* over the hole 370*cp*.

The disk 377 is rotatably mounted to a side surface 370*d* on the disk chamber 370*b* side of the partition 370*c*. The support rod 333*b* linked to the handle 333*a* is mounted to the rotational center of this disk 377. As a result, the support rod 333*b* and the disk 377 rotate along with the handle 333*a*. Also, a return mechanism 333*c* containing a spring 333*d* is mounted to the support rod 333*b*. Therefore, once rotated, the support rod 333*b* and the disk 377 are returned to their pre-rotated state by the elastic force of the spring 333*d* built into the return mechanism 333*c*.

As shown in FIG. 29, the disk 377 is equipped with a large-diameter semicircular component 377*a* on the right half and with a small-diameter semicircular component 377*b* on the left half. This disk 377 rotates left and right around the center point O shown in FIG. 29. The center of the return mechanism 333*c* and the support rod 333*b* is this center point O.

As indicated by the broken line UR in FIG. 29, a recess 377*ah* of a specific depth is formed on the back of the semicircular component 377*a* at a location away from the center point O. The distal end 378*b* of the stem 378 protruding into the disk chamber 370*b* over the hole 370*cp* of the partition 370*c* goes into this recess 377*ah* as shown in FIG. 30.

As shown in FIG. 30, the distal end 378*b* of the stem 378 protrudes through the hole 370*cp* into the disk chamber 370*b* as a result of the arms 378*c* being biased toward the disk chamber 370*b* by the springs 379. This distal end 378*b* is kept in the recess 377*ah*. While the distal end 378*b* and the recess 377*ah* are in this positional relationship, the shutoff valve mechanism 376 is closed. The position of the disk 377 in this positional relationship will be referred to as the neutral position.

Figure 31:
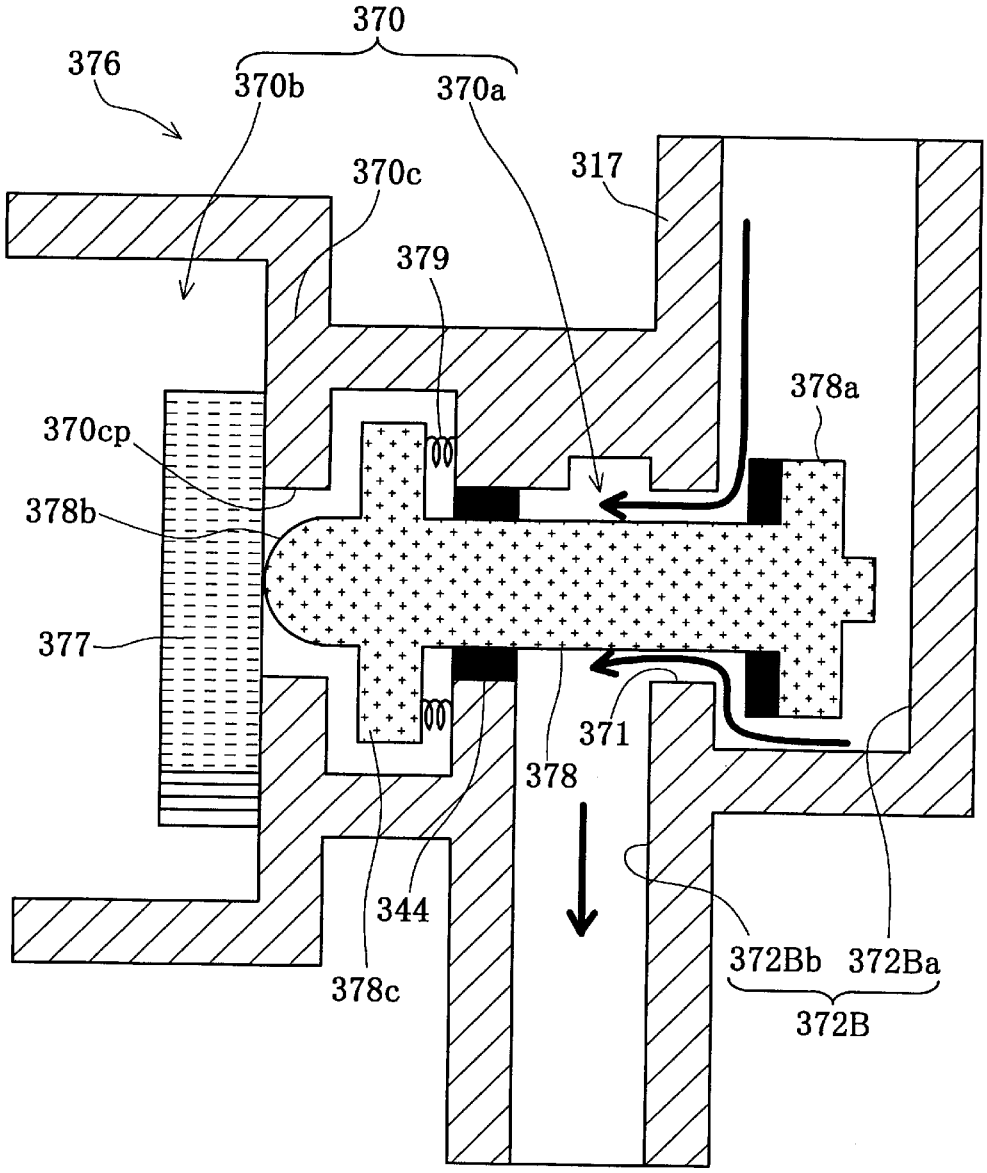
FIG. 31 is a diagram of the distal end 378*b* of a stem 378 when a handle 333*a* has been rotated from the state shown in FIG. 30 so that a disk 377 has been rotated from its neutral position.

FIG. 31 shows the distal end 378*b* of the stem 378 when the disk 377 has been rotated from the neutral position. We will assume here that the handle 333*a* has been rotated from the state shown in FIG. 30. The disk 377 is linked to this handle 333*a* via the support rod 333*b* (see FIG. 28), and therefore rotates along with the handle. As a result, the semicircular component 377*a* moves in the direction of handle rotation away from the hole 370*cp*, and the flat back of the disk 377 covers the hole 370*cp* as shown in FIG. 31. Accordingly, the distal end 378*b*, which had been protruding into the disk chamber 370*b* through the hole 370*cp* before the handle was operated, is pushed by the flat back of the disk 377, and is pushed down toward the stem chamber 370*a* against the biasing force of the springs 379. This causes the washer 378*a* to separate from the inner wall of the first outgoing water path 372Ba, forming a gap between the communicating hole 371 and the stem 378 as shown in FIG. 31. This puts the shutoff valve mechanism 376 in an open state, and the water inside the first outgoing water path 372Ba is able to flow into the second outgoing water path 372Bb as indicated by the arrows in the figure.

The description will now return to FIG. 29. Two protrusions 381*a* and 381*b* rising to a specific height from the side surface 370*d* are provided on the side surface 370*d* off to the semicircular component 377*b* side of the center point O. The protrusions 381*a* and 381*b* are provided a specific distance away from upper and lower end surfaces 377*au* and 377*ad*, both along the rotational locus of the semicircular component 377*a*. The distance away from these end surfaces 377*au* and 377*ad* is different for the protrusion 381*a* and the protrusion 381*b*. Specifically, as shown in FIG. 29, the angle θ1, formed by the line segment P—P connecting the center point O to the lower end surface 377*ad* and the line segment Q—Q connecting the center point O to the upper end surface 377*au*, is approximately 450, while the angle θ2, formed by the line segment P—P connecting the center point O to the upper end surface 377*au* and the line segment Q—Q connecting the center point O to the protrusion 381*b*, is approximately 30°. Therefore, the disk 377 rotates approximately 45° clockwise from the neutral position, and rotates approximately 30° counter-clockwise from the neutral position. Any further rotation is prevented by collision between the end surfaces 377*ad* and 377*au* and the protrusions 381*a* and 381*b*.

Numerous teeth are formed around the outer periphery of the semicircular component 377*a* of the disk 377. Some of these numerous teeth mesh with teeth formed on the side surface of a hydraulic rotation component 380*c* of an oil damper 380. The disk 377 slowly rotates under the hydraulic control of the hydraulic rotation component 380*c* while the teeth of the two are meshed. Therefore, when the handle 333*a* is operated, a constant resistance is imparted to the rotation of the disk 377 by the hydraulic pressure of the hydraulic rotation component 380*c*. This gives the user appropriate tactile feedback. Even after the user's hand is removed from the handle 333*a* after the handle 333*a* has been operated, a constant resistance is imparted to the rotation of the disk 377 provided by the action of the return mechanism 333*c*. The result is that the disk 377 returns slowly to its original position.

Figure 32:
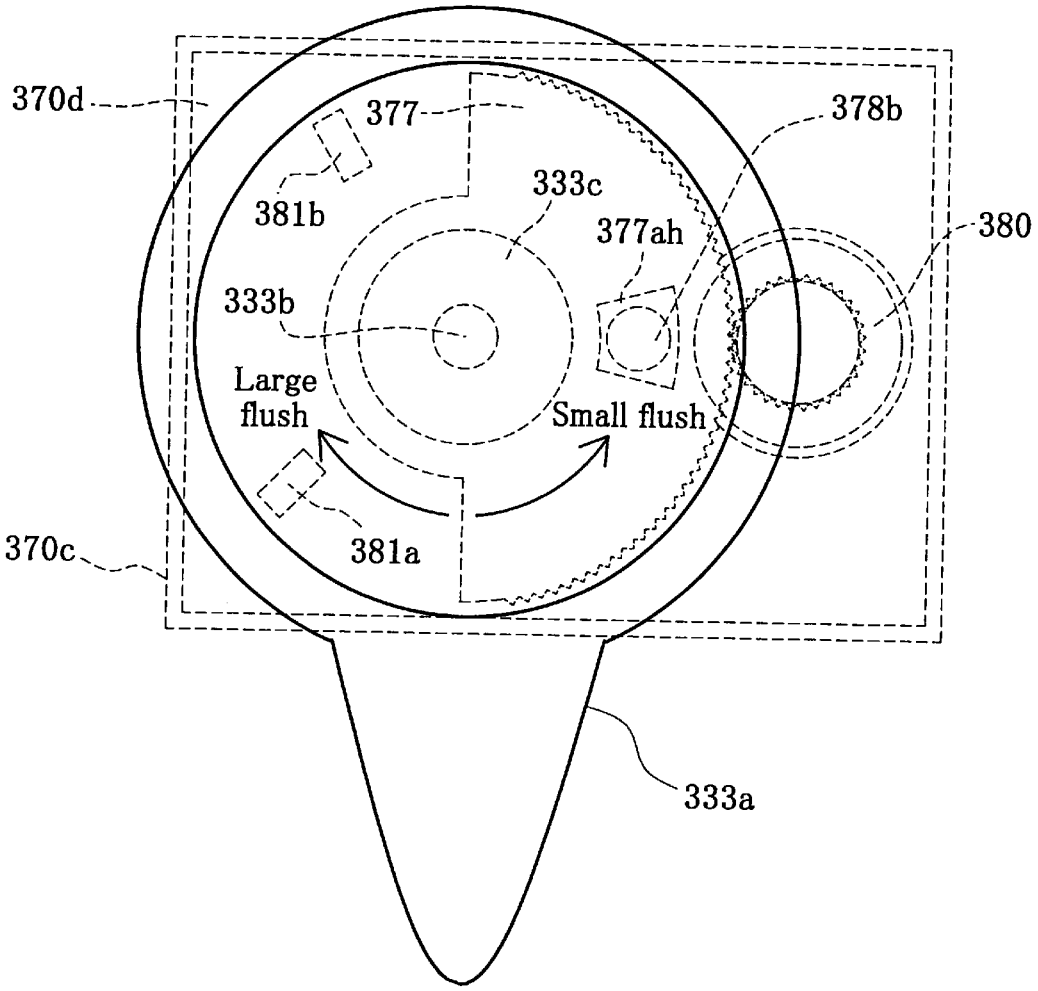
FIG. 32 is a diagram illustrating the positional relation between the disk 377 and the handle 333*a;*

FIG. 32 is a diagram illustrating the positional relation between the disk 377 and the handle 333*a*. As shown in this figure, when the disk 377 is in the above-mentioned neutral position, the handle 333*a* is in the neutral location shown in the figure. When the handle 333*a* in this neutral location is rotated in the direction of a large flush (clockwise), the handle 333*a* and the disk 377 rotate only approximately 45° because they are restricted by the protrusion 381*a*. When the handle is rotated in the direction of a small flush (counter-clockwise), the handle 333*a* and the disk 377 rotate only approximately 30° because they are restricted by the protrusion 381*b*. After this, the return mechanism 333*c* is actuated when the user's hand is removed from the handle 333*a*, but the handle 333*a* and the disk 377 in this case return to the neutral location at the same speed for both large and small flushes due to the action of the oil damper 380.

The above-mentioned valve chamber 370 may be provided as a separate member from the linking pipe 317, and may be mounted by a nut or the like to the linking pipe 317. If so, it will be possible to replace the entire stem chamber 370*a* or disk chamber 370*b* if the washer 378*a* of the stem 378, the O-ring 344, or the disk 377 should wear out, which facilitates the work entailed by this replacement.

Figure 33:
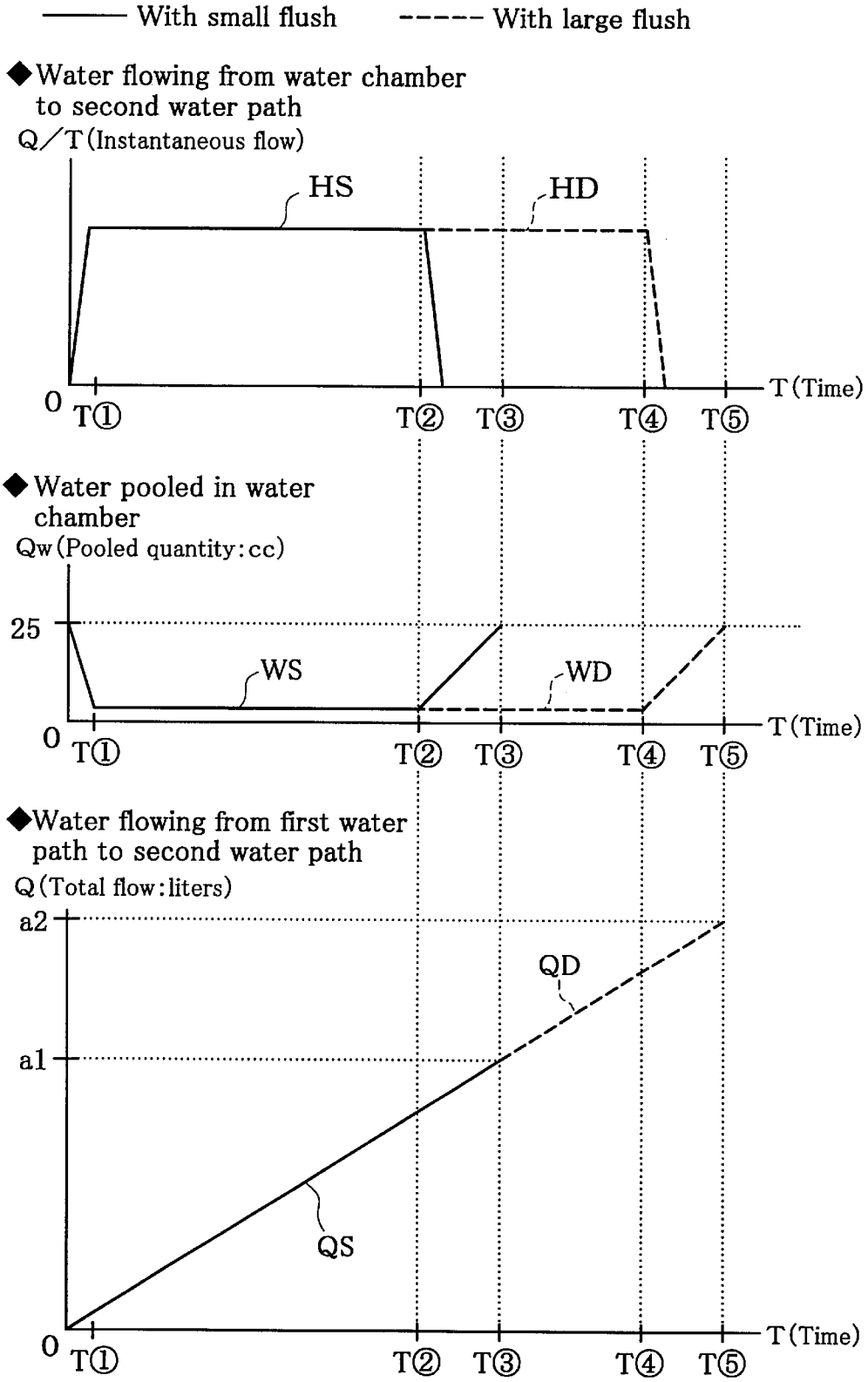
FIG. 33 consists of graphs of the relation between the open period of a valve 320 and the period of flow from a water chamber 322 to a second water path 318*b;*

Next to be described will be the passage of flushing water through the flush valve 310 structured as above, that is, the supply of flushing water to the spray nozzle 131 of the jet pump 13 (hereinafter referred to as operating flushing water supply). With this flush valve 310, a different amount of operating flushing water is supplied for a large and for a small flush, which is accomplished by varying the duration the valve body 320 is open, that is, the period during which the water in the water chamber 322 flows into the second water path 318*b* after handle operation (hereinafter referred to as water chamber flushing water out-flow period), for a large flush and a small flush. FIG. 33 consists of graphs of the relation between the open period of the valve 320 and the out-flow period from a water chamber 322 to the second water path 318*b*.

The top graph in FIG. 33 shows the relation between the out-flow period from the water chamber 322 to the second water path 318*b* and the instantaneous flow of water that flows out. The instantaneous flow from the water chamber 322 to the second water path 318*b* is substantially the same with a large flush (polygonal line HD) and with a small flush (polygonal line HS). This is because when the shutoff valve mechanism 376 is open, the size of the gap formed between the communicating hole 371 and the stem 378 is the same for both a large flush and a small flush.

Meanwhile, the out-flow period from the water chamber 322 to the second water path 318*b* is shorter for a small flush (until time $\hat{T2}$has elapsed) than for a large flush (until time $\hat{T4}$ has elapsed). Specifically, as shown in FIGS. 29 and 32, in the case of a small flush, the rotation of the disk 377 that accompanies handle operation is approximately 150 less than with a large flush. Meanwhile, the handle 333*a* and the disk 377 attempt to return to the neutral side at the same speed for both a large and a small flush due to the action of the oil damper 380. Accordingly, they will return to the neutral position sooner with a small flush, in which case the rotational angle of the disk 377 is smaller. Therefore, with a small flush, the distal end 378*b* of the stem 378 enters the recess 377*ah* in a shorter time, and the communicating hole 371 is blocked off by the washer 378*a* of the stem 378 in a shorter time. As a result, the period during which the flow of water from the first outgoing water path 372Ba to the second outgoing water path 372Bb is permitted is shorter in the case of a small flush. Thus, the water chamber flushing water out-flow period is shorter during a small flush, and the shutoff valve mechanism 376 closes in a shorter time.

When water is no longer able to flow from the water chamber 322 to the second water path 318*b*, it begins to pool in the water chamber 322. Therefore, as shown by the middle graph in FIG. 33, the water sent from the first water path 318*a* through the through hole 320*g* to refill the water chamber 322 after the handle has been operated and the valve body 320 opened begins to pool in the water chamber 322 after time $\hat{T2}$ has elapsed in the case of a small flush (see polygonal line WS) and after time $\hat{T4}$ has elapsed in the case of a large flush (see polygonal line WD). Since the water from the first water path 318*a* flows through the through hole 320*g* and into the water chamber, the instantaneous flow of water into the water chamber 322 is the same for both a large and a small flush. Accordingly, whether the flush is large or small, the water chamber 322 will be full when the same amount of time has elapsed since the water began pooling in the water chamber 322. Therefore, as shown in the middle graph in FIG. 33, the water chamber 322 is full sooner after the start of the flush with a small flush (when time $\hat{T3}$ has elapsed), and will be full later with a large flush than with a small flush (when time $\hat{T5}$ has elapsed).

In other words, as shown in the bottom graph in FIG. 33, the open duration of the valve body 320 in the case of a small flush (between 0 and $\hat{T3}$) is shorter than the open duration in the case of a small flush (between 0 and $\hat{T5}$ ). As a result, the total quantity of water supplied from the first water path 318*a* to the second water path 318*b*, that is, the above-mentioned operating flushing water supply, is less with a small flush and greater with a large flush. These operating flushing water supplies a1 and a2 for large and small flushes are determined by taking into account the toilet bowl size, stop valve branch pipe diameter, pump specifications, and other such design parameters at the toilet design stage so that the total quantity of flushing water used to flush the toilet will be approximately 6 liters for a large flush and approximately 4 liters for a small flush.

With the fifth embodiment, in which the flush valve 310 described above is used for the operating flushing water supply of the jet pump 13, the total quantity of flushing water for a large or small flush can be set to large or small according to how the toilet is used by varying the operating flushing water supply quantity for a large or small flush.

With this flush valve 310, the operating flushing water supply is set to large or small by adjusting the above-mentioned open duration of the valve body 320, and this open duration is adjusted by means of a mechanically driven shutoff valve mechanism 376 as described above. More specifically, the time it takes for the disk 377 to return to the neutral position it was in before handle operation is varied by changing the rotational angle of the disk 377 that accompanies this handle rotation between a large flush and a small flush. Therefore, a flush toilet that can be flushed with a total amount of flushing water corresponding to either defecation or urination can be installed even where there is no electrical power, which makes the toilet more versatile.

A sixth embodiment will now be described. This sixth embodiment is characterized in that, in setting the total amount of flushing water used for a toilet flush in the manufacture of the toilet, one of a plurality of available flushing water quantity settings (total flushing water quantities) is specified. The flush toilet in this sixth embodiment can have a configuration in which the jet pump 13 is submerged as in the first embodiment. In this case, the toilet is flushed with flushing water of the specified flushing water quantity. Also, the sixth embodiment can employ the same configuration as in the above-mentioned fourth embodiment, in which the flushing water quantity was set to large or small for a large or small flush. If so, then the toilet will be flushed with flushing water of the specified flushing water quantity during a large flush, and will be flushed with a quantity of flushing water smaller than this specified flushing water quantity during a small flush.

Figure 36:
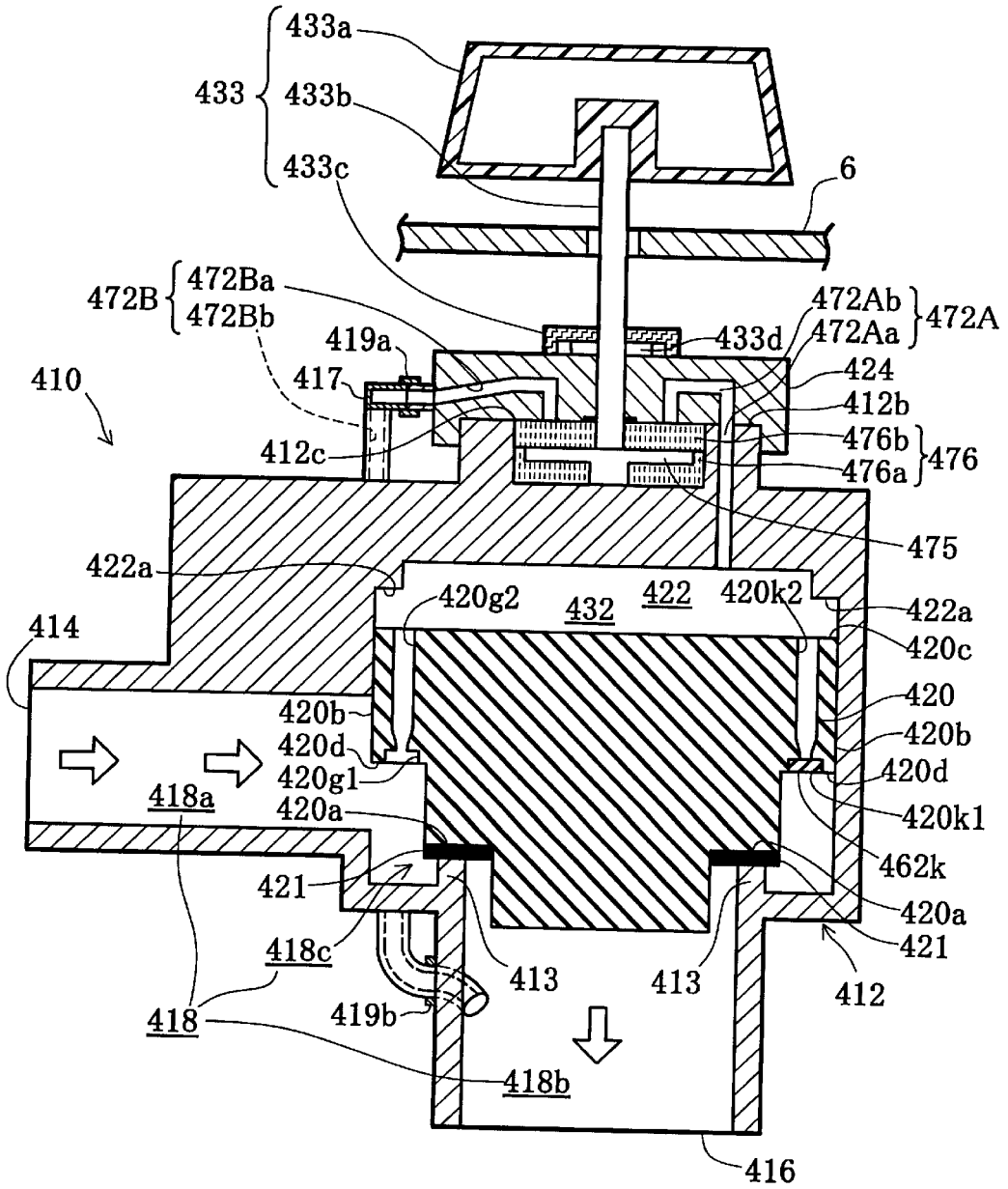
FIG. 36 is a simplified cross section of a flush valve 410 which is used in a sixth embodiment and allows the quantity of flushing water that passes to the secondary side to be set to one of a plurality of flushing water quantity settings (total flushing water quantity)

FIG. 36 is a simplified cross section of a flush valve 410 which is used in the sixth embodiment and allows the quantity of flushing water that passes to the secondary side to be set to one of a plurality of flushing water quantity settings (total flushing water quantity). FIG. 37 consists of diagrams of the top and bottom of a valve 420 had by the flush valve 410. FIG. 38 is a diagram illustrating the bottom of the valve 420 when a selection member 462 has been fitted to the valve 420.

As shown in FIG. 36, the flush valve 410 has a valve body 420 contained in a valve unit 412, and a control component 433 for opening the valve protrudes from the valve unit 412. This flush valve 410 is installed in the tank holding area 5 in place of the flush valve 11 in the first embodiment or the flush valve 211 in the fourth embodiment. In other words, a water supply port 414 of the valve unit 412 is connected to an upstream primary flow path, and a water discharge port 416 is connected to the pipe 12, which is a secondary flow path downstream. The control component 433 is provided to the tank holding area 5 in place of the handle 221, conversion mechanism 220, valve opening knob 213, and so forth used for opening the valve in the fourth embodiment.

The control component 433 has a handle 433*a* located to the outside of the lid 6 and supported by a support rod 433*b*. The lid 6 comes off for maintenance work or the like, and the handle 433*a* is detachable from the support rod 433*b* so as not to get in the way of this removal of the lid 6. The handle 433*a* can also be disposed at the side of the tank holding area 5.

When the handle 433*a* is rotated, the support rod 433*b* rotates integrally with this handle, and an upper disk 476*b* fitted and fixed at the lower end of the support rod is rotated. As it rotates along with the operation of the handle, the support rod 433*b* receives the elastic force of a flat spring 433*d* built into a return mechanism 433*c*, and attempts to return to its prerotation state.

Inside the valve unit 412, above the valve body 420 is a water chamber 422 in and out of which flows the primary-side flushing water. This valve body 420 is equipped around its outer edge with eight through holes 420*g*2 to 420*n*2 that go from the top 420*c* to a wing 420*d*. With the flush valve 410 in the sixth embodiment, these through holes 420*g*2 to 420*n*2 function as a flow path for the water that refills the water chamber 422 from a first water path 418*a* after the valve body 420 has opened. Specifically, they function as a communicating flow path 432.

Figure 37A:
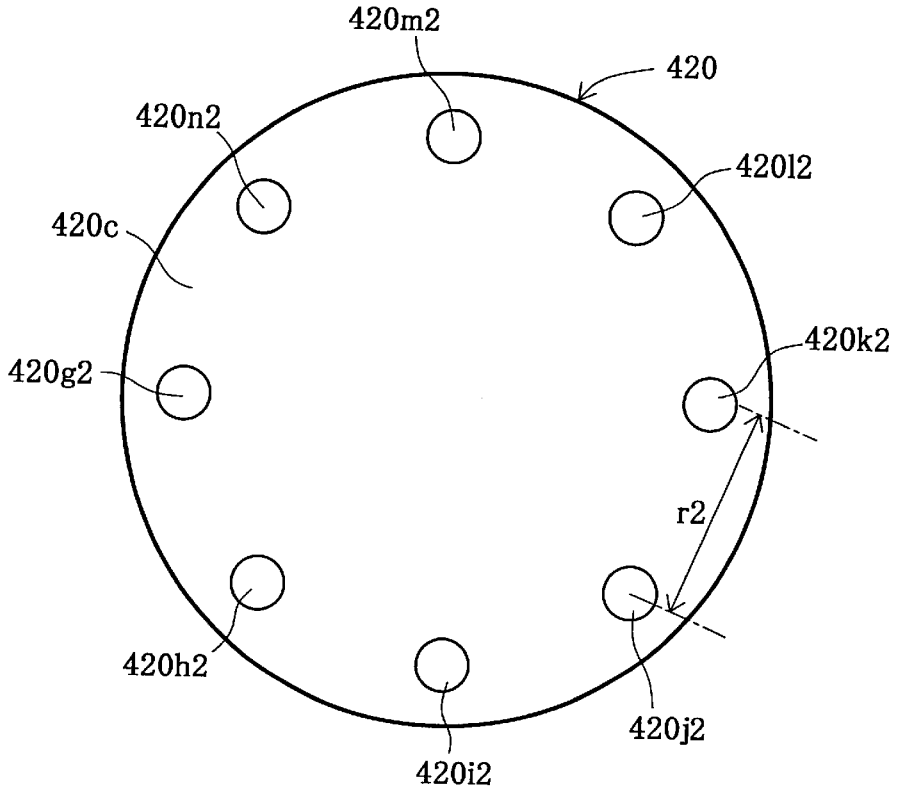
FIG. 37 consists of diagrams of the top and bottom of a valve 420 had by the flush valve 410.
Figure 37B:
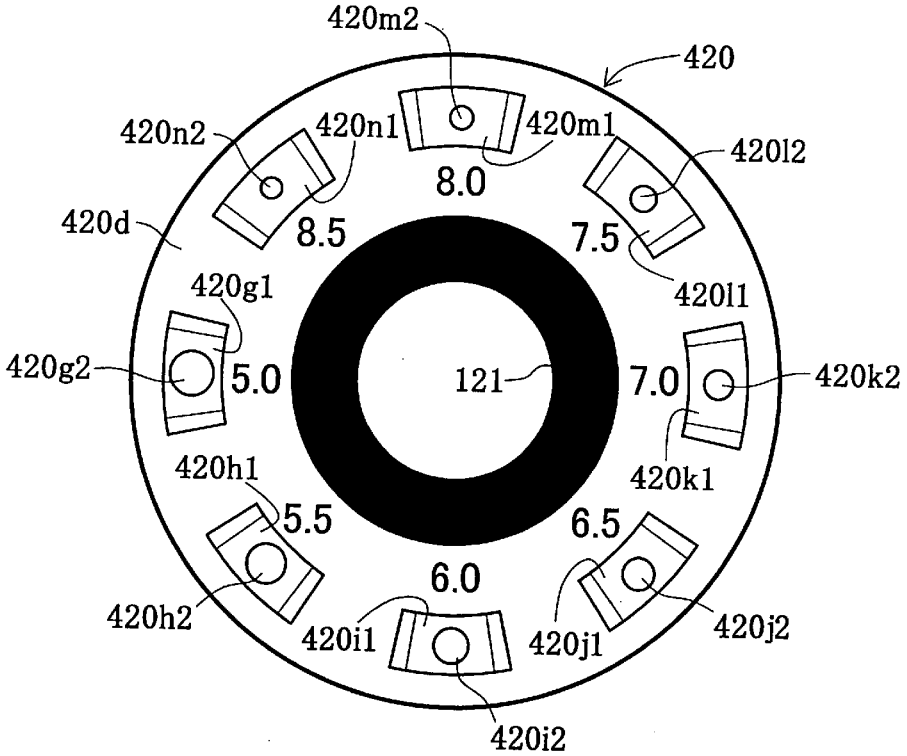
Figure 38:
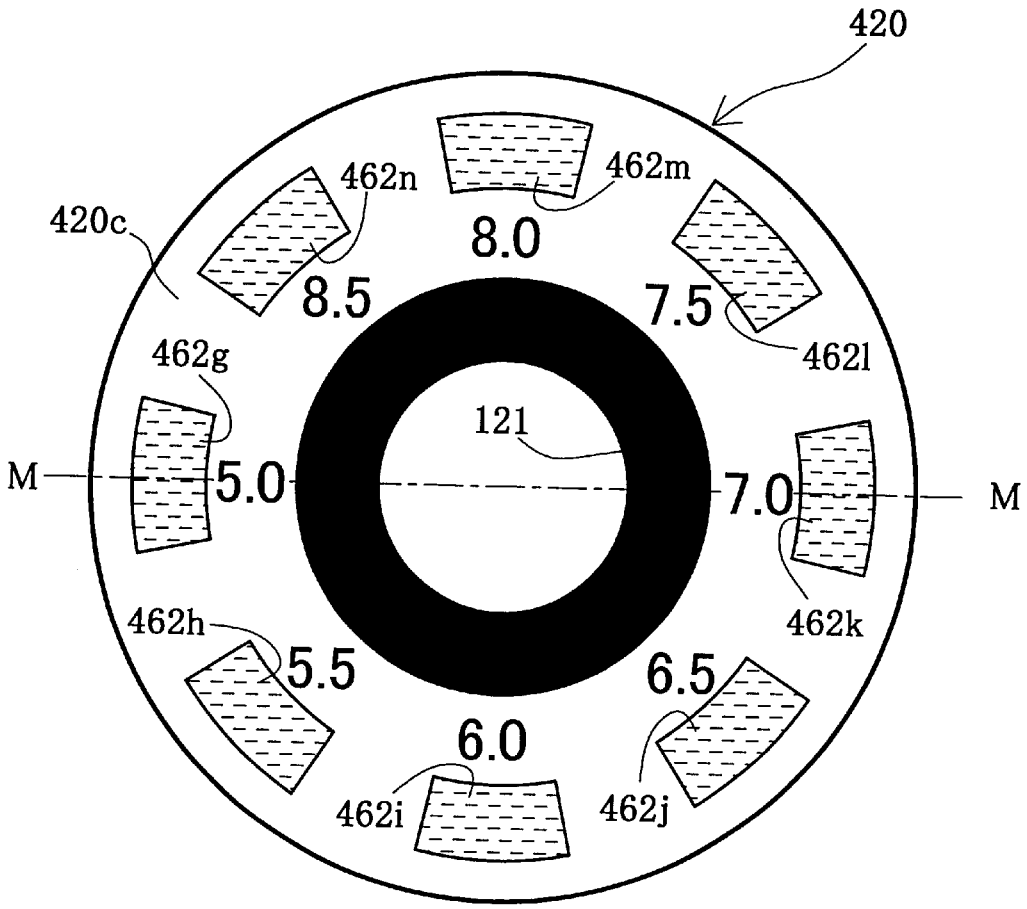
FIG. 38 is a diagram illustrating the bottom of the valve 420 when a selection member 462 has been fitted to the valve 420.

As shown in FIGS. 37(A) and 37(B), the eight through holes 420*g*2 to 420*n*2 that go through the valve body 420 are substantially circular holes provided at an equal pitch slightly to the inside of the outer periphery of the valve body 420. As shown in FIG. 37(A), the inside diameter of the outlets of the through holes 420*g*2 to 420*n*2 located on the top 420*c* is the same as that of the through holes 420*g*2 to 420*n*2, which is approximately 1.5 mm. On the other hand, as shown in FIG. 37(B), the outlets of the through holes 420*g*2 to 420*n*2 are located at the bottom of recesses 420*g*1 to 420*n*1 formed on the wing 420*d*, and the inside diameter of the outlets of these through holes 420*g*2 to 420*n*2 is different for each of the through holes 420*g*2 to 420*n*2. In specific terms, the inside diameter of the through hole 420*g*2 is approximately 1.2 mm, the inside diameter of the through hole 420*h*2 is approximately 1.1 mm, the inside diameter of the through hole 420*i*2 is approximately 1.0 mm, the inside diameter of the through hole 420*j*2 is approximately 0.9 mm, the inside diameter of the through hole 420*k*2 is approximately 0.8 mm, the inside diameter of the through hole 42012 is approximately 0.7 mm, the inside diameter of the through hole 420*m*2 is approximately 0.6 mm, and the inside diameter of the through hole 420*n*2 is approximately 0.5 mm.

As shown in FIGS. 37(B) and 36, the recesses 420*g*1 to 420*n*1 of a specific depth are provided to the wing 420*d* of the valve body 420. The inlets to the through holes 420*g*2 to 420*n*2 are formed in the bottom of the recesses 420*g*1 to 420*n*1, which are formed in a larger cross sectional area than these inlets.

Let us return to FIG. 36 for a description of the cross sectional shape of the recesses 420*g*1 to 420*n*1 and the through holes 420*g*2 to 420*n*2 that communicate with these recesses 420*g*1 to 420*n*1. As shown in FIG. 36, the recesses 420*g*1 and 420*k*1 are provided to the wing 420*d*. The through holes 420*g*2 and 420*k*2, which go from the bottom of the recesses 420*g*1 and 420*k*1 to the top 420*c*, are formed above these recesses 420*g*1 and 420*k*1. The cross sectional area of these through holes 420*g*2 and 420*k*2 is smallest at the inlets located at the bottom of the recesses 420*g*1 and 420*k*1. From there, the cross sectional area of the gk2 steadily increases from the inlets toward the top 420*c*, and the cross sectional area is substantially the same from the middle of the gk2 all the way to the outlets on the top 420*c*. The cross sectional area of the other through holes 420*h*2 to 420*j*2 and 42012 to 420*n*2, which are not shown in FIG. 36, is also smallest at the inlets, increases from these inlets, and is substantially the same from the middle of the through holes 420*h*2 to 420*j*2 and 42012 to 420*n*2 all the way to the outlets on the top 420*c*, just as with the through holes 420*g*2 and 420*k*2.

The description will now return to FIG. 37. As shown in FIG. 37(A), the eight through holes 420*g*2 to 420*n*2 are disposed so that the distance 2r between the centers of adjacent holes is substantially constant. Also, as shown in FIG. 37(B), the through holes 420*g*2 to 420*n*2 are disposed along the outer periphery of the valve body 420 in the order of through hole 420*n*2, through hole 420*m*2, through hole 42012, through hole 420*k*2, through hole 420*j*2, through hole 420*i*2, through hole 420*h*2, and through hole 420*g*2, clockwise when viewed from the bottom. In other words, the eight holes are disposed continuously clockwise in the order of the size of the hole surface area at the inlet.

As shown in FIG. 37(B), the recesses 420*g*1 to 420*n*1 are formed in substantially the same shape. As shown in FIG. 38, selection members 462 consisting of eight coverings 462*g* to 462*n* are fitted into these recesses 420*g*1 to 420*n*1. The valve body 420 is used in a state in which one of the eight coverings 462*g* to 462*n* is not mounted in the recesses 420*g*1 to 420*n*1. In FIG. 36, a valve body 420 in which the covering 462*g* is not mounted in the recess 420*g*1 is illustrated as a cross section along the M—M line in FIG. 38.

The eight coverings 462*g* to 462*n* are formed in the same shape using elastic pieces slightly larger than the recesses

420*g*1 to 420*n*1. These elastic pieces can be made from an elastic resin, rubber, or the like. Accordingly, when the coverings 462*g* to 462*n* are fitted into the recesses 420*g*1 to 420*n*1, the coverings 462*g* to 462*n* press against the inner walls of the recesses 420*g*1 to 420*n*1 because of the elastic force thereof. As a result, the through holes 420*g*2 to 420*n*2 prevent the passage of water.

It is also possible for the coverings 462*g* to 462*n* fitted into the recesses 420*g*1 to 420*n*1 to be removed later. Specifically, the tip of a screwdriver may be inserted in between the recesses 420*g*1 to 420*n*1 and the coverings 462*g* to 462*n*, and the tip of the screwdriver used to squeeze the coverings 462*g* to 462*n* and pry them up and out.

As shown in FIGS. 38 and 37(B), different numbers for each location of the recesses 420*g*1 to 420*n*1 are transferred in the vicinity of the recesses 420*g*1 to 420*n*1 on the wing 420*d*. These numbers indicate the total quantity (total flow Q) of water supplied from the first water path 418*a* to a second water path 418*b* when the coverings 462*g* to 462*n* are not mounted in one of the recesses 420*g*1 to 420*n*1. This total flow Q will be discussed below.

How the valve opens and how it closes for water chamber refilling will be described for the flush valve 410 of the sixth embodiment structured as above. The components that contribute to opening the valve body 420 in the flush valve 410 are the control component 433, a second shutoff valve mechanism 476 consisting of the upper disk 476*b* and a lower disk 476*a*, an incoming water path 472A consisting of through passages 472Aa and 472Ab from the water chamber 422 to the disk chamber, and an outgoing water path 472B consisting of through passages 472Ba and 472Bb from the water chamber to the water discharge port 416.

Specifically, when the valve body 420 is in the open state shown in FIG. 36, the water (operating water) that has flowed from the water supply port 414 is held back by the closed valve body 420. In this state, water fills the first water path 418*a* and the water chamber 422. When the handle 433*a* is then rotated to flush the toilet, the support rod 433*b* and the upper disk 476*b* at the lower end thereof rotate in the direction the handle was rotated. This rotation of the upper disk 476*b* puts the incoming water path 472A and the outgoing water path 472B in a communicating state. More specifically, the upper disk 476*b* is equipped with two through holes symmetrically disposed around its rotational axis, one of which is made by rotation of the disk to communicate with both the through passage 472Ab of the incoming water path 472A and a groove 475 in the lower disk 476*a*. The other through hole in the upper disk 476*b* is made to communicate with both the through passage 472Ba of the outgoing water path 472B and the groove 475 in the lower disk 476*a*. As a result, the incoming water path 472A and the outgoing water path 472B communicate via the groove 475, so the water in the line of the incoming water path 472A and the water in the water chamber 422 flow through the upper disk 476*b* and the lower disk 476*a* and into the outgoing water path 472B, which is open to the atmosphere, after which the water flows through the inside of a communicating pipe 417 and into the second water path 418*b*. The result is that the valve body 420 rises toward the water chamber 422 and opens.

The water pooled in the water chamber 422 and the incoming water path 472A instantly flows into the outgoing water path 472B due to the pressure differential between the water chamber 422 and the outgoing water path 472B. Meanwhile, the action of the return mechanism 433*c* causes the rotated handle 433*a* and support rod 433*b* to return to their original positions prior to rotation (shown in FIG. 36). Along with this, the upper disk 476*b*, which is integral with the support rod 433*b*, also returns to its original position. Consequently, communication is cut off between the incoming water path 472A and the outgoing water path 472B via the through holes in the upper disk 476*b* and the groove 475 in the lower disk 476*a*. Therefore, after this, water refills the water chamber 422 through the through hole 420*g*2, in which the covering 462*g* is not mounted. In this case, the water that refills the water chamber 422 also goes into the incoming water path 472A, but is blocked by the upper surface of the upper disk 476*b*. As a result, water is prevented from advancing to the outgoing water path 472B or the lower disk 476*a* upon completion of the flush commencement operation.

The open valve body 420 is closed as follows by the water that refills the water chamber 422. When the valve body 420 opens and water is supplied from the first water path 418*a* to the second water path 418*b*, a large quantity of water flows underneath the raised valve body 420. Accordingly, the first water path 418*a* and a main water path 418*c* are substantially full, with water pressing against the wing 420*d* of the valve body 420. This causes part of the water supplied from the first water path 418*a* to the second water path 418*b* to flow through the through hole 420*g*2 and into the water chamber 422 due to water pressure (supply pressure; primary pressure), so the water chamber 422 is refilled with water. As a result of this refilling of the water chamber 422 with water, the valve body 420 gradually descends, and when the water chamber 422 is substantially full, the valve body 420 closes.

With the flush valve 410 in the sixth embodiment structured as above, the open duration of the valve body 420 is adjusted to one of a plurality of preset times. In this sixth embodiment, this adjustment of the open duration is accomplished by refilling the water chamber 422 with different quantities of water per unit of time after the handle 433*a* has been operated (hereinafter referred to as the instantaneous flow to the water chamber 422).

This adjustment of open duration is accomplished with a non-electrical structure, namely, the eight through holes 420*g*2 to 420*n*2 with varying inlet diameters and the coverings 462*g* to 462*n* that cover these through holes 420*g*2 to 420*n*2. More specifically, this is accomplished by varying whether the coverings 462*g* to 462*n* are attached or not, and thereby changing the opening surface area of the through holes 420*g*2 to 420*n*2 through which water passes while refilling the water chamber 422 from the first water path 418*a*.

FIG. 39 is a diagram of the relation between the inside diameter D2 of the inlets of the through holes 420*g*2 to 420*n*2 and the total flow Q of the flushing water used to flush the toilet. In this embodiment, operating water is supplied to the jet pump 13 from the flush valve, and the toilet is flushed with flushing water discharged from this jet pump 13 as discussed above. Thus, the quantity of water (operating water) supplied by the flush valve 410 from the first water path 418*a* to the second water path 418*b* is set in relation to the total quantity Q for flushing the toilet so that this total quantity Q will be obtained. With the sixth embodiment, the larger is the inside diameter D2 of the inlets of the through holes 420*g*2 to 420*n*2 of the valve body 420 (put another way, the larger is the opening surface area), the greater is the instantaneous flow to the water chamber 422 and the shorter is the duration that valve body 420 is open, so a smaller amount of flushing water flows from the first water path 418*a* to the second water path 418*b* (that is, a smaller amount of operating water is supplied to the jet pump 13). In view of this, as shown in FIG. 39, the above-mentioned total quantity Q is predetermined as dictated by the opening surface area of the inlets of the through holes 420*g*2 to 420*n*2.

In specific terms, when the water from the first water path 418*a* flows into the water chamber 422 through the through hole 420*g*2 (inside diameter approximately 1.2 mm), the open duration of the valve body 420 is shorter because the through hole inside diameter is larger. Accordingly, the total quantity Q of flushing water (water for flushing the toilet) accompanying the supply of operating water to the jet pump 13 and the jet pump discharge while the valve is open is only about 5 liters. With the other through holes, the total quantity Q is as given in the figure. These numbers are the same as those transferred onto the wing 420*d* in FIGS. 37(B) and 38.

With the sixth embodiment, in which the flush valve 410 described above is used to supply operating water to the jet pump 13, in the manufacture of the toilet, the open duration of the valve body 420 can be specified from among a variety of options by suitably selecting one of the through holes 420*g*2 to 420*n*2 of various cross sectional areas of the valve body 420 for supplying water to the water chamber. The quantity of flushing water supplied from the flush valve (total quantity Q) is adjustable through this specification of the open duration. As a result, a flush toilet that is flushed with a quantity of flushing water suited to the waterworks situation where the toilet is installed, to the legal restrictions where it is installed, and so forth can be provided by the simple means of using the through holes 420*g* 2 to 420*n*2 as needed.

This flush valve 410 in the sixth embodiment comprises coverings 462*g* to 462*n* for blocking off the through holes 420*g*2 to 420*n*2, and these coverings 462*g* to 462*n* are detachable. Therefore, the user can select the desired discharge quantity by changing which of the coverings 462*g* to 462*n* is detached.

Also, with the flush valve 410, the quantity of water discharged when the coverings 462*g* to 462*n* are removed from the through holes 420*g*2 to 420*n*2 (the total quantity Q of water used to flush the toilet) is displayed near the through holes 420*g*2 to 420*n*2. Therefore, the desired discharge quantity can be selected easily and reliably. Furthermore, the discharge quantity (the above-mentioned total quantity Q) may also be distinguished by a method other than that given above. For instance, the quantity of water discharged when the coverings 462*g* to 462*n* are removed from the through holes 420*g*2 to 420*n*2 can be displayed on the coverings 462*g* to 462*n*. Varying the colors of the coverings 462*g* to 462*n* according to the locales where the flush valve 410 will be used is also favorable.

Embodiments of the present invention were given above, but the present invention is not limited in any way to the above embodiments or embodiments, and it should go without saying that various modifications are possible within the essence of the present invention.

For example, the various variation embodiments given in the first to third embodiments can also be applied to the forth, fifth, or sixth embodiment.

Also, the spray nozzle 131 may be one in which the through flow path 131*h* in the middle is closed off. Alternatively, the spray nozzle 131 may be one with a simple nozzle shape that merely jets the flushing water in a columnar form.

INDUSTRIAL APPLICABILITY

In a flushing water supply device having a tank that reserves flushing water to be supplied to a supply destination, or a flush toilet in which the supply destination is the toilet, there is greater freedom in how the flushing water is stored, and an effective increase in the flushing water discharge flow is achieved.

What is claimed is:

1. A flush toilet, which flushes a toilet bowl with flushing water, comprising:

a toilet flushing tank device having a flushing water tank that reserves flushing water; and a supply line that is arranged to introduce flushing water from said toilet flushing tank device into the toilet bowl and has openings at both end of said supply line, the toilet flushing tank device including:

a jet pump having a spray nozzle and a throat disposed across from said nozzle; and a nozzle water supply unit for supplying operating water to the spray nozzle and jetting the operating water from the spray nozzle into the throat, the throat being connected to one end of the supply line so that the flushing water jetted from the throat flows into the supply line, the jet pump being disposed submerged in the flushing water tank so that the flushing water in the flushing water tank flows into the throat along with the jetting of the flushing water from the spray nozzle.

2. The flush toilet according to claim 1, wherein the nozzle water supply unit supplies the operating water so that the flushing water jetted from the throat will be continuously gushed upward beyond a predetermined full level of the flushing water tank throughout the toilet flushing period.

3. The flush toilet according to claim 1, wherein the supply line has a line route that passes through a location higher than the full level, and has a line terminal at a location higher than the full level.

4. The flush toilet according to claim 1, wherein the nozzle water supply unit has a backflow check valve for preventing backflow of the flushing water from the spray nozzle side.

5. The flush toilet according to claim 1, wherein the supply line has a backflow check valve for preventing backflow of the flushing water from the toilet side.

6. The flush toilet according to claim 1, further comprising a water quantity regulator for regulating the quantity of flushing water through the supply line to the toilet bowl to a selected one of a plurality of preset flushing water quantities.

7. The flush toilet according to claim 6, wherein the water quantity regulator regulates the quantity of operating water supplied from the nozzle water supply unit through adjustment of a supply time.

8. The flush toilet according to claim 1, further comprising:

a control component that is operated for enabling a user to select one of a plurality of flushing type including a first type flush and a second type flush, the second type flush being different in water quantity from the first type flush, and to instruct the nozzle water supply unit to start the flushing the toilet bowl; and a water quantity setting component for setting the quantity of the flushing water, which is introduced into the toilet through the supply line, according to the selected flushing type, wherein the water quantity setting component sets the flushing water quantity to a first water quantity during the first type flush when the control component is operated for a first instruction of starting to flush the toilet bowl with a first pattern, and sets the flushing water quantity to a second water quantity that is larger than the first water quantity during the second type flush when the control component is operated for a second instruction of starting to flush the toilet bowl with a second pattern.

9. The flush toilet according to claim 8, wherein the water quantity setting component has a limiter for limiting the quantity in which the flushing water in the flushing water tank flows into the throat along with the jetting of flushing water from the spray nozzle.

10. The flush toilet according to claim 9, wherein the limiter limits the quantity in which the flushing water flows into the throat during the first type flush.

11. The flush toilet according to claim 10, wherein the limiter has:

an in-tank shroud that surrounds the jet pump disposed submerged in the flushing water tank;

a water passage component that allows the flushing water in the tank to pass into and out of the in-tank shroud; and a water passage valve that prevents the passage of flushing water through the water passage component during the first type flush, but allows the passage of flushing water through the water passage component during the second type flush.

12. The flush toilet according to claim 8, wherein the water quantity setting component has a water supply variation component that sets the quantity of operating water supplied from the nozzle water supply unit to the spray nozzle to a first supply quantity corresponding to the first water quantity during the first type flush, and to a second supply quantity corresponding to the second water quantity during the second type flush.

13. The flush toilet according to claim 1, wherein the throat is a venturi tube having a constricted portion in which the line diameter is narrower.

14. The flush toilet according to claim 1, wherein the jet pump is composed such that an outer edge of the spray nozzle and an inlet edge of the throat are separated away and a gap, which is formed between the spray nozzle outlet and the throat inlet, opens into the internal space of the flushing water tank.

15. The flush toilet according to claim 14, wherein the spray nozzle is arranged such that its outlet is directed upward.

16. The flush toilet according to claim 15, wherein the spray nozzle is arranged such that its outlet is directed diagonally upward.

17. The flush toilet according to claim 1, further comprising a rim formed so as to encircle an upper edge of the toilet bowl of the toilet, and having a rim water-discharge mechanism that allows flushing water to be discharged from said rim along the surface of the toilet bowl, and the throat arranged across from the spray nozzle being linked to the rim water-discharge mechanism via the supply line.

18. The flush toilet according to claim 1, wherein the jet pump is constructed such that its height inside the flushing water tank is adjustable.

19. The flush toilet according to claim 1, further comprising a tank water supply unit that supplies flushing water to the flushing water tank until the flushing water level reaches the full level of the tank when the flushing water level inside the flushing water tank drops to a predetermined level where water supply is required.

20. The flush toilet according to claim 19, wherein the toilet flushing tank device separatively rests directly on a toilet-body.

21. The flush toilet according to claim 1, wherein the toilet flushing tank device is unseparatively built in the toilet.

22. The flush toilet according to claim 21, wherein the flushing water tank of the toilet flushing tank device is formed integrally with a toilet-body.

23. The flush toilet according to claim 1, wherein the spray nozzle has an annular outlet for the operating water.

24. The flush toilet according to claim 23, wherein the annular outlet is an annular continuous opening.

25. The flush toilet according to claim 23, wherein the annular outlet is formed by annularly disposing a plurality of operating water jetting holes.

26. The flush toilet according to claim 23, wherein the shape of the annular outlet is circular.

27. The flush toilet according to claim 23, wherein the spray nozzle has a flushing water through-passage in which the flow path through the spray nozzle is surrounded by the annular outlet, and which allows the passage of flushing water through the through-passage to the throat.

28. The flush toilet according to claim 1, wherein the jet pump is configured as a jet pump assembly in which a plurality of spray nozzles and a plurality of throats are integrally assembled.

29. The flush toilet according to claim 28, wherein the nozzle water supply unit that supplies the operating water includes:

a main water supply pipe for supplying the operating water to the jet pump assembly; and a plurality of branch water supply pipes that branch off from the main water supply pipe for supplying water to the spray nozzles of the jet pump assembly, and wherein the plurality of throats merge on the terminal side and are connected to the supply line.

30. The flush toilet according to claim 28, wherein the nozzle water supply unit that supplies the operating water to the jet pump assembly includes:

a main water supply pipe for supplying the operating water to the jet pump assembly;

a supply-side manifold that connects said main water supply pipe with the plurality of spray nozzles; and a discharge-side manifold that connects the plurality of throats to the supply line.

31. The flush toilet according to claim 28, further comprising a jetting controller that controls conditions of the flushing water which is jetted from the plurality of spray nozzles.

32. The flush toilet according to claim 28, wherein the toilet flushing tank device has a plurality of the jet pump assemblies, and the supply line is provided for each of the plurality of jet pump assemblies.

33. The flush toilet according to claim 1, wherein the toilet flushing tank device has a plurality of the jet pumps, and the supply line is provided for each of the plurality of jet pumps.

34. The flush toilet according to claim 32, wherein the supply lines are provided in order to guide the flushing water to different places in the toilet.

35. A water supply device for supplying flushing water, comprising:

a flushing water tank that reserves flushing water;

a supply line that is arranged to introduce flushing water in said flushing water tank to its destination and has openings at both end of said supply line, a jet pump having a spray nozzle and a throat disposed across from said nozzle; and a nozzle water supply unit for supplying operating water to the spray nozzle and jetting the operating water from the spray nozzle into the throat, the throat being connected to one end of the supply line so that the flushing water jetted from the throat flows into the supply line, the jet pump being disposed submerged in the flushing water tank so that the flushing water in the flushing water tank flows into the throat along with the jetting of the flushing water from the spray nozzle.

36. The flushing water supply device according to claim 35, wherein the nozzle water supply unit supplies the operating water so that the flushing water jetted from the throat will gushed upward beyond a predetermined full level of the flushing water tank.

37. The flushing water supply device according to claim 35, wherein the throat is a venturi tube having a constricted portion in which the line diameter is narrower.

38. The flushing water supply device according to claim 35, wherein the jet pump is composed such that an outer edge of the spray nozzle and an inlet edge of the throat are separated away and a gap, which is formed between the spray nozzle outlet and the throat inlet, opens into the internal space of the flushing water tank.

39. The flushing water supply device according to claim 35, wherein the jet pump is constructed such that its height inside the flushing water tank is adjustable.

40. The flushing water supply device according to claim 35, wherein the spray nozzle has an annular outlet for the operating water.

41. The flushing water supply device according to claim 40, wherein the shape of the annular outlet is circular.

42. The flushing water supply device according to claim 40, wherein the annular outlet is an annular continuous opening.

43. The flushing water supply device according to claim 40, wherein the annular outlet is formed by annularly disposing a plurality of operating water jetting holes.

44. The flushing water supply device according to claim 40, wherein the spray nozzle has a flushing water through-passage in which the flow path through the spray nozzle is surrounded by the annular outlet, and which allows the passage of flushing water through the through-passage to the throat.

45. The flushing water supply device according to claim 35, wherein the jet pump is configured as a jet pump assembly in which a plurality of spray nozzles and a plurality of throats are integrally assembled.

46. The flushing water supply device according to claim 45, wherein the nozzle water supply unit that supplies the operating water includes:

a main water supply pipe for supplying the operating water to the jet pump assembly; and a plurality of branch water supply pipes that branch off from the main water supply pipe for supplying water to the various spray nozzles of the jet pump assembly, and wherein the plurality of throats merge on the terminal side and are connected to the supply line.

47. The flushing water supply device according to claim 45, further comprising a jetting controller that controls conditions of the flushing water which is jetted from the plurality of spray nozzles.

* * * * *